US008235140B2

(12) United States Patent
Wideman et al.

(10) Patent No.: US 8,235,140 B2
(45) Date of Patent: Aug. 7, 2012

(54) METHODS AND APPARATUS FOR THERMAL DRILLING

(75) Inventors: Thomas W. Wideman, Milton, MA (US); Jared M. Potter, Redwood City, CA (US); Donald Dreesen, Los Alamos, NM (US); Robert M. Potter, Rio Rancho, NM (US)

(73) Assignee: Potter Drilling, Inc., Redwood City, CA (US)

( * ) Notice: Subject to any disclaimer, the term of this patent is extended or adjusted under 35 U.S.C. 154(b) by 363 days.

(21) Appl. No.: 12/575,852

(22) Filed: Oct. 8, 2009

(65) Prior Publication Data

US 2010/0089577 A1 Apr. 15, 2010

Related U.S. Application Data

(60) Provisional application No. 61/103,859, filed on Oct. 8, 2008, provisional application No. 61/140,477, filed on Dec. 23, 2008, provisional application No. 61/140,489, filed on Dec. 23, 2008, provisional application No. 61/140,512, filed on Dec. 23, 2008, provisional application No. 61/236,958, filed on Aug. 26, 2009.

(51) Int. Cl.
*E21B 7/00* (2006.01)

(52) U.S. Cl. ..... 175/11; 175/15

(58) Field of Classification Search ..... 175/11, 175/15

See application file for complete search history.

(56) References Cited

U.S. PATENT DOCUMENTS

| | | | | |
|---|---|---|---|---|
| 2,680,487 | A | 6/1954 | Carpenter | |
| 2,738,162 | A | 3/1956 | Aitchison | |
| 3,045,766 | A | 7/1962 | Fleming | |
| 3,103,251 | A | 9/1963 | Browning | |
| 3,112,800 | A | 12/1963 | Bobo | |
| 3,182,734 | A | 5/1965 | Scott | |
| 3,322,213 | A | 5/1967 | Arnold | |
| 3,344,870 | A | 10/1967 | Morris | |
| 3,476,194 | A | 11/1969 | Browning | |
| 3,576,222 | A | 4/1971 | Acheson et al. | |
| 3,692,127 | A | 9/1972 | Hampe et al. | |
| 3,792,741 | A * | 2/1974 | Hopler, Jr. | 175/11 |
| 3,917,011 | A | 11/1975 | Hester | |

(Continued)

FOREIGN PATENT DOCUMENTS

GB 2082650 A 3/1982

(Continued)

OTHER PUBLICATIONS

Invitation to Pay Additional Fees and, Where Applicable, Protest Fee for Application No. PCT/US09/060010 dated Apr. 7, 2010 (5 pages).

(Continued)

*Primary Examiner* — William P Neuder
(74) *Attorney, Agent, or Firm* — Goodwin Procter LLP

(57) ABSTRACT

Methods and apparatus for spalling a material, for example to thermally drill a wellhole, are provided. Such methods may include directing a fluid having a temperature greater than about 500° C. above the ambient temperature of the material and less than about the temperature of the brittle-ductile transition temperature of the material to a target location on the surface of the material, wherein the fluid produces a heat flux of about 0.1 to about 50 MW/m$^2$ at an interface between the fluid and the target location, and thereby creating spalls of the material.

31 Claims, 23 Drawing Sheets

U.S. PATENT DOCUMENTS

| | | | | |
|---|---|---|---|---|
| 3,934,659 | A | 1/1976 | Tsiferov | |
| 4,066,137 | A | 1/1978 | Frankle et al. | |
| 4,073,351 | A | 2/1978 | Baum | |
| 4,185,703 | A | 1/1980 | Guerber | |
| 4,250,962 | A | 2/1981 | Madgavkar et al. | |
| 4,286,651 | A | 9/1981 | Steiger et al. | |
| 4,369,850 | A | 1/1983 | Barker | |
| 4,431,069 | A | 2/1984 | Dickinson, III et al. | |
| 4,453,597 | A | 6/1984 | Brown et al. | |
| 4,687,491 | A | 8/1987 | Latty | |
| 4,768,709 | A | 9/1988 | Yie | |
| 4,871,037 | A | 10/1989 | Warren et al. | |
| 4,930,454 | A | 6/1990 | Latty et al. | |
| 4,930,586 | A | 6/1990 | Turin et al. | |
| 4,967,840 | A | 11/1990 | Miller | |
| 5,111,891 | A | 5/1992 | Kinnan | |
| 5,335,724 | A | 8/1994 | Venditto et al. | |
| 5,402,855 | A | 4/1995 | Gondouin | |
| 5,499,678 | A | 3/1996 | Surjaatmadja et al. | |
| 5,544,705 | A | 8/1996 | Jones et al. | |
| 5,553,926 | A | 9/1996 | Blackstock et al. | |
| 5,590,715 | A | 1/1997 | Amerman | |
| 5,711,146 | A | 1/1998 | Armstrong et al. | |
| 5,771,984 | A | 6/1998 | Potter et al. | |
| 5,813,465 | A | 9/1998 | Terrell et al. | |
| 5,944,123 | A | 8/1999 | Johnson | |
| 6,024,171 | A | 2/2000 | Montgomery et al. | |
| 6,263,984 | B1 | 7/2001 | Buckman, Sr. | |
| 6,283,214 | B1 | 9/2001 | Guinot et al. | |
| 6,347,675 | B1 | 2/2002 | Kolle | |
| 6,386,300 | B1 | 5/2002 | Curlett et al. | |
| 6,651,741 | B2 | 11/2003 | Bassin et al. | |
| 6,708,763 | B2 | 3/2004 | Howard et al. | |
| 6,742,603 | B2 | 6/2004 | Polizzotti et al. | |
| 6,772,847 | B2 | 8/2004 | Rae et al. | |
| 6,827,144 | B2 | 12/2004 | Nicholson | |
| 6,880,491 | B2 | 4/2005 | Reiner et al. | |
| 7,025,940 | B2 | 4/2006 | Shah et al. | |
| 7,059,405 | B2 | 6/2006 | Farabee et al. | |
| 7,108,730 | B2 | 9/2006 | Shah et al. | |
| 7,264,048 | B2 | 9/2007 | Zupanick et al. | |
| 7,306,042 | B2 | 12/2007 | Bansal et al. | |
| 7,350,577 | B2 | 4/2008 | Howard et al. | |
| 7,441,595 | B2 | 10/2008 | Jelsma | |
| 7,451,818 | B2 | 11/2008 | Addis et al. | |
| 7,503,404 | B2 | 3/2009 | McDaniel et al. | |
| 7,617,873 | B2 | 11/2009 | Lovell et al. | |
| 7,708,073 | B2 | 5/2010 | Richard et al. | |
| 7,740,708 | B2 | 6/2010 | Lofton et al. | |
| 7,814,978 | B2 | 10/2010 | Steele et al. | |
| 7,918,279 | B2 | 4/2011 | Leising et al. | |
| 2002/0113484 | A1 | 8/2002 | Schwoebel et al. | |
| 2003/0164252 | A1 | 9/2003 | Rae et al. | |
| 2005/0139353 | A1 | 6/2005 | Johnson | |
| 2005/0183891 | A1 | 8/2005 | Chrisman | |
| 2007/0284106 | A1* | 12/2007 | Kalman et al. | 166/298 |
| 2008/0053065 | A1 | 3/2008 | Hobson et al. | |
| 2008/0093125 | A1 | 4/2008 | Potter et al. | |
| 2009/0032306 | A1 | 2/2009 | Addis et al. | |
| 2009/0120645 | A1 | 5/2009 | Leising et al. | |
| 2010/0032207 | A1 | 2/2010 | Potter et al. | |
| 2010/0089574 | A1 | 4/2010 | Wideman et al. | |
| 2010/0089576 | A1 | 4/2010 | Wideman et al. | |
| 2010/0218993 | A1 | 9/2010 | Wideman et al. | |
| 2011/0174537 | A1 | 7/2011 | Potter et al. | |

FOREIGN PATENT DOCUMENTS

WO WO-2010072407 A1 7/2010

OTHER PUBLICATIONS

Invitation to Pay Additional Fees and, Where Applicable, Protest Fee for Application No. PCT/US09/060002 dated Apr. 7, 2010 (6 pages).
Invitation to Pay Additional Fees and, Where Applicable, Protest Fee for Application No. PCT/US09/060003 dated Mar. 23, 2010 (7 pages).
Invitation to Pay Additional Fees and, Where Applicable, Protest Fee for Application No. PCT/US09/060007 dated Mar. 3, 2010 (4 pages).
International Search Report and Written Opinion for Application No. PCT/US09/060010 dated Jul. 23, 2010 (22 pages).
International Search Report and Written Opinion for Application No. PCT/US09/060002 dated Jul. 23, 2010 (22 pages).
International Search Report and Written Opinion for Application No. PCT/US09/060007 dated Jun. 18, 2010 (18 pages).
International Search Report and Written Opinion for Application No. PCT/US09/060003 dated Jun. 18, 2010 (22 pages).
Examiner's Report for Australian Application No. 2007230605 dated Mar. 26, 2010 (4 pages).
Aadnoy, Bernt S., et al., "Borehole Stability of Multilateral Junctions," *Journal of Petroleum Science and Engineering* 30 (2001): 245-255.
Aadnoy, Bernt S., et al., "Some Effects of Ellipticity on the Fracturing and Collapse Behavior of a Borehole," *Int. J. Rock Mech. Min. Sci & Geomech Abstr*. 32 (1995): 621-627.
Exadaktylos, G.E., et al., "A Semi-Analytical Elastic Stress-Displacement Solution for Notched Circular Openings in Rocks," *International Journal of Solids and Structures* 40 (2003): 1165-1187.
Gao, Huajian, "Stress Analysis of Holes in Anisotropic Elastic Solids: Conformal Mapping and Boundary Perturbation," *Q.Ji Mech. appl. Math* 45 (1992): 149-168.
Lund, Bjorn, "Crustal Stress Studies Using Microearthquakes and Boreholes, Comprehensive Summaries of Uppsala Dissertations from the Faculty of Science and Technology" *Uppsala University—Sweden* (2000) 517.
Papanastasiou, P., "Localization of Deformation and Failure Around Elliptical Perforations Based on a Polar Continuum," *Computational Mechanics* 26 (2000): 352-361.
Resource Technology, Inc., Tulsa, Oklahoma, "A Technical and Economic Evaluation Thermal Spallation Drilling Techonlogy," Jul. 10, 1984, 253 pages.
Dreesen et al., "Coiled-Tubing-Deployed Hard Rock Thermal Spallation Cavity Maker," 2003, 33 pages.
Calaman et al. (1968). Jet Piercing. In B.A. Kennedy (Ed.), *Surface Mining* (pp. 325-337).
Communication for European Application No. 09736532.4 dated May 26, 2011 (2 pages).
Communication for European Application No. 09793358.4 dated May 26, 2011 (2 pages).
Communication for European Application No. 09737302.1 dated Jun. 21, 2011 (2 pages).
Communication for European Application No. 07759460.4 dated Nov. 13, 2008 (2 pages).
Communication for European Application No. 09736533.2 dated May 25, 2011 (2 pages).
International Search Report and Written Opinion for Application No. PCT/US07/065014 dated Dec. 26, 2007 (4 pages).
Bever, et al., Surface Hardening of Steel, www.accessscience.com/popup.aspx?id=6710000&name=print dated Oct. 5, 2011, 8 pages.
Flame-Jet Drilling in Conway N. H., Granite, dated Nov. 4, 1981, 31 pages.

* cited by examiner

Differential stress , kilobars
50
40
30
20
10
0
2
4
6
8
Strain, percent
400 °C, dry
700 °C, dry
900 °C, dry
1000 °C, dry
natural quartz crystals
950 °C, wet

METHODS AND APPARATUS FOR THERMAL DRILLING

RELATED APPLICATIONS

This application claims priority to U.S. Ser. No. 61/103,859, filed Oct. 8, 2008; U.S. Ser. No. 61/140,477 filed Dec. 23, 2008; U.S. Ser. No. 61/140,489, filed Dec. 23, 2008; U.S. Ser. No. 61/140,512, filed Dec. 23, 2008; and U.S. Ser. No. 61/236,958, filed Aug. 26, 2009, each of which is hereby incorporated by reference in its entirety.

FIELD

In various embodiments, this disclosure relates to methods and apparatus for conducting processes capable of spalling or penetrating a material such as rock. For example, the disclosed methods may be used for preparing boreholes for geothermal energy systems.

BACKGROUND

Drilling very deep boreholes or enhancing existing wells in hard rock far below the earth's surface, e.g. 10,000 feet deep or more, is inherently incompatible with traditional mechanical or contact drilling or rock removal technologies. Low rates of penetration, extreme bit and drill string wear, and excessive time spent "tripping" to replace damaged or worn bits and drill string make conventional rotary and coiled tubing drilling economically non-viable for many deep, hard rock applications.

Several non-contact techniques have been developed for hard rock drilling but may be effective only in shallow and/or air filled boreholes. Most notably, air or flame jet spallation drilling uses a hot gas or flame directed against a rock surface to cause spalling and removal of the rock. This technique, however, is only feasible in shallow, air-filled boreholes. To drill deeper, a borehole must be filled with water or "mud" to provide mechanical stability. In this environment, flames are not viable in part because of the difficulty in generating or maintaining the required flame under the high pressure water column. For example, the high pressures at the bottom of deep, fluid-filled boreholes make behavior of the flames extremely unstable and difficult to maintain. Further, initiating combustion under these conditions is extremely challenging and typically requires an energy source to be provided at the bottom of the borehole. However, using an energy source such as a spark or glow plug would require, e.g., a power cable to be run from the surface, which is not feasible in deep applications. Other energy sources such as flame holders are inherently unstable, especially at such depths.

Further, most combustion reactions produce very high temperature flames, typically 1800-3000° C. or more. Such temperatures can destroy drilling components and require careful addition of cooling water to maintain a temperature that can be withstood by downhole tools. In addition, such high temperatures can melt rock (e.g., into an amorphous glass) so that the rock is then unspallable. Even a momentary interruption in cooling water can transform rock so that it can no longer be spalled and/or destroy downhole components, even if a cooler temperature is recovered. Small changes in the stand-off distance, or distance from the combustion to the rock surface, can result in dramatic changes in the nature of the high temperature flame impingement, which may result in a temperature too low for spallation, or temperatures high enough to soften or melt the rock. Such tight tolerances for stand-off distances are difficult to control at the bottom of a deep borehole.

Further, flame-based combustion systems require multiple conduits for fuel, oxidant and cooling or circulating water. Other approaches to spallation drilling such as the use of electrical heating require sufficient power down hole. In deep drilling operations, multiple conduits or supply of sufficient power through cables from the surface or through transformation of energy by hydraulic flow may not be feasible, or may be simply impossible.

Combustion systems that require the use of gaseous oxidants, such as air or oxygen, are also unsuitable for deep fluid filled borehole conditions, in part because the pressures required to pump these gases against a hydrostatic column of a fluid filled borehole are sometimes impossible to achieve, and even if possible, have associated safety risks.

There is a need for a method that fulfills the promise of thermal spallation drilling in high pressure, water filled boreholes. If the challenge of drilling deep boreholes in hard rock is not solved, EGS may not become the much needed clean alternative to meeting our current and future global energy needs.

SUMMARY

The present disclosure relates, at least in part, to a method of reducing near wellbore impedance, or reducing the restriction to fluid flow in the immediate vicinity (e.g. 1 inch to about 3 feet) of an existing borehole wall) by providing a spallation system to e.g. increase the diameter of a section of an existing borehole or well, for example a geothermal well.

For example, a method of spalling a material, in accordance with one aspect of the invention, includes directing a fluid having a temperature greater than about 500° C. above the ambient temperature of the material and less than about the temperature of the brittle-ductile transition temperature of the material to a target location on the surface of the material; wherein the fluid produces a heat flux of about 0.1 to about 50 $MW/m^2$ at an interface between the fluid and the target location, and thereby creating spalls of the material. The fluid may have a temperature greater than about 600° C. and/or a temperature less than about 900° C.

In some embodiments, the method may further include providing a spallation system comprising one or more nozzles. The fluid may be directed through the at least one nozzle to the target location. The fluid may produce a heat flux of about 1 to about 20 $MW/m^2$ at an interface between the fluid and the target location. The nozzle may be adapted to direct the heated fluid from the drilling system substantially along an elongate central axis of the drilling system.

Some embodiments of the invention may include directing the fluid from the at least one nozzle in a cyclically pulsing flow or in a substantially continuous flow.

In some embodiments, the method may further include selecting the fluid to have a specified value of a parameter selected from the group consisting of a temperature, a heat flux, an exciting jet velocity, a heat capacity, a heat transfer coefficient, a Reynolds number, a Nusselt number, a density, a viscosity, and a mass flow rate.

The fluid may have an exiting jet velocity of about 400 to about 700 m/s, and/or have a heat capacity of about 2.26 to about 3 kJ/kg·K. The heat transfer coefficient of the fluid may be about 38 to about 56 $kW/m^2 \cdot K$. The directed fluid may have a Reynolds number of about $0.5 \times 10^6$ to about $60 \times 10^6$, and/or have a Nusselt number of about 30 to about 45 or about 740 to about 1040. The fluid may have a density of about 0.01 to about 0.1 g/cm$^3$, and/or a viscosity of about 0.025 to about 0.045 cP.

Some embodiments further include monitoring at least one property of the spalls, such as, but not limited to, the spall size and/or shape. The method may, in some embodiments, include adjusting the fluid temperature and/or heat flux to maintain a pre-determined spall size. For example, at least one parameter of the method may be adjusted in response to a change in the at least one of a property of the spalls, a hole diameter, a rate of penetration, and a standoff distance.

The fluid may be monitored after the fluid is in contact with the material and/or after spalls have formed. Contemplated fluids include water or mud. The material may be rock.

Also contemplated herein is a method for penetrating or reacting rock including the steps of contacting a fluid having a temperature greater than about 500° C. above the ambient temperature of the material and less than about the temperature of the brittle-ductile transition temperature of the material to a target location on the surface of the material, wherein the fluid produces a heat flux of about 0.1 to about 50 MW/m$^2$ at an interface between the fluid and the target location, and directing said fluid to said rock, thereby effecting penetration of the rock and/or forming a reacted rock region.

Contemplated methods may also include a method for excavation of a borehole in a geological formation, including using a thermal drilling system to create a pilot borehole in a geological formation, measuring at least one property of the geology of the pilot borehole, evaluating the at least one measured property to determine whether to enlarge the pilot borehole, and enlarging the pilot borehole if the at least one measured property meets a set requirement. The thermal drilling system may be a spallation drilling system.

In some embodiments, the pilot borehole is enlarged by inserting at least one drilling system into the pilot borehole.

The evaluating step may include evaluating whether the geological formation is suitable for use as an injection or production borehole for at least one of a geothermal system, resource mining, excavation, or $CO_2$ or nuclear sequestration or storage. The property of the geology of the pilot borehole may be evaluated by evaluating at least one property of a fluid exiting the borehole. The fluid may be at least one of a spallation fluid, a cooling fluid, and a drilling mud.

In some embodiments, using a thermal spallation system includes directing a fluid having a temperature greater than about 500° C. above the ambient temperature of the rock and less than about the temperature of the brittle-ductile transition temperature of the rock to a target location on the surface of the rock; wherein the fluid produces a heat flux of about 0.1 to about 20 MW/m$^2$ at an interface between the fluid and the target location.

Also contemplated herein is a method of monitoring an excavation of a borehole in a geological formation, including the steps of providing a thermal spallation system comprising at least one jet nozzle, directing a heated fluid, having a temperature from about 500° C. to about 900° C., from the jet nozzle against a target location at a distal portion of a borehole in the geological formation, wherein said heated fluid has a heat flux of about 0.1 to about 20 MW/m$^2$, to create spalls in the target location, carrying the spalls and heated fluid from the target location to a surface location through the borehole, and measuring a property of at least one of the spalls and the heated fluid, wherein the at least one property of the spalls is related to a parameter of the excavation. The thermal spallation system may include a catalyst element.

Both a property of at least one of the spalls and a property of the heated fluid may be measured. The spalls may, for example, be measured at the surface location. Contemplated properties of at least one of the spalls include at least one of a size, a shape, a temperature, and/or a chemical composition. The heated fluid may, for example, be measured at a downhole location, or at a location removed from the downhole location. The property of the heated fluid may include at least one of a temperature and a chemical composition. In some embodiments, the measuring step includes at least one of a thermal measurement, an optical measurement, an acoustic measurement, a chemical measurement, and a mechanical measurement.

Some embodiments of the invention further include introducing a flow of water or mud into the borehole. The flow of water or mud may be carried down the borehole in at least one conduit. The flow of water or mud may at least partially form an ascending fluid stream capable of carrying spalls to a surface location.

Contemplated methods may further include adjusting a parameter of the thermal spallation system in response to a change in at least one of a property of at least one of the spalls, a property of the heated fluid, a hole diameter, a rate of penetration, and a standoff distance.

Also contemplated herein is an apparatus for spalling rock including a fluid heating means adapted to heat a fluid to a temperature greater than about 500° C. above the ambient temperature of a surrounding material and less than about the temperature of the brittle-ductile transition temperature of the material, and at least one nozzle adapted to direct the heated fluid onto a target location on the surface of the material, wherein the fluid produces a heat flux of about 0.1 to about 50 MW/m$^2$ at an interface between the fluid and the target location, and thereby creating spalls of the material.

The fluid heating means may be adapted to heat a fluid to a temperature greater than about 600° C., and/or a temperature less than about 900° C.

The apparatus may further include a spallation system comprising at least one nozzle. The at least one nozzle may be adapted to direct a fluid to the target location. The fluid may produce a heat flux of about 1 to about 20 MW/m$^2$ at an interface between the fluid and the target location. The fluid may be directed through one nozzle.

In some embodiments, the apparatus may include a means of monitoring at least one of a property of the spalls, a hole diameter, a rate of penetration, and a standoff distance. For example, the spall size and/or shape may be monitored. The apparatus may further include a means of adjusting the fluid temperature and/or heat flux to maintain a pre-determined spall size.

In some embodiments, the apparatus may include a means of monitoring the fluid after the fluid is in contact with the material. The fluid may include water, mud, and/or an additive.

Also contemplated herein is a system for excavation of a borehole in a geological formation, including a thermal system to create a pilot borehole in a geological formation, a means of measuring at least one property of the geology of the pilot borehole, and a drilling system adapted to enlarge the pilot borehole. The thermal system may include a fluid heating means adapted to heat a fluid to a temperature greater than about 500° C. above the ambient temperature of a surrounding material and less than about the temperature of the brittle-ductile transition temperature of the material, and at least one nozzle adapted to direct the heated fluid onto a target location on the surface of the material, wherein the fluid produces a heat flux of about 0.1 to about 50 MW/m$^2$ at an interface between the fluid and the target location, and thereby creating spalls of the material. The fluid heating means may be self-energized.

The drilling system may include at least one of a spallation drilling system and a mechanical drilling system. The measuring means may be located substantially at the proximal end of the borehole and/or substantially at the distal end of the borehole. The thermal system may include a single nozzle, or a plurality of nozzles.

Also contemplated herein is method of spalling a material, including providing a thermal system capable of providing a heated fluid having a temperature greater than about 500° C. above the ambient temperature of the material and less than about the temperature of the brittle-ductile transition temperature of the material, and directing the heated fluid to a target location on the surface of the material, wherein the fluid produces a heat flux of about 0.1 to about 50 $MW/m^2$ at an interface between the fluid and the target location, and thereby creating spalls of the material.

In some embodiments, the thermal system includes a catalyst. The method may further include contacting one or more unreacted fluids with the catalyst to generate the heated fluid. The unreacted fluid may include an oxidant and/or a fuel.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

Figure 1A:
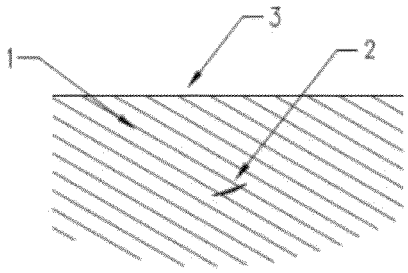
FIGS. 1A-1E are schematic views of a spallation process, in accordance with one embodiment of the invention.
Figure 1B:
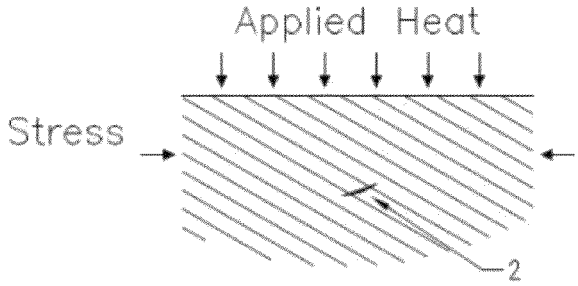
Figure 1C:
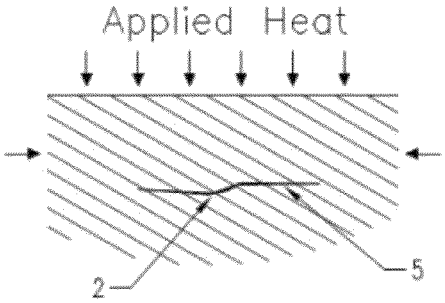
Figure 1D:
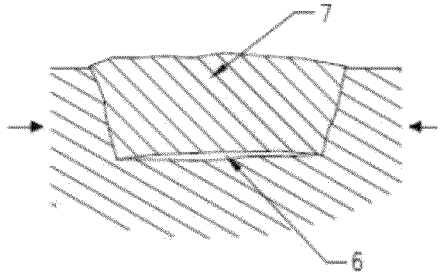
Figure 1E:
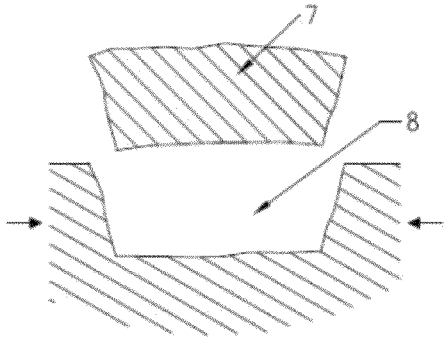

The present disclosure relates, at least in part, to methods and systems for use in spallation, fracturing, loosening, or excavation of material such as rock, for example, methods of making or excavating boreholes, and/or enlarging existing boreholes. Such methods include using a disclosed working fluid or reacted fluid, e.g. a working fluid capable of producing a heat flux of about 0.1 to about 50 $MW/m^2$ when in contact with rock.

Methods

For example, provided herein are systems and methods that may be capable of creating 20 feet of an e.g., 8 inch borehole in about hour, or 20 feet of a 4 inch borehole in about an hour or less, or about a 0.2 inches of ~1 inch borehole in about 4 minutes. Also provided herein are systems or methods for opening a length of existing borehole, e.g. with an original diameter of that may be as small as 4 inches, to a final diameter of about 36 inches or more, which in some embodiments may be accomplished in 12-24 hours, or days. Contemplated systems and methods may be used to create boreholes, shafts, caverns or tunnels in a target material such as crystalline rock material, silicate rock, basalt, granite, sandstone, limestone, peridotite, or any other rocky material. Disclosed systems and methods may also be used for producing multilaterals from an existing borehole, which in turn may be opened. In certain embodiments, disclosed systems and methods may be used, for example, to create vertical boreholes, horizontal boreholes, deviated boreholes, angled boreholes, larger diameter boreholes, curved boreholes, or any combination thereof. Also provided herein are systems and methods that may spall rock at a rate of about 100 $ft^3$/hour or more, which may be useful for example for the creation of tunnels, caverns, mineshafts, and the like.

For example, also provided herein are methods to reduce existing wellbore impedance and/or improve production of existing wells (e.g. EGS wells). Such methods may include, for example, increasing the diameter of at least portions (e.g. a working, producing, or production zone or portion—one or more sections that are typically significantly downhole, may be uncased, or cased with slotted or perforated casing, and where substantially most of the energy output or fluid production occurs, for example, in an EGS well) of an existing wellbore.

The systems and methods disclosed herein may include sensors such as gyroscopes, magnetometers, and/or inclinometers, for monitoring the orientation of the drilling systems. Systems and methods may also include at least one of temperature and/or pressure sensors, flow sensors, natural rock gamma ray sensors, resistivity/conductivity sensors and rock and/or pore space density sensors, to identify rock properties and hydrologic conditions that may influence the desired trajectory, for example, of the borehole/drill hole. For example, sensors may be provided to selectively monitor flow entry points and/or temperature changes of fluids that will influence the target which influences desired direction of drilling or hole opening. In one embodiment, the methods and systems described herein provide for deep borehole drilling, for example from approximately 1,000 feet to about 50,000 feet, or 5,000 feet to about 50,000 feet, or about 10,000 feet to approximately 50,000 feet below the surface, or more. In other embodiments, methods and systems described herein provide for hole openings in e.g. production zones of a wellbore. One or more wellbore diameters may be increased by about 0.1 to 10 feet or more. In other embodiments, for example, substantially perpendicular holes relative to a production zone of an existing well can be formed that may be about 1 to about 1,000 feet or more in length. Also contemplated herein are the formation of parallel/collinear slots, multilaterals (similar to branching of a tree) or horizontal deviations, which may be used to increase production from e.g. a single, substantially vertical wellbore. These multilaterals may be further hole opened.

For example, provided herein are systems and/or methods that may be configured for drilling boreholes in hard rock for geothermal, enhanced or engineered geothermal systems (EGS), and/or oil and gas applications, natural gas production or enhanced oil recovery or unconventional oil production, using a disclosed working fluid to spall rock. However, the systems and methods described herein may also be used for other applications such as, but not limited to, exploratory boreholes, test boreholes, boreholes for scientific study or resource assessment, quarrying, ground source heat pumps, water wells, resource mining (conventional or solution mining), combined HDR (hot dry rock) solution mining, gas or liquefied natural gas (LNG) applications, $CO_2$ sequestration capture or storage, storage of water or other resources, nuclear waste disposal, thermal or supercritical oxidations of wastes, downhole chemical processing and/or tunnel or cavern creation (new or in conjunction with an existing well).

For example, methods are provided herein for increasing the diameter along a section of an existing geothermal well or borehole, for example, methods are provided for creating substantially axial (i.e. substantially parallel/collinear with the wellbore) slots along the length of a working portion or production zone of an existing borehole, methods of perforating an existing borehole (e.g. creating holes substantially perpendicular to the wellbore); methods for creating radial branches off of and/or stemming from an existing borehole (e.g. intersecting a production zone); and/or methods of creating one, two, or a plurality of substantially axial slots along a length of an existing borehole, wherein the methods include using a disclosed working fluid. The axial slots or radial branches may be oriented, in some embodiments, so as to intersect the greatest number of fractures or to be facing the injection well. Also contemplated herein are methods for substantially expanding the diameter of a wellbore along a given length, or for removing a portion of material by spallation, whereby the spallation induces further fracturing, collapse or break-out of the rock wall.

Methods contemplated herein also include hydrothermal reactions, explosions or detonations, which take place in the wellbore or fractures for only a finite period. For example, an unreacted fluid may be pumped into the wellbore and/or allowed to penetrate the fractures. A reaction may then be initiated by e.g. a catalyst "pill" sent down the drill string or by exposing a sample of catalyst in a downhole tool, initiating a hydrothermal reaction and causing spallation in fractures and macrofracturing in wellbore.

Alternatively, the wellbore may be cooled by traditional means of circulating fluids. An unreacted fluid which has a Self Accelerating Decomposition Temperature (SADT)—a temperature at which reaction runs away and propagates—that is below the formation temperature may then be injected into the wellbore and fractures. As the formation is allowed to recover from the cooling treatment, the reaction may initiate, with or without the use of a catalyst.

In some embodiments, two or more components of the unreacted fluid, e.g. fuel and oxidant may be delivered through the conduit in "slugs" so that there is no chance of a premature reaction in the conduit. Once the desired mixture of e.g. fuel and oxidant have been created in the wellbore, the reaction can be initiated by e.g. a catalyst pill, exposing a catalyst in the tool, auto-initiated, or by allowing the wellbore to warm. Since high concentrations of e.g. fuel and oxidant can be delivered by this "slug" flow, it may be possible to produce an unreacted fluid mixture e.g. above the detonation limits which allows for propagation of the reaction and shock-wave throughout the producing zone and/or fractures, creating spallation and fracturing.

In general, as discussed herein, "spallation" refers to the breaking away of surface fragments of a material, e.g. rock "spall" refers to the fragments of material formed by a process of spallation. A thermal spallation process can refer to a spallation process that uses a working fluid other than air, such as working fluid that includes water (e.g., hydrothermal spallation resulting from the creation of high temperature water from hydrothermal oxidation reaction as disclosed herein), water or oil based drilling muds, supercritical fluids, and the like.

Disclosed herein, in an embodiment, is a spallation method that may use a means, for example, a hydrothermal means, a flameless means and/or a self-energized means, e.g., a means that does not use a separate energy source to initiate or generate a chemical reaction to produce a heated, working fluid and/or a means that does not include a flame. For example, a flameless chemical means may include a reaction such as a hydrothermal oxidation reaction, or a reaction that includes a physical change in the reacting fluids, e.g., a phase change and/or solvation. An exemplary hydrothermal oxidation reaction is the catalyzed reaction of aqueous methanol and aqueous peroxide. It is understood by a person skilled in the art that a flameless hydrothermal reaction refers to an exothermic reaction that produces heat but does not produce a flame. A flameless reacted fluid is the product of a flameless hydrothermal reaction. For example, a contemplated hydrothermal oxidation reaction may produce visible light through diffuse ionization, but does not produce light from a flame, as does combustion. In some embodiments, contemplated reactions are aqueous and flameless. Such reactions are substantially stable in the presence of water or increased temperature or pressure. Contemplated reactions are distributed through water so the reacted temperature may be produced at a desired temperature (e.g., below the limits of tool construction or at a desired jet temperature) without e.g. requiring mixing of cooling water. In some embodiments, contemplated fuel and/or oxidant may be delivered to the drill head down a single conduit at e.g., near pressure balance with the fluid in the borehole.

Such means may allow the application of a working fluid to a surface zone of a target material such as a hard and/or crystalline rock with substantially high heat flux. Provided herein, for example, are means to form a working fluid for e.g. borehole creation or borehole enlargement which may produce a heat transfer capability of about 0.1 to about 20 $MW/m^2$, or about 1.0 to about 30 $MW/m^2$, about 0.5 $MW/m^2$ to about 8 $MW/m^2$, about 0.1 $MW/m^2$ to about 8 $MW/m^2$, or about 2 $MW/m^2$ to about 7 $MW/m^2$, when in contact with the material. For example, provided herein are means to form a working fluid may produce a heat flux of about 0.1 to about 10 $MW/m^2$, or about 1.0 to about 10 $MW/m^2$, about 0.5 $MW/m^2$ to about 8 $MW/m^2$, or about 1 to about 8 $MW/m^2$ or about 2 $MW/m^2$ to about 7 $MW/m^2$, when in contact with the material.

In an alternative embodiment, provided herein are means for producing a working fluid having a heat flux of about 0.01 to about 10 $kW/m^2$ when in contact with material. Such a heat flux may be used to form e.g., caverns, tunnels and mine-shafts, or for enlarging the diameter of an existing borehole, for example, using a lower heat flux process.

Figure 9:
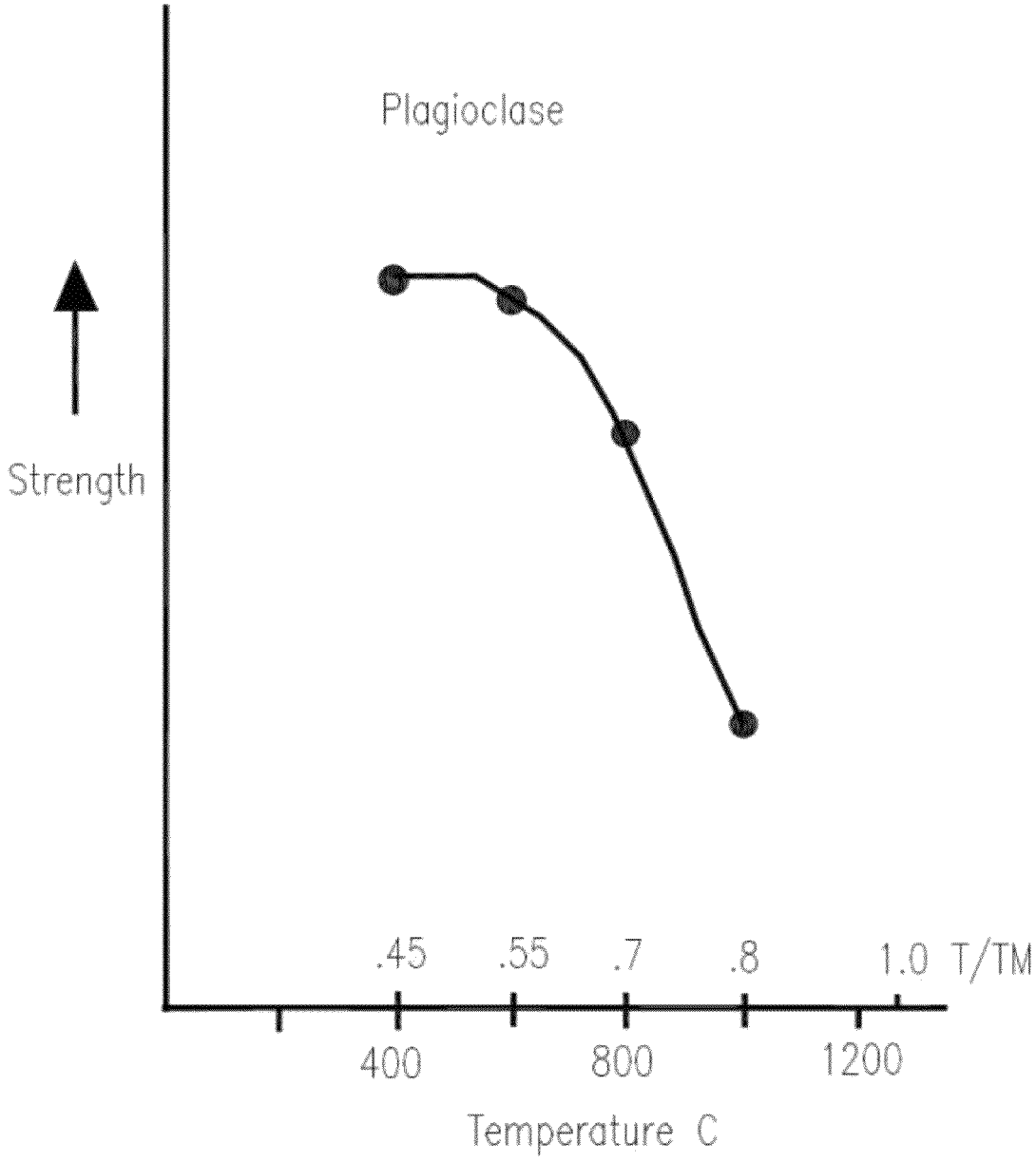
FIG. 9 is a graphical representation of thermal effects on the strength of plagioclase feldspar, in accordance with one embodiment of the invention.
Figure 10:
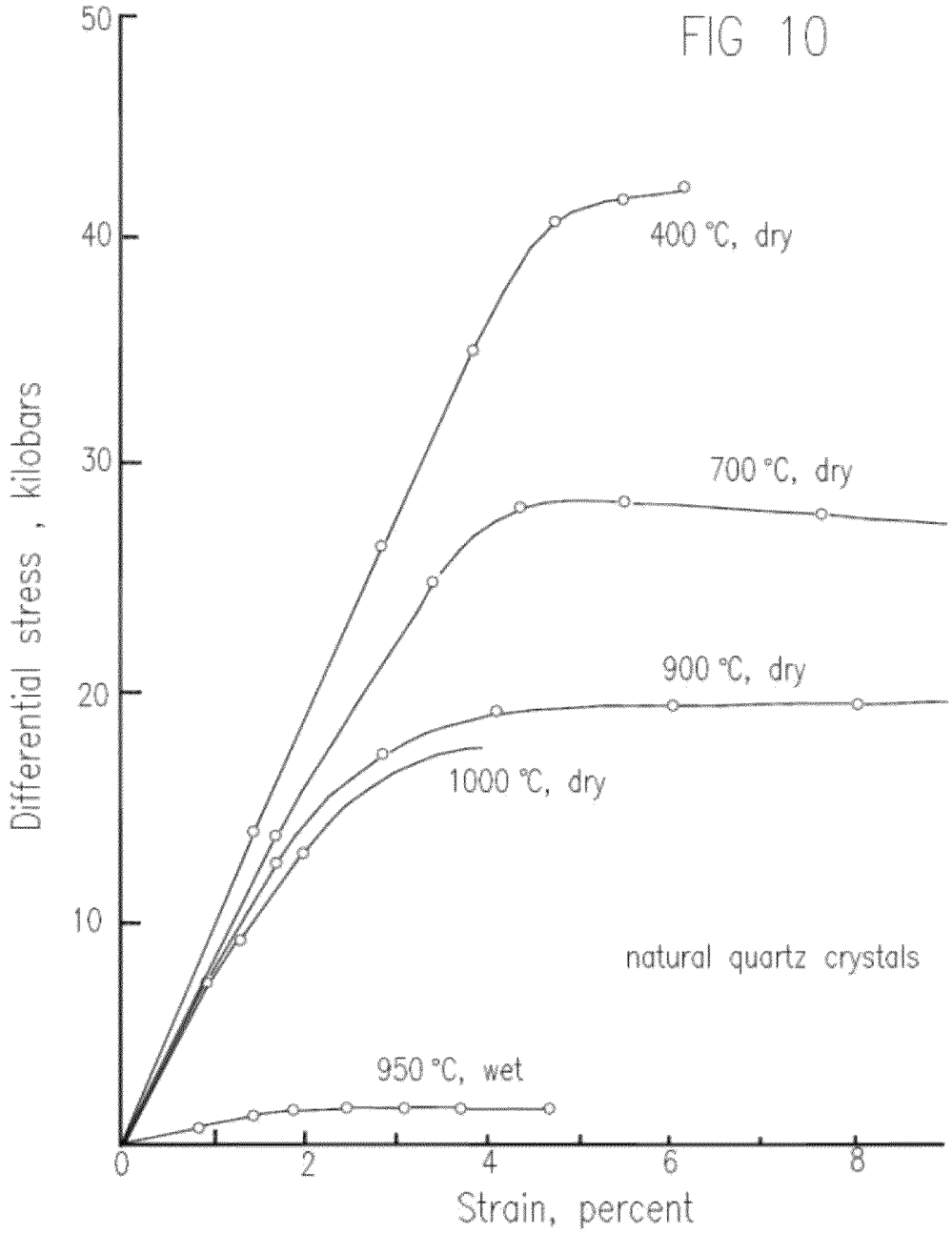
FIG. 10 is a graphical representation of differential stress vs. strain on natural quartz crystals at various temperatures both dry and water saturated, in accordance with one embodiment of the invention.
Figure 11:
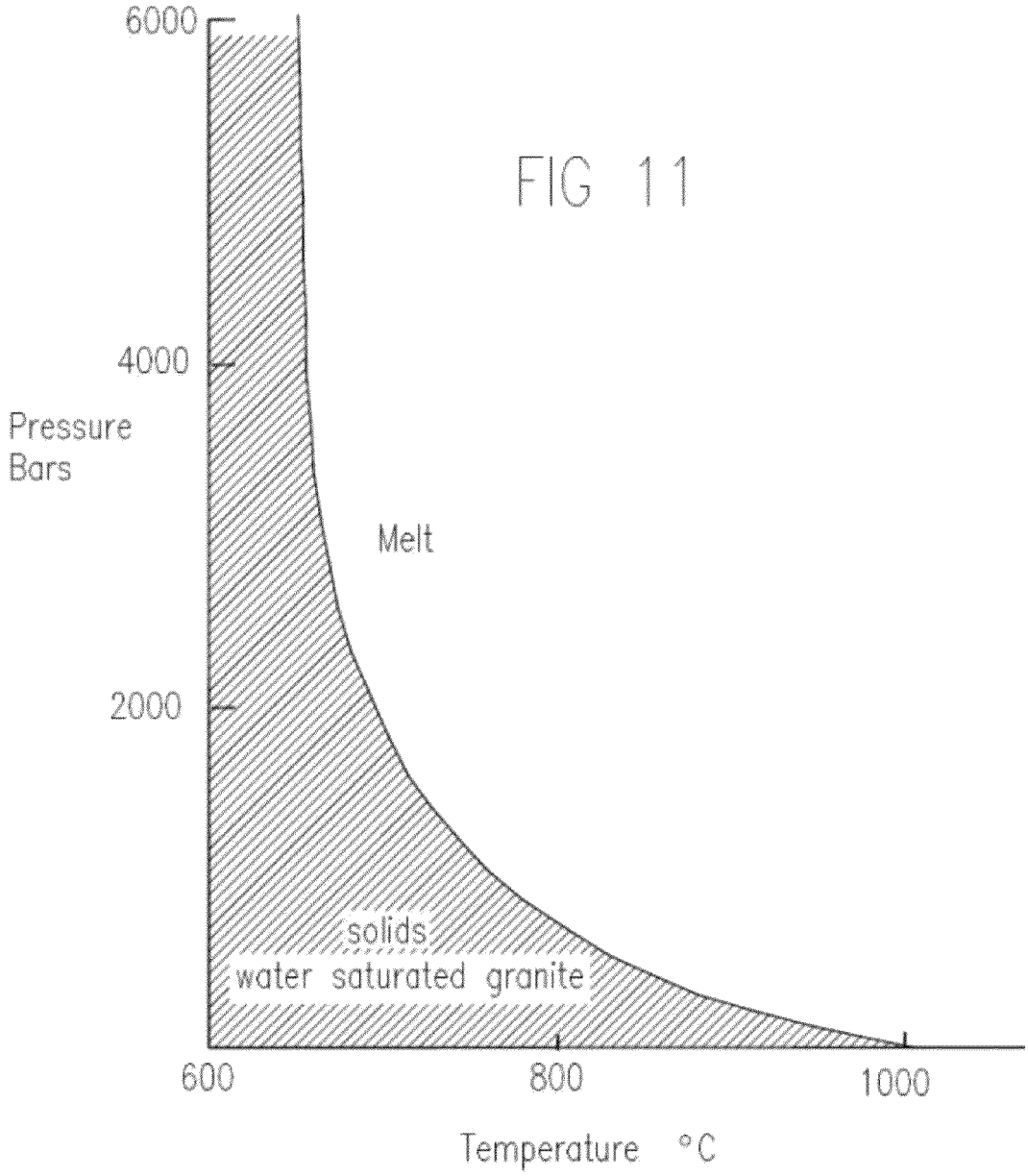
FIG. 11 is a graphical representation of an experimentally determined melting curve for water saturated granite mixture vs. pressure, in accordance with one embodiment of the invention.

In some embodiments, the disclosed methods, means, and apparatus are capable of achieving and/or maintaining (in for example, a reaction chamber) or directing a reacted fluid towards e.g. a rock surface at a temperature that is not substantially higher than a certain desired temperature (for example not substantially higher that the desired working fluid or the limits of materials of construction of the system and/or apparatus), e.g. to achieve and/or maintain a reacted fluid temperature between about 500° C. (or about 500° C. above the ambient rock temperature), and about 900° C., or about the temperature of rock fusion and/or brittle ductile transition. In some embodiments, maintaining such a reacted fluid temperature may be more advantageous as compared to known techniques such as air spallation and/or flame spallation, which can use high combustion temperatures that can induce melting or fusing of rock or can damage downhole hardware. For example, FIG. 9 depicts brittle ductile measurements on feldspar samples under no loading and with overburden pressure applied to the material. It will be appreciated that the temperature that induces melting or fusing of rock, or the brittle/ductile transition may vary with the type and/or nature of rock. For example, FIG. 10 depicts the relationship between differential stress and strain on natural quartz crystals for variations in temperatures and water content, while FIG. 11 shows how the melting curve for water saturated granite is affected by pressure. Furthermore, it can be appreciated that using a heat source which exceeds this temperature may lead to undesirable transformation of the rock, such as melting or softening. For example, if it occurred, such undesired melting or softening may impede further spallation.

In some embodiments, such a temperature and/or heat flux is necessary for the spallation of rock by e.g. creating enough heat flux to remove spalls while e.g. substantially maintaining a temperature that does not e.g. degrade materials of construction and/or fuse or soften rock, minerals or grain boundaries which may make rock substantially more difficult to spall. For example, applying a working fluid having substantially high heat flux when in contact with rock may cause grains within the rock to expand and thereby produce microfractures within the rock. The growth of such microfractures may result in a fractured region that spalls, buckles and/or separates from the surface of the rock or material. When such spall is ejected from the rock surface, it exposes fresh material below the spall, and the spall process may continue. An exemplary spallation process is shown in FIG. 1. Such spallation processes may be easier when, for example, pre-existing stress in rock, e.g. lithostatic loading or deviatoric (non-uniform) loading, is present.

In the thermal spallation process of FIG. 1, a rock 1 has an exposed surface 3 which contains, near the surface, a small flaw 2 in the mineral structure. Heat is applied to the rock surface 3 by a high temperature source, such as a supersonic flame jet or hydrothermal jet. The rock 1 may be subjected to the natural stress found in the ground which acts on the grain in all directions, but is typically lowest in a direction perpendicular to the exposed mineral surface. As the mineral starts to expand from the applied heat, stresses parallel to the exposed surface increase, so the flaw 2 starts to grow 5 to relieve the stress. The flaw may expand to a size 6 where the grain or portion of the grain 7 is separated from the rock 1, thereby leaving a void 8 and a fresh surface for further heat transfer and spallation.

In some embodiments, the heat flux and/or temperature of the working fluid may be adjusted to produce or facilitate rock removal processes such as macrofracturing, dissolution, partial melting, softening, change in crystalline phase, decrystallization, or the like. For example, removal of large volumes of rock such as in the creation of caverns, mine shafts or tunnels, or larger hole opening processes, such as reducing near wellbore impedance, may require lower heat fluxes.

Substantially high heat fluxes may produce small spalls, which in turn may improve lift (and removal) from the borehole. For example, spalls produced by methods disclosed herein are, in some embodiments, approximately less than or about 0.1 mm to about 2.0 mm thick and may have diameters less than or about 1-20 times, or about 1 to about 5 times, their thickness. In some embodiments, spalls may be produced that are less than or about 0.1 mm to about 2.0 mm in all dimensions. In some embodiments, spalls as large as 10 mm may be formed; these spalls have significant thermal damage and microfracturing which may cause them to be broken down further in the flow streams or by mechanical forces in the wellbore during drilling.

In some embodiments, such as hole opening using lower heat fluxes, created spalls may be on the order of inches to several feet; these spalls may be left in place, allowed to fall into an existing cavern or "rat hole" (existing below the production zone), or may be reduced and/or removed by a secondary process such as mechanical drilling. Non-removal of such formed spalls may be advantageous, e.g. smaller conduits may be needed to transport fluids to and from the bottom of the hole. Substantial non-removal of spalls may be particularly advantageous if larger spalls are generated by lower heat fluxes. In other embodiments, any rock that is removed may intentionally makes the hole less stable, resulting in break-out or cave-ins, further expanding the diameter without requiring the complete spallation of all of the loosened material.

In some embodiments, seismic or acoustic monitoring of the fracturing or the sound in the section of the borehole may provide information as to the size and extent of spalling and the size or shape of the resulting borehole. In other embodiments, the methods and apparatus disclosed herein also provide for an additional down hole fluid, which may improve buoyancy or lift of cuttings (for example, improved buoyancy in aerated foams, liquid water or drilling mud as compared to air used in flame jet spallation) and may, in some embodiments, assist in transport of particles to the surface of the wellbore where they can be separated from e.g., water using standard oilfield (or geothermal) drilling technologies such as, but not limited to, shaker screens, mud pits, and hydrocyclone de-sanders, and de-silters. In some embodiments, the methods of spallation disclosed herein produce substantially smaller cuttings or spall in comparison to conventional rotary drill cuttings. In another embodiment, the methods of spallation disclosed herein provide for substantial control over the size of spalls formed, by e.g. controlling heat flux and/or temperature e.g. of a heated or reacted fluid.

In another embodiment, application of a high heat flux (e.g. using a reacted or working fluid) on the surface of the target material may result in a thermally affected zone or reacted rock region. For example, a thermally-affected zone having reduced mechanical strength (due to e.g. microfracturing, macrofracturing, softening, and/or annealing), which may extend as much as about ¼ inch or more below the rock surface, may be created by a disclosed reacted or working fluid inducing e.g. a substantially high heat flux. Provided herein is a method for penetrating or reacting rock, e.g. a method for forming a reacted rock region, which may be suitable for penetration using conventional mechanical rock drills. (For example, such reacted rock region may be easier to drill using mechanical rock drills as compared to a rock region that has not been reacted). Such a method may therefore further include mechanically drilling, reaming, or otherwise removing the reacted rock, as described below. For example, removing the reacted rock may increase the diameter or improve the shape of the well.

Figure 20:
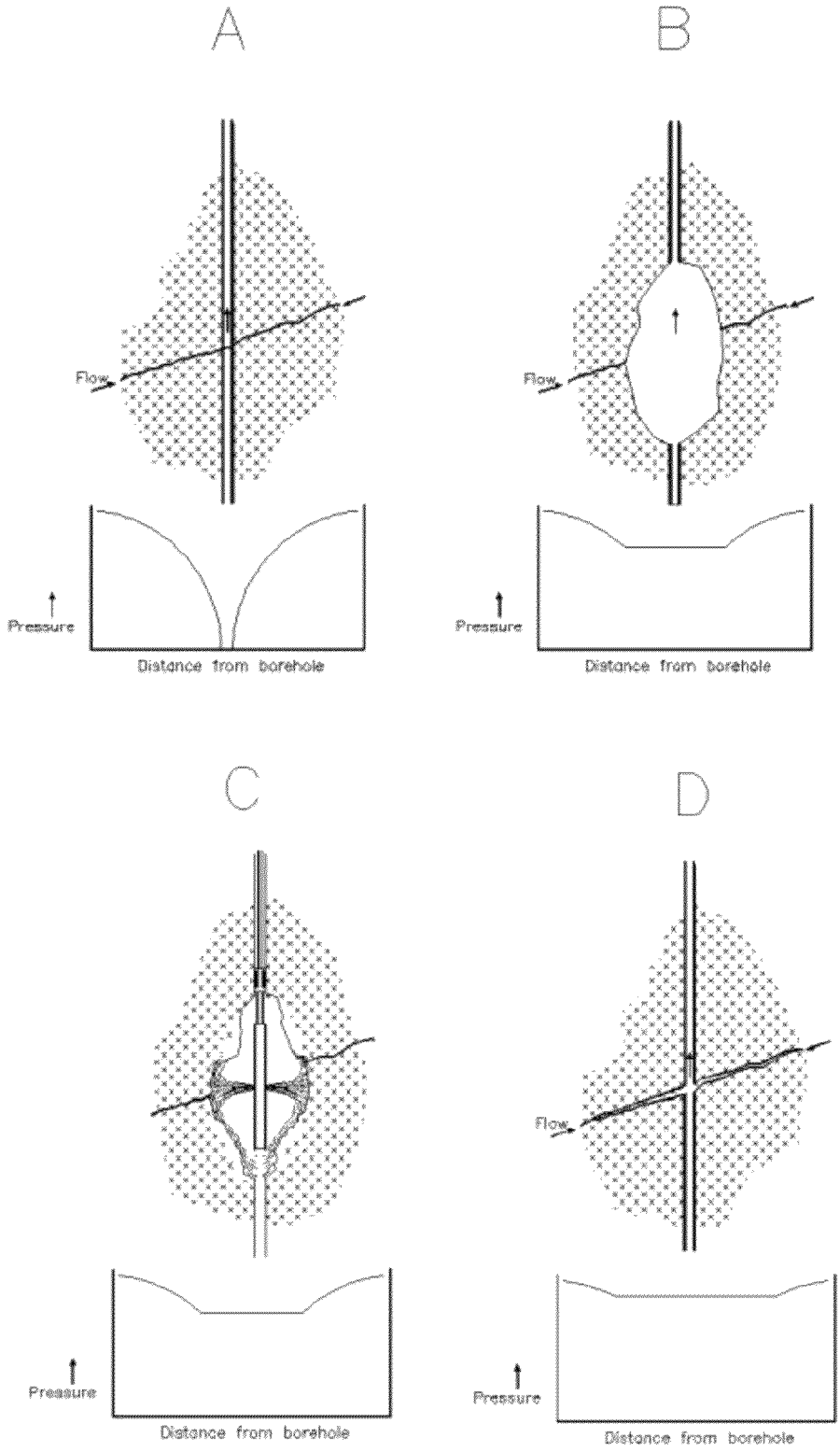
FIG. 20 A-D show schematic views of a fracture intersecting a wellbore: (A) with high near wellbore impedance; (B) globally opened; (C) to reduce the near wellbore impedance; and (D) with the fracture preferentially opened to produce to reduce near wellbore impedance.

Near wellbore impedance may occur where fractures intersect a wellbore, as shown, e.g., in FIG. 20A. In one embodiment, a method of fracture enlargement is provided, e.g. to reduce wellbore impedance, by using a provided working fluid in a wellbore. Pressure in an existing well may be controlled, in some embodiments, by e.g., "shutting in the well", "zonal isolation" or by "packing off" the length of the borehole being treated such that the working fluid is forced into or near fractures (e.g. identified fractures or fractures along an isolated zone), inducing spallation or geomechanical changes at the surface of the fracture, enlarging the fracture, and thereby resulting in an improvement in the flow of fluids through the fracture, as shown, e.g., in FIG. 20D. In other embodiments, the pressure in an existing well may be controlled to prevent flow of the fluid into the fractures, by either maintaining neutrally or "underbalanced" conditions. In other embodiments, the pressure may be varied or cycled; this may assist in blowing produced spalls or fractured rock out of the fractures or away from the borehole wall. Pressure or flow may also be cycled to allow for the measurement of flow and temperature from the borehole to determine how effective the treatment has been, or if additional treatment is necessary. In other embodiments, the wellbore may be expanded more globally, by removing the rock in and around the fracture, also leading to a reduction in wellbore impedance, as shown, e.g., in FIGS. 20B and 20C. In other embodiments, the walls of the borehole can be spalled to create features such as slots or perforations that may be designed to better intersect the existing fractures or to weaken the walls of the wellbore in that location so as to induce further collapse and expansion of the wellbore, leading to a further reduction in impedance. In some embodiments, the reacted fluid may comprise other chemicals which may assist in the process of reducing wellbore impedance, e.g. chemicals which increase or decrease the solubility of certain minerals. Incorporation of these chemicals either from the unreacted fluid or from a separate stream, may be used to prevent minerals from being dissolved by the high temperature fluid jet and/or or being redeposited in the cooler fractures, or may be used to facilitate dissolution of the minerals in either the spalls or along the fracture walls. These chemicals may include alcohols e.g. methanol, or bases e.g. hydroxides, or combinations of the two, such as alcoxides. Alternatively, these chemicals may include acids, such as HCl, HF or the like.

The disclosed methods and apparatuses of e.g., spalling rock, can be applied to any formation of rock, for example, can be applied to a subterranean formation in which the hydrostatic head of fluid in the borehole produces a pressure at the bottom of the borehole that does not exceed the fracture pressure of the formation. In some embodiments, during operation of the disclosed methods, the pressure of a borehole may be maintained below the formation's fracture pressure or above the pressure of exposed permeable formations to prevent inflow. For example, a drilling mud may be used to vary the hydrostatic pressure in the borehole or to create partial isolation of the working zone.

The methods described herein may further include monitoring properties (e.g. size, shape, temperature and/or chemical composition) of the formed spalls and/or may include adjusting or monitoring e.g. a working fluid temperature and/or heat flux, to e.g., optimize rate of penetration or maintain a pre-determined or desired range of spall sizes. Such measurements may be performed by e.g., an optical measurement, seismic measurement, an acoustic measurement, a chemical measurement, and/or a mechanical measurement. For example, fluid flow and temperature sensors coupled with computational models may be used to determine heat flux at e.g. the bottom of the borehole. In some embodiments, chemistry of the returning fluid (e.g. fuel, oxidant or combustion products) may be monitored to e.g. adjust the downhole reaction conditions or as an indicator of system, e.g., combustion or oxidation catalyst efficiency. For example, CO, $CO_2$, formaldehyde, formic acid, $NO_x$, oxygen, fuel (e.g. alkanes, methanol or ethanol), or oxidant may be detected in returning fluids as e.g. indicators of condition of a catalyst used for oxidation reactions. In another embodiment, fluid chemistry (e.g. pH, dissolved minerals, suspended minerals, and agglomerates) may be monitored in the returning fluid, which may allow for adjusting additives in the working or cooling-lift fluid to reduce or enhance solid or mineral precipitation, agglomeration, dissolution. Downhole monitoring of temperature, heat flux, stand-off, and/or borehole geometry by e.g. temperature sensors, flow sensors, acoustic monitors, or calipers may allow for optimization of the drilling conditions. In other embodiments, standard oilfield and geothermal drilling methods and equipment for the measurement of the formation, orientation, and borehole conditions, e.g. measurement while drilling (MWD) or logging while drilling (LWD) systems may be used, as well as directional drilling and drilling with casing or casing while drilling technologies.

For example, in a disclosed method for hole opening of existing wellbores, a drill string deploying the heating system (e.g. the catalyst or combustion chamber for producing the reacted fluid) may also contain instrumentation to help identify and locate the areas of the working portions to be treated. Once the instrumentation identifies the regions or fractures, a drill string can then be pulled up the wellbore to align the jets or nozzles with the areas to be treated. A packer or heat shield may be used to separate the instrumentation from the heat of the spallation process and to isolate the zone of the borehole to be treated.

Working Fluids and Apparatus

In some embodiments, the working fluid includes a substantially aqueous fluid, e.g. water. Other exemplary fluids include oil or water based drilling mud. The fluids may be selected for optimum heat capacity and/or heat transfer properties. In alternate embodiments, a working fluid may include a gas such as neon or nitrogen. Contemplated working fluids may include by appropriate additives, e.g. viscosifiers, thermal stabilizers, density modifying additives such as barite, and those common in oil, gas and/or geothermal drilling.

The working fluid may be directed through one or more nozzles, for example, a nozzle disposed in a drilling system. Such nozzles may be adapted to direct the fluid substantially along an elongate central axis, for example, in a pulsing (e.g. cyclically pulsing) flow or a substantially continuous flow. For example, in some embodiments, a single, centrally located, non-rotating thermal spallation system may have a reduced number of moving parts and reduced mechanical complexity that may result in a substantially simplified and/or cost effective system. Minimizing the moving parts within a thermal spallation system, may allow stronger and more robust materials to be used in construction of the system, and therefore the resulting structure may be better adapted to withstand the high pressures, temperatures, and mechanical wear and impact that is generated at the bottom of a borehole during operation. In another embodiment, a combination of centrally located and peripheral nozzles can be used to optimize heat flux across the surface of the rock, drilling rates, spall size or borehole geometry.

For example, such as in hole opening applications provided herein, the shape of the openings may be controlled to make features in the walls of existing boreholes such as channels, perforations, slots, or multilaterals (multiple branches drilled out from the existing wellbore). For example, the shape of the openings may be controlled by controlling spall size, or may be controlled by the orientation of the nozzles. For example, an apparatus with at least one substantially perpendicular nozzle may be slowly run along the length of a production zone of an existing borehole, creating a slot. Alternatively, a single substantially perpendicular jet may sit on one position in the existing borehole creating a perforation. An apparatus with multiple perpendicular jets (within the same or different apparatus) or if the tool or apparatus is rotated, a series of holes or parallel slots can be created. The pressure from the surface pumps and/or reaction may be used to move the nozzle e.g., towards the rock face to maintain a small stand-off. A ring or peripheral gap nozzle can create disc-like openings if stationary (as shown, e.g., in FIG. 20B), or open the diameter along the length of the wellbore if translated. A less directed or more even heat flux may be applied to open the hole more evenly in all areas, or in the areas of greatest existing stress. In an embodiment, methods of reducing wellbore impedance are provided that include the use of less focused or directed jets, jets substantially axial with the wellbore or with greater stand-off distances or lower heat fluxes, to produce more global spalling of the area of a production zone. In some embodiments, "packers" or plugs (e.g., cement or ceramic plugs) may be used to isolate the areas of a production zone to be treated.

Also provided herein are apparatuses for spalling rock, such as an apparatus that includes a fluid heating means adapted to heat a fluid to a temperature greater than about 500° C. above the ambient temperature of a surrounding material and less than about the temperature of the brittle-ductile transition temperature of the material; and at least one nozzle adapted to direct the heated fluid onto a target location on the surface of the material, wherein the fluid produces a heat flux of about 0.1 to about 20 $MW/m^2$ at an interface between the fluid and the target location, and thereby creating spalls of the material. The nozzles of the disclosed apparatuses and systems may include a high temperature resistant material, e.g. a ceramic or ceramic composites, metal-ceramic composites, stainless steels, austenitic steels and superalloys such as Hastelloy, Inconel, Waspaloy, Rene alloys (e.g. Rene 41, Rene 80, Rene 95), Haynes alloys, Incoloy, MP98T, TMS alloys, and CMSX single crystal alloys, metal carbides, metal nitrides, alumina, silicon nitride, and the like. The materials may also be coated to improve their performance, oxidative and chemical stabilities, and/or wear resistance. Desired working fluid temperatures and heat fluxes can be achieved using a variety of means, such as described below. In some embodiments, a desired heat flux and/or temperature may be achieved using a flame jet, a gas based spallation system, an aqueous solution based spallation system (such as, but not limited to, a hydrothermal spallation system), a flameless combustion system, a laser system, an electrical heat source, a mechanical heat source (such as, but not limited to a friction-based heat source), an induction heating source, pressure-pump or compressor based heat source, a cavitation-based heat source, a frictional pressure drop based heat source, chemical or physical reaction based heat source, or any other appropriate heat source.

Chemical Heating

For example, a disclosed spallation system or apparatus that is capable of producing a fluid for use in the disclosed methods and apparatuses may include at least one jet nozzle, and a housing including a reaction chamber and, optionally, a catalyst element held within the reaction chamber. In operation, unreacted fluids or solids can be contacted with the catalyst element within the housing, resulting in the unreacted fluid or solid reacting, with the catalyst element and generating a reacted fluid. This reacted fluid may then be emitted through the at least one jet nozzle and directed to an excavation site within the geological rock formation, thereby creating spalls and/or a reacted rock region. In some embodiments, contemplated unreacted fluid or solids react in the presence of a catalyst substantially self-energized, e.g., does not require an additional energy or heat source such as e.g., a spark, flame holder, flame, or glow plug to initiate or maintain the reaction and produce the reacted fluid.

For example, one or more unreacted fluids or solids (e.g. one or two unreacted fluids (e.g. liquids) (which may be the same or different), or one unreacted fluid and one unreacted solid, or one or two unreacted solids (which may be the same or different), may be contacted with the catalyst element, thereby forming or generating a reacted or working fluid. Such reacted fluid may be emitted through at least one nozzle (e.g. one center nozzle, a ring or peripheral gap nozzle, or a plurality of nozzles), where the at least one nozzle is directed to an excavation site (e.g. bottom hole or against the borehole wall) within or on the geological rock formation. The directed reacted fluid may create spalls which may or may not then be transported to the top of the hole and/or may create a reacted rock region e.g., down hole. It will be recognized by one skilled in the art that discrete spots on the catalyst may, at times, exceed the final temperature of the working fluid due to localized heating on the catalytic surface, but the reaction is self-energizing and does not require an additional heat source to be provided by e.g. a power cable from the surface or an unstable flame holder.

The unreacted fluid may, in one embodiment have a density similar to water. This may be advantageous, for example, in minimizing any pressure differences between the unreacted fluid and the fluids in the wellbore. For example, if the density of the unreacted fluid is slightly greater than the fluids in the wellbore, any required pumping pressures for the unreacted fluid may be reduced.

Contacting unreacted fluids or solids with the catalyst may occur at a pressure of for example, about 1 to about 200 MPa or 1 to about 400 MPa. The unreacted fluid or solid may be at a temperature of about 20° C. to about 350° C. In some embodiments, at least one of the unreacted fluids is substantially liquid.

Contemplated catalysts include catalysts comprising transition metals and/or noble metals, e.g. lead, iron, silver, platinum, palladium, nickel, cobalt, copper, iridium, gold, samarium, cerium, vanadium, manganese, chromium, ruthenium, zinc, and/or rhodium, and or mixtures and/or alloys or salts thereof, and/or complexes, e.g. carbonyl complexes thereof. Contemplated catalysts include oxides and/or nitrides of e.g. metals. The catalyst may, in one embodiment, include lanthanum, zirconium, aluminum or cerium (e.g. lanthanum cerium manganese hexaaluminate, Zr—Al-oxides and Ce-oxides) or other mixed metal oxide catalysts. The catalyst may include promoters (e.g. cerium and/or palladium).

In some embodiments, the catalyst may be provided on a non-reactive support, and/or on a substantially porous support, or a support with channels (e.g. a honeycomb structure). Such supports may include alumina, sol-gels such as sol-gel derived alumina, aerogels, carbon supports, solid oxides, solid nitrides, oxidatively stable carbides, silica, magnesium and/or oxides thereof, titanium zirconium, and/or zeolites, metals, ceramics, intermetallics, corrosion resistant metals (e.g. iron chromium alloys), or alloy or composites thereof, or other materials commonly used in catalytic supports. The supports can be but are not limited to powdered, granular, or fixed bed. In some embodiments, the catalyst or catalytic bed may further include inhibitors that inhibit e.g. plating or poisoning on the surface of the catalyst or catalytic support. In other embodiments, the catalyst may include cation salts and/or promoters such as ionic promoters or tin, nickel, silver, gold, cerium, platinum, manganese oxides, or salts. A contemplated catalyst may include other components such as boron, phosphorus, silica, selenium or tellurium. Catalysts or their supports may be comprised of nanoparticles.

In other embodiments, the catalyst may be configured as a bed over which (or through which) the unreacted fluid is flowed. In some embodiments, the catalyst bed may be sized and shaped to fit within an appropriate drill head housing, or the catalyst bed may be disposed in a different housing separate from the nozzle. In one embodiment, the catalyst bed may be substantially cylindrical, less than approximately three inches in diameter and two feet in length. In an alternative embodiment larger or smaller catalyst beds may be used. For example, in one alternative embodiment a catalyst bed of approximately 0.5 inches in diameter and 1-2 inches in length may be used. In other embodiments, axial or radial flow reactors may be used. In other embodiments, multiple catalyst beds may be used of the same or different designs. The catalyst bed may include a catalyst on a substantially non-reactive support and/or a porous support.

A catalytic support may include for example, a zeolite molecular sieve of porous extrudate, piece, pellets, powder, or spheres, and/or porous alumina, silica, alumino-silicate extrudate, pieces, pellets, powder, or spheres. Catalytic supports may be chemically resistant to any unreacted or reacted fluid. In one example embodiment, the catalyst bed includes about 0.5% platinum on 1/16" alumina spheres having a surface area of at least approximately 10 $m^2/g$, or at least 100 $m^2/g$ (e.g. a surface area of about 5 $m^2/g$ to about 15 $m^2/g$ or more). In one embodiment, the catalyst bed may be about 5% platinum with a promoter on alumina grains e.g., with a high surface area. In some embodiments, the catalyst or catalyst bed may have plates or sheets. In an alternative embodiment, other forms of catalysis are contemplated (for example using a hot surface or a slug of hydrogen peroxide to initiate the reaction or bring the catalyst bed up to temperature that may produce a substantially self-sustaining reaction) may be used in place of, or in addition to, catalytic reactions. In one embodiment, the decomposition of a peroxide over a catalyst generates free oxygen and heat which raises the temperature of the unreacted fluid to initiate or help initiate the reaction; the pressure of the unreacted fluid may be increased to raise the boiling point of the decomposed fluid to initiate or assist initiation of the reaction.

In an alternative embodiment, a catalyst bed can be used in conjunction with a heat exchanger to initiate the reaction and raise the temperature of a down flowing unreacted fluid, wherein once the system has an appropriate temperature and/or the reaction is self-sustaining, the catalyst bed may be by-passed and/or isolated by e.g. a thermally-actuated mechanical valve, which may improve catalytic longevity. A higher activity catalyst bed may also be used to "light off" the reaction, after which lower activity beds may be used to maintain its high activity. The use of higher pressures in the catalyst bed through e.g. choked flow across the nozzle, mud weight in the borehole, or back pressure at the wellhead, may increase the reaction rates per unit catalyst and decrease the pressure drops across the catalyst bed which may allow for smaller catalyst bed volumes and e.g. axial reactor beds.

In some embodiments, the catalyst may be disposed on a moving rotating element, such as blades or screens on a hydraulically driven turbine, which may increase the contact between the catalyst and fluid. In another embodiment, the catalyst may be on a support that can be e.g., mechanically, thermally, or chemically removed, e.g. without having to pull a drill string out. For example, if the catalyst performance decreases or the catalyst is poisoned, the catalyst can be removed (e.g. by dissolution of alumina in hydrofluoric acid) and a fresh catalyst may be sent down in, e.g. in the form of a pill. The catalyst may be supported on carbon that is combusted once the reaction reaches full temperature.

The catalyst may be regenerated, by for example, passing an oxidant, hydrogen or a hydrogen source over the catalyst at temperature, by acid or base washes, or any other technique commonly used in catalytic combustion systems. Hydrogen or additional oxidant may be added continuously to the unreacted fluid to prevent e.g. coking while also reducing the light-off temperature.

A catalyst chamber may be a water cooled reactor. In another embodiment, the catalyst chamber may be a transpiring wall reactor from a porous material tube that includes metal or ceramics.

The catalyst chamber may have distinct zones. For example, different zones may be responsible for different chemical reactions, destruction or binding of catalyst poisons, or for different temperatures or to reduce the amount of the most expensive catalyst (e.g. noble metal) that is needed, or to provide zones of less expensive, sacrificial catalysts. The relative flow through different zones may be changed depending on the temperature of the catalyst chamber or over time. Different zones, for example, may have substantially the same catalyst and geometry or different catalyst and geometry. For example, sending the unreacted fluid over one bed at a time until the bed is no longer active can extend the working life of a tool before it needs to be pulled from the hole to replace the catalyst.

In one embodiment, the unreacted fluid is an aqueous fluid. In other embodiments, an unreacted fluid may be liquid and may include water, oil, water or oil based drilling muds, aerated fluids, and/or supercritical $CO_2$, or any other appropriate liquid for use as e.g. the working fluid. In one embodiment water can be separated downhole from the unreacted fluid by cyclone separators or other appropriate fluid separation systems and methods. For example, an unreacted fluid may be liquid, gaseous, or a supercritical fluid (e.g. $H_2O$ at temperatures above about 375° C. and 3200 PSI (approximately 7400' water column).

For example, the unreacted fluid may include water and/or an oxidant and/or a fuel. In operation, the unreacted fluid may be, e.g., pumped to a drill head assembly of a disclosed spallation system. In the drill head, the unreacted fluid can be, for example, passed over a catalyst configured (or otherwise put in contact with the catalyst) to e.g., cause the flameless reaction with an oxidant and/or a fuel that may be present in e.g. the unreacted fluid. Such a reaction may produce a reacted fluid, e.g. a fluid at an elevated temperature, that may then be directed out of an e.g., distal jet nozzle of the spallation drill head assembly and impinge upon a target rock surface, creating thermally damaged rock and/or spalled rock. The reacted fluid, in some embodiments, may include water in gaseous (steam) or supercritical form, for example, may be a gas when in first contact with rock. After contacting the rock, the expelled water, gas or supercritical fluid can then, in some embodiments, flow up the borehole, carrying the spalled rock with it. In some embodiments, the reacted (hot) fluid is allowed to travel up the borehole to further spall the borehole walls and expand the diameter of the borehole. In other embodiments, the reacted fluid is cooled e.g. just above the drilling assembly by a heat exchanger and/or cooling-lift fluid, thereby substantially stopping the spallation reaction. In other embodiments, the reacted fluid is directed through a "shroud" which may reduce its interaction with the sides of the rock wall, and also substantially stopping the spallation reaction. In an alternative embodiment, some of the reacted fluid does not travel up the wellbore but rather enters the rock or formation through e.g. fractures. In some embodiments, the spalls or rock fragments are not carried up the wellbore but are allowed to fall further into the hole or remain on the borehole wall.

In one embodiment, a non-reacted or unreacted fluid includes a fuel and/or oxidant. For example, the unreacted fluid may include two or more components that are miscible with each other. In another embodiment, an unreacted fluid and/or an unreacted solid is present, for example, an unreacted solid may include an oxidant (e.g. a solid encapsulated oxidant), or an unreacted substantially solid fuel, e.g. a wax. An unreacted solid may be dispersed, dissolved, undissolved or encapsulated within a solid. In one embodiment at least one of the fuel and/or oxidant may change state or dissolve, decompose, or otherwise react during its transport along the borehole to the drill head, or upon reaching a drill head. A catalyst or accelerant may be added to the unreacted fluid, wherein the catalyst can be activated at the bottom of the hole by heat or mechanical force, with or without the use of a secondary permanent catalyst. The working fluid may also contain an inhibitor to prevent the reaction from occurring along the length of a drill string.

In certain embodiments, a nonreacted fluid is pumped down hole to a drill head at the distal end of the borehole at approximately 1-50 or 5-50 gallons per minute, e.g. about 20 gallons/minute. In one embodiment, an unreacted fluid may be pumped down one or more small diameter tubes that may be nested inside of a traditional steel coiled tubing system. Such small diameter tube or tubes may have one or more periodic check valves so as to prevent the unreacted fluid from back-flowing and to limit uncontrolled reactions from propagating up the nested tube.

In an alternative embodiment, any appropriate tubing system for transporting the aqueous solution to the catalyst or drilling head assembly may be utilized. In some embodiments, the fuel and oxidant are transported to the catalyst or drilling head assembly through one conduit, or in separate conduits. For example, fuel/oxidant mixtures which are stable at desired concentrations can be transported together in one tube. This may, for example, have advantages over transporting the fuel and oxidant separately in that it would require one less conduit to pass material to the distal end of the borehole. It may also simplify storage, mixing, or handling procedures on the surface. Fuels or oxidants which may be carried in the bulk cooling-lift water (and separated at the bottom of the hole) to also reduce the number of conduits.

In one embodiment, the fuel and oxidant may be combined in a number of different ways to allow for transportation of the fuel and oxidant down the same conduit. For example, fuel and oxidant may be transported down a single conduit through use of a single molecule ("single-source") or network/complex. The chemical heat source can be a monopropellant, such as hydrogen peroxide, nitrous oxide, or hydrazine. Alternatively, fuel and oxidant may be transported down a single conduit through use of methods including, but not limited to, slug flow (i.e. gases and/or liquids sent one after another), dissolved gases, or bubble flow (i.e. small bubbles suspended in a fluid and transported along with the fluid). In an alternative embodiment, the fuel and oxidant may be transported down the same conduit as two solid materials in one or more "pills". In a further alternative embodiment, one or more of the fuel and/or oxidant may be transported in an encapsulated form such as, but not limited to, a material, such as a peroxide, encapsulated by e.g., wax.

In some embodiments, fuel and oxidant may be sent down one conduit in two separate fluid phases. For example, the fuel may be carried in an oil-based phase, and the oxidant in the water based phase. At the bottom of the hole, the two phases can be, for example, homogenated, or the fuel and/or oxidant can be separated from its respective phase by means of a hydrocylcone or other separation device and then combined with its reactant.

Contemplated fuels include carbonaceous fuel, such as a fossil fuel (e.g. coal, biomass), gasoline, natural gas (e.g. liquefied natural gas) diesel, biodiesel or kerosene. For example, fuels contemplated for use in the disclosed methods include alcohols, alkyls, cycloalkyls, alkenes, alkynyls, ethers, alkoxyalkyls, (e.g. $CH_3CH_2OCH_2CH_3$), dioxanes, glycols, diols, ketones, acetone, aldehydes and/or aromatic organic compounds such as benzene or naphthalene, or combinations thereof. Hydrocarbons may be used as fuel, and include alkanes (e.g. $C_1$-$C_{20}$ alkanes) such as methane, ethane, propane, butane, pentane, hexane, heptane, octane, and higher alkyl fuels such as naphtha, kerosene, paraffin, hydrocarbon oligomers, and/or other waxes. Other contemplated fuels include ethylene vinyl acetate (EVA), polyvinyl chloride (PVC), boranes (such as $B_2H_6$ or $B_5H_9$), carboranes, ammonia, kerosene, diesel, fuel oil, bio-based oils, such as biodiesel, starch, sugars, carbohydrates, or other oxyhydrocarbons. A fuel may be, or include, hydrogen, hydrogen generating compounds, or hydrogen containing polymers such as polyethylene, polypropylene, or paraffin polymers. A fuel may also be, or include, reactive metals such as aluminum, beryllium, and coated or encapsulated sodium.

For example, contemplated fuels include alcohol fuels (e.g. $C_1$-$C_8$ alcohols) such as methanol, ethanol, propanol, and/or butanol, or mixtures thereof, which in some embodiments may be optionally substituted by one or more halogens. In certain embodiments, the fuel may be substantially miscible in water, e.g. methanol, ethanol or benzene.

Contemplated oxidants include air, oxygen, peroxides, (e.g., hydrogen peroxide or methyl ethyl ketone peroxide) percarbonates, permanganates, permanganate salts, as well as combinations thereof. For example, contemplated oxidants include inorganic and/or organic peroxides such as peroxides of alkali metal peroxides, e.g. lithium, sodium, and/or potassium peroxides, e.g. sodium peroxide and/or barium peroxide. Alkyl peroxides such as t-butyl peroxide and benzoyl are contemplated. Oxidants contemplated herein may include hypochlorite and/or hypohalite compounds, halogens such as iodine, chlorite, chlorate or perchlorate compounds, hexavalent chromium compounds, sulfoxides, ozone, nitric acid, $N_2O$, and/or persulfuric acid. Other possible oxidants include $F_2$, $OF_2$, $O_2/F_2$ mixtures, $N_2F_4$, $ClF_5$, $ClF_3$, $N_xO_y$, IRFNA IIIa: 83.4% $HNO_3$, 14% $NO_2$, 2% $H_2O$, 0.6% HF: IRFNA IV HAD: 54.3% $HNO_3$, 44% $NO_2$, 1% $H_2O$, 0.7% HF, RP-1, $C_{10}H_{18}$, and $CH_3NHNH_9$.

As disclosed herein the peroxide may be in e.g. aqueous form, or may be in a solid form e.g. pellets that may include urea. An unreacted fluid that includes an e.g. oxidant, e.g. hydrogen peroxide, may also include corrosion inhibitors and/or passivating agents and/or anti-foaming agents and/or surfactants and/or surface tension modifying agents. For example, an unreacted fluid may include stabilizers such as phosphoric or phosphonic acid or sodium pyrophosphate or tin compounds. In an embodiment, an oxidant, e.g. high pressure or liquid oxygen may be metered into a fuel stream (e.g. methane or methanol stream); mixing can take place either at the surface or in the drill head. The mixture may then travel into the drill head. In one embodiment the drilling head is configured to withstand bottom hole pressures of upwards of about 100 to 4000 PSI, 1000 to about 4000 PSI, or about 1000 to about 30000 PSI (e.g. about 1 to about 200 MPa), e.g. the pressures present at the bottom of a deep wellbore.

In some embodiments, a provided unreacted fluid may include an aqueous solution comprising by weight of about 5% to about 52% oxidant, e.g. hydrogen peroxide, or about 30% to about 40% oxidant, or about 5% to about 50% oxidant, and may include about 5% to about 20% fuel, e.g. methanol, or about 10% to about 20% fuel, e.g. 10% to about 15% fuel, or even about 5% to about 50% fuel. For example, an unreacted fluid may include about 2% to about 40% by weight hydrogen peroxide. In another embodiment, the unreacted fluid may include about 10% to about 20% by weight methanol or ethanol. In an exemplary embodiment, the unreacted fluid includes about 15% methanol or ethanol and about a stoichiometric amount of air, oxygen, or peroxide (e.g. hydrogen peroxide). In another exemplary embodiment, the unreacted fluid includes 38% by weight hydrogen peroxide and about 12% by weight methanol, or e.g. about a 4:1 weight ratio of hydrogen peroxide/methanol, e.g. about a 5:1 to about a 1:1 weight ratio of hydrogen peroxide/methanol.

In an exemplary embodiment, the unreacted fluid is slightly oxidant rich to assure complete combustion of the hydrocarbons to reduce the amount of by-products caused by incomplete combustion, such as carbon monoxide, formaldehyde, and/or formic acid. In other embodiments, the unreacted fluid may be T-Stoff (80% hydrogen peroxide, $H_2O_2$ as the oxidizer) and C-Stoff (methanol, $CH_3OH$, and hydrazine hydrate, $N_2H_4.nH_2O$) as the fuel); nitric acid ($HNO_3$) and kerosene; inhibited red fuming nitric acid (IRFNA, $HNO_3$+ $N_2O_4$) and unsymmetric dimethyl hydrazine (UDMH, $(CH_3)_2N_2H_2$), nitric acid 73% with dinitrogen tetroxide 27% (AK27), and kerosene/gasoline mixture, hydrogen peroxide and kerosene; hydrazine ($N_2H_4$) and red fuming nitric acid; Aerozine 50 and dinitrogen tetroxide, unsymmetric dimethylhydrazine (UDMH) and dinitrogen tetroxide; or monomethylhydrazine (MMH, $(CH_3)HN_2H_2$) and dinitrogen tetroxide. In another embodiment, the unreacted fluid may include 50-98% hydrogen peroxide. The products from decomposing the 50-98% peroxide (e.g. $H_2O$ and/or $O_2$) over a catalyst (e.g. platinum, silver, or palladium), may then be allowed to react with a fuel (e.g. methanol). The heat from the decomposition of the hydrogen peroxide, combined with downhole temperatures and pressures and/or the use of a heat exchanger, may auto-initiate or sustain the reaction of fuel and oxidant, such as peroxide and/or oxygen with methanol and/or ethanol.

An unreacted fluid or solid, when contacted with the catalyst, may generate a reacted fluid, e.g. a fluid for use in the thermal systems disclosed herein. The reacted fluid may include water and may also include nitrogen, carbon dioxide and/or carbon monoxide, as well as smaller amounts of unreacted fuels and/or oxidants and/or side products. For example, an unreacted fluid that includes methanol and hydrogen peroxide, reacting with a catalyst, produces exothermically water and carbon dioxide. In some embodiments, little or no heat, and/or other initiator (e.g. spark, glow plug, or flame holder), is required to initiate the reaction. In some embodiments, contacting the unreacted fluid and catalyst produces substantially continuously reacted fluid.

In some embodiments, the reacted or working fluid, e.g., hot water, is focused out of the jet nozzle of the drill head assembly and directed against the target rock surface. In one embodiment, the jet temperature (reacted fluid temperature)

and/or heat flux may be controlled by adjusting the mixture of the aqueous solution (for example, by increasing the methanol and/or oxygen concentration to increase the jet temperature). In another embodiment, the jet temperature and/or heat flux may be controlled by increasing the flow rate of the unreacted and e.g., hence reacted fluid. In another embodiment, the jet temperature and/or heat flux may be controlled by adjusting the flow rate of the unreacted fluid to adjust for complete or incomplete reaction. The jet temperature and/or heat flux may also be controlled by, for example, adjusting the flow rate of the unreacted fluid to reduce the amount of heat exchange between the reacted and unreacted fluids.

A drill assembly may include a drill head with a nozzle. An exemplary drill head may have a diameter of approximately ¾ inches with a 0.1 inch center nozzle through which the reacted fluid is expelled. In alternative embodiments, nozzles with different configurations and/or geometries may be utilized, such as a larger or smaller nozzle diameter. For example, the drill head may be about 5 to about 15, or 4 to about 29 times the diameter of the nozzle. In one embodiment, the drill head assembly may include a plurality of jet nozzles directed in either the same or different directions from a distal portion of the drill head assembly. In another embodiment, the drill head assembly includes one center jet nozzle. Rock "spalls" (e.g. grains or platelets of less than about 0.025 inch to about 0.1 inch) can be ejected and may be swept up the borehole by the reacted fluid (after the reacted fluid contacts the rock). In one embodiment, a larger flow of cooling-lift water (e.g., traveling in the annulus between the nested tube and coiled tubing), can be introduced after the heat exchanger (if used), to cool the fluid and help transport the spalls to the surface.

In one embodiment, a heat exchanger is placed above the catalyst bed so that some of heat of the upflowing (e.g. reacted) fluid is transferred to the down flowing (e.g. unreacted) fluid, both conserving energy and preheating the solution prior to the e.g. the catalyst bed, heater, or drill head. In an exemplary embodiment, a nested drill string may act as a heat exchanger. In some embodiments, the catalyst may be preheated by sending some chemical, e.g. an oxidant (e.g. peroxide) in the down-flowing fluid, with or without fuel, which may in some embodiments, initiate a reaction, for example heating the catalyst. For example, heat provided by a heat exchanger to a down flowing fluid may provide enough heat to initiate the combustion reaction without the need for a catalyst, which may allow flow to be directed away from the catalyst bed (and thus may preserve or prolong the useful lifetime of the catalyst). In some embodiments, hot gas may be used to dry the catalyst bed prior to contact with the fuel and oxidant.

In another embodiment, approximately 0.12 gallons per minute of a 15-20% aqueous solution, such as, but not limited to an aqueous methanol solution, is pumped through a preheater to bring the temperature up to 290° C. In an alternative embodiment, a greater or lesser volume of aqueous solution may be pumped. In further alternative embodiments the preheater may bring the temperature of the aqueous solution up to a greater or lesser temperature, as required. In a further alternative embodiment, no preheater is required In one embodiment spallation takes place with stand-off distances (i.e. the distance from the nozzle exit at which the target surface is placed) ranging from approximately 0.2-10.0 inches. In an alternative embodiment, stand-off distances of less than 0.2 inches or greater than 10 inches may be achieved. This may, for example, allow a one inch diameter hole to be drilled at a rate of greater than 0.5 inches per minute. In one embodiment, the standoff distance is varied, either periodically or randomly, in a controlled or relatively uncontrolled manner, or in response to a downhole measurement or physical, mechanical, electrical thermal, or chemical condition. This variation in standoff may improve the tools ability to reliably under ream or to produce a borehole of consistent or desired geometry. Standoff distance, for example, may be controlled by acoustic monitoring, e.g. analysis of the sound of the jet can be used to determine the shape of the bottom of the hole and distance between the nozzle and the bottom. Parameters of the jet, (e.g., nozzle geometry, flow, temperature, stand-off) can be adjusted to optimize drilling, either through communications to the surface or by downhole processors or actuators. The backpressure of the flow through the nozzle may also be used for feedback to adjust e.g., the geometry of the nozzle, the flow rate, the stand-off, and/or the rate of drill string displacement.

Figure 3A:
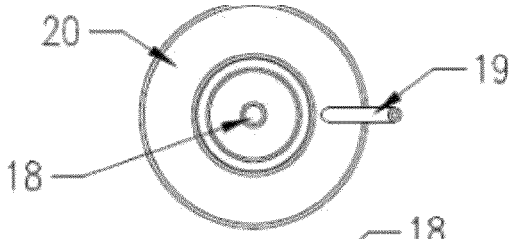
FIG. 3A is a schematic top view of a drill head for a thermal spallation system, in accordance with one embodiment of the invention.
Figure 3B:
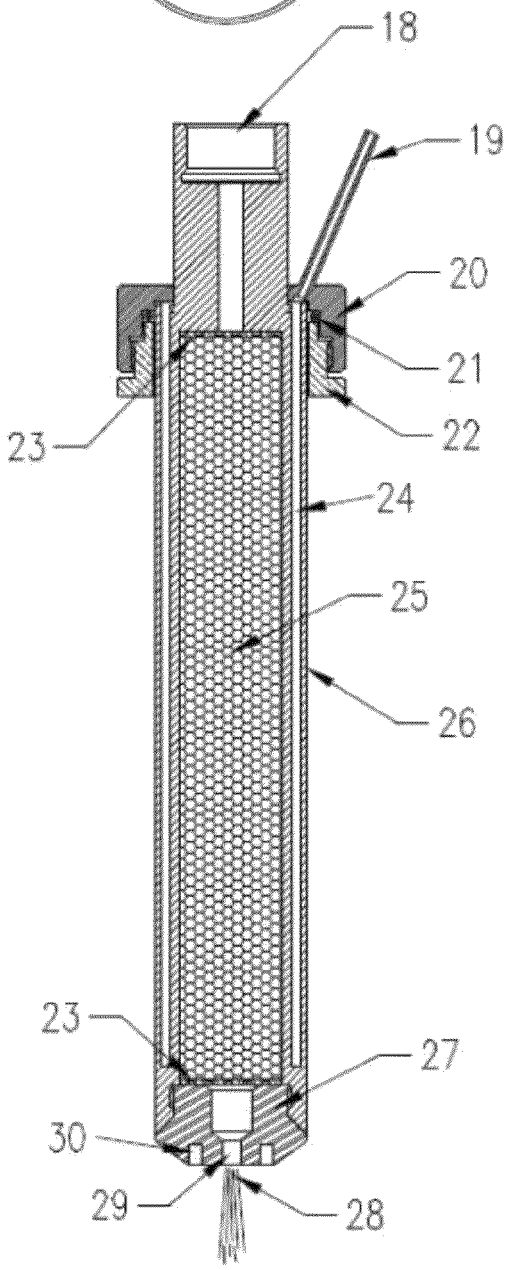
FIG. 3B is a sectional side view the drill head of FIG. 3A.
Figure 3C:
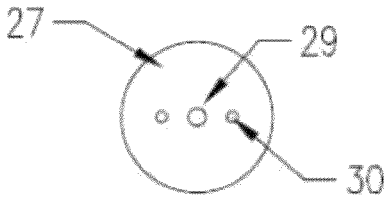
FIG. 3C is a schematic bottom view of the drill head of FIG. 3A.

An example drill head assembly, a small scale axial flow reactor, for a spallation system is shown in FIGS. 3A to 3C. In this embodiment, a catalytic heater drilling spallation system 31 may be used to create high temperature high pressure fluids in a reaction chamber or cell 26, initiated by a stream of hot water mixed with 20% methanol to which gaseous oxygen is added. In alternative embodiments, a higher or lower percentage methanol may be used. This stream of fluid flows into the cell 26 through an inlet fitting 18. In one embodiment, the cell body 26 is constructed with an insulating gap 24 filled with an insulating material, such as, but not limited to, nitrogen gas at the same, or substantially the same, pressure as the fluid flowing into the cell 26. This gap 24 may assist in preventing heat loss from the reaction chamber within the cell 26 into the cooling water surrounding the cell 26, and also helps maintain the cell integrity at the high temperatures of the reaction occurs. The nitrogen enters the gap through a tube fitting 19 and into a collar 20. A replaceable o-ring seal 21 allows the inner region to thermally expand without loss of the nitrogen pressure blanket. A threaded nut 22 secures the o-ring in place. In alternative embodiments, alternative insulating materials and systems may be utilized in place of, or in addition to, the nitrogen gas layer.

The reaction chamber within the central region of the cell 26 is filled with a catalyst, such as, but not limited to, platinum coated alumina spheres 25, that are held in place by two stainless steel filter screens 23. In an alternative embodiment, other appropriate materials and/or means of positioning and holding the catalyst may be used. In operation, the reacted fluid passes out of the reaction chamber, after reacting with the catalyst 25, at an elevated temperature. A nozzle body 27, such as a threaded nozzle body, focuses the high temperature jet 28 of reacted fluid out of a nozzle exit 29 onto a target location on a rock surface. The nozzle body 27 may be, for example, screwed into place on the distal end of the system 31 using the two drilled holes 30 and a spanner wrench.

Figure 3D:
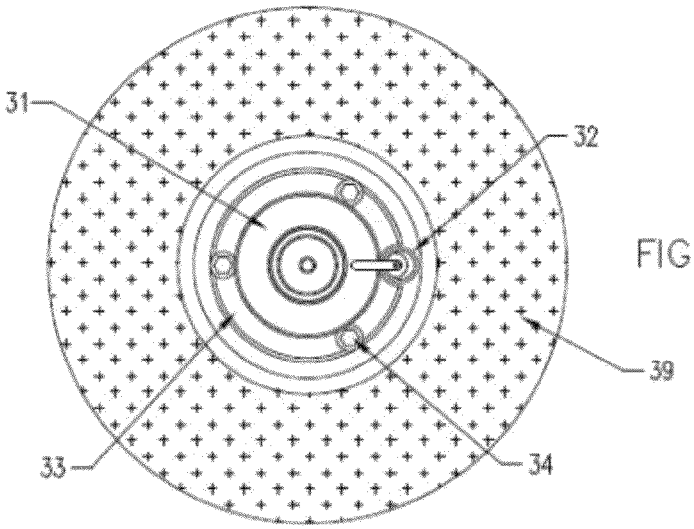
FIG. 3D is an end view of the drill head of FIG. 3A positioned against a rock interface.
Figure 3E:
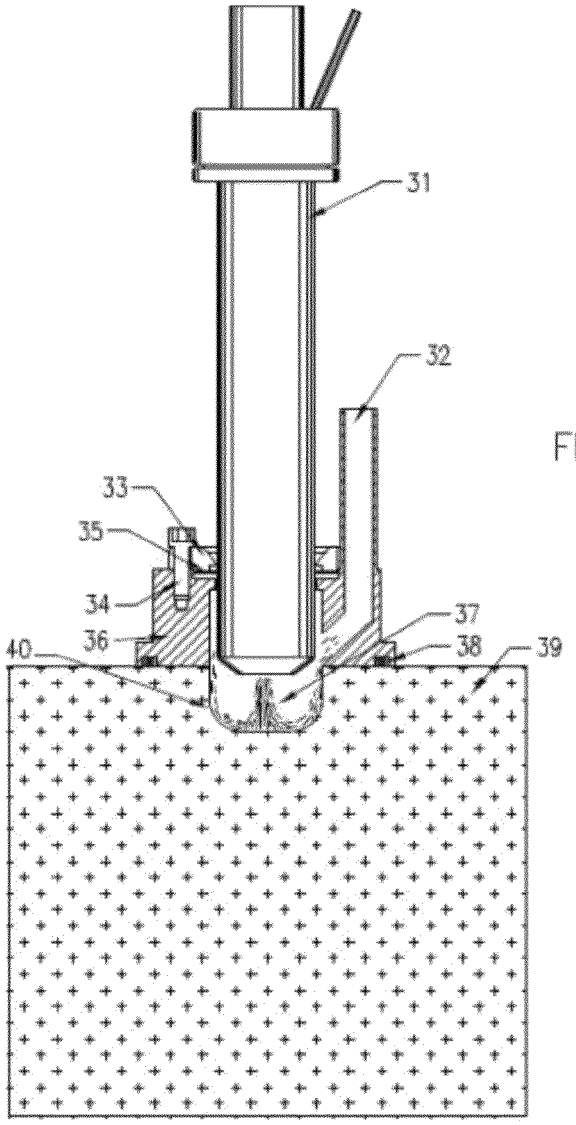
FIG. 3E is a side view of the drill head of FIG. 3A positioned against a rock interface.

FIGS. 3D and 3E show the system 31 in operation. Prior to starting the system 31, a granite block 39 is predrilled with a small borehole 40. A seal-interface block 36 isolates the nozzle 27 from the coolant fluid, and provides a means for venting spalls and oxidation fluids/gases from the borehole. The interface block 36 may, for example, have a cap 33 which is held in place using a number of screws 34. The cap retains in place a thin metal washer and ceramic felt pad 35 which makes a sliding seal for the system 31, thereby preventing inflow of coolant. The interface block 36 may be sealed to the outside using, for example, an o-ring 38. A jet 37 of hot reacted fluid exits the nozzle exit 29 and enters the predrilled borehole 40, where it spalls the rock at the distal end of the borehole and flows upward and out of the interface block through the chimney tube 32.

Figure 12:
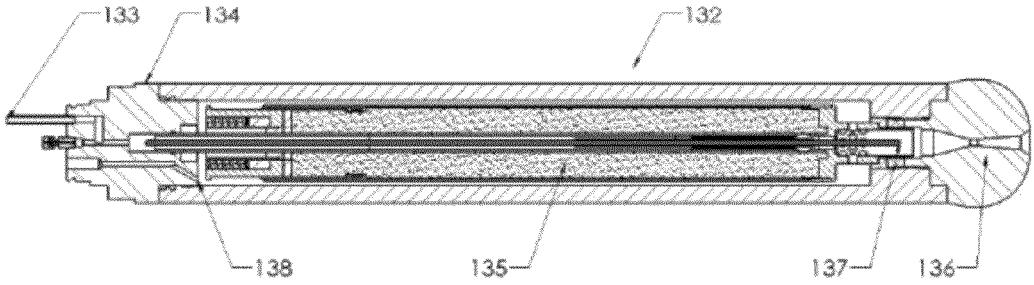
FIG. 12 is a sectional side view of the convergent radial flow reactor.
Figure 13A:
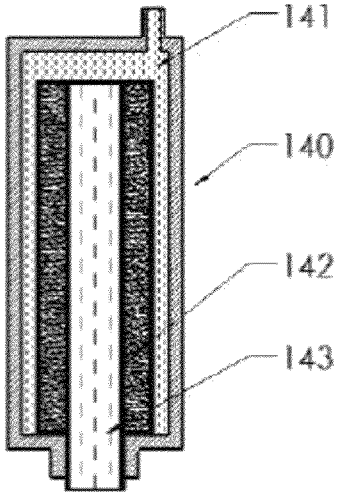
FIGS. 13A and 13B are schematics of convergent and divergent radial flow reactors.
Figure 13B:
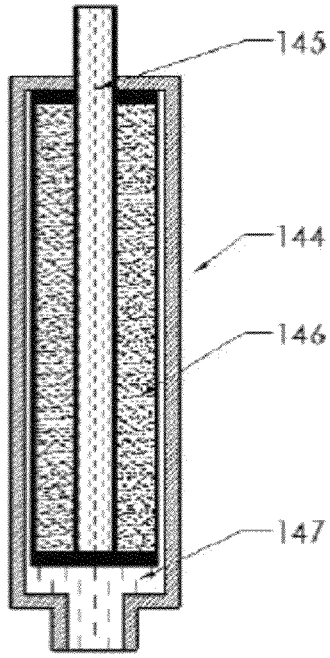
Figure 14A:
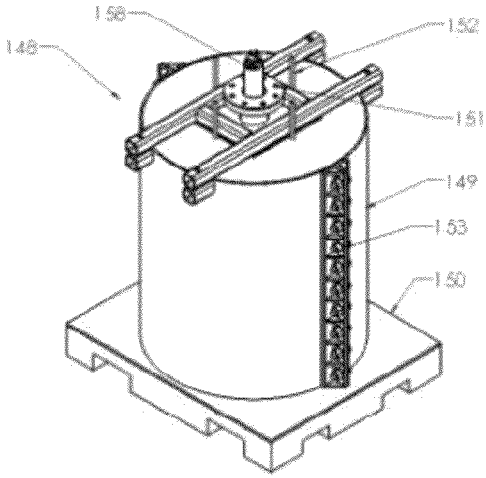
FIGS. 14A, 14B, and 14C show views of a rock core confinement system for laboratory drilling demonstrations.
Figure 14B:
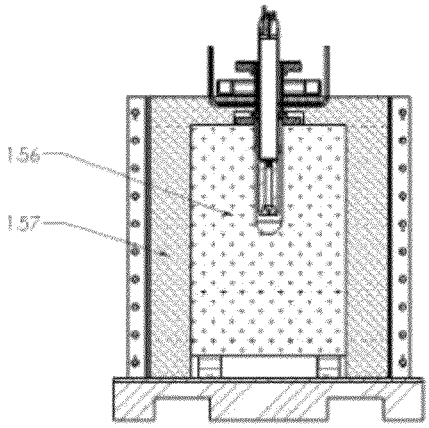
Figure 14C:
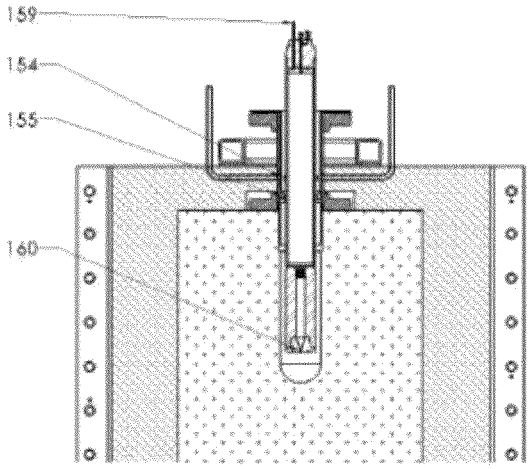

Another example, as depicted in FIG. 12, is a convergent radial flow reactor housed within a 2⅞" OD drill head for producing 4" holes in granite using the laboratory test system or deployed on a coiled tubing unit. This system is comprised of a steam generation assembly 132 containing a catalyst bed 135, a drill head 136, and a connector 134 that couples the unit to other downhole subassemblies and the drill string. Unreacted fluid is pumped down a single capillary in the drill string, through 133, and into the steam generation assembly 132 where it flows through a catalyst bed and reacts producing reacted that exits out a nozzle 136. Pressures and temperatures inside the steam generation assembly 132 are measured at specific locations 137, 138 which can be used to monitor the performance of the system. Flow schematics of this steam generation assembly 140, 144 for a thermal spallation drilling system are shown in FIG. 13A and FIG. 13B. A converging flow design is shown in FIG. 13A. Fuel and oxidant enter the cell 141 and flow across a catalyst bed 142 where they react producing the working fluid which exits down a tube 143 to the drill nozzle (not shown). A diverging flow design is shown in FIG. 13B. Fuel and oxidant enter the cell 145 and flow across a catalyst bed 146 where they react producing working fluid which exits down and annulus which converges to a tube 147 that leads to a drill nozzle (not shown). For surface demonstrations of the drill head shown in FIG. 12, an example of a spallation drilling test system rock core confinement apparatus 148 is shown in FIG. 14A, FIG. 14B, and FIG. 14C. The system can be used to simulate spallation drilling at the surface where there is low stress on the rock. The system is comprised of a steel concrete mold 149 that encases a rock sample 156 which is surrounded by concrete 157. A wellhead 151 is secured to the rock sample prior to the sample being encased in concrete. The entire system rests on a pallet 150 for ease of transportation. Bolts 153 on the side on the concrete mold 149 can be tightened after the concrete has hardened in order to induce a compressive stress on the rock sample. A drill 158 enters as shown. Cooling water or drilling mud is pumped through injection tubes 152 and enters the wellbore at injection points 154. A flow barrier 155 prevents the cooling water from entering the hot thermal spallation region downhole while the drill is in operation. Unreacted fluid is pumped into the drill through a tube 159 and reacted fluid exits the drill nozzle 160.

Gas Spallation

Figure 2:
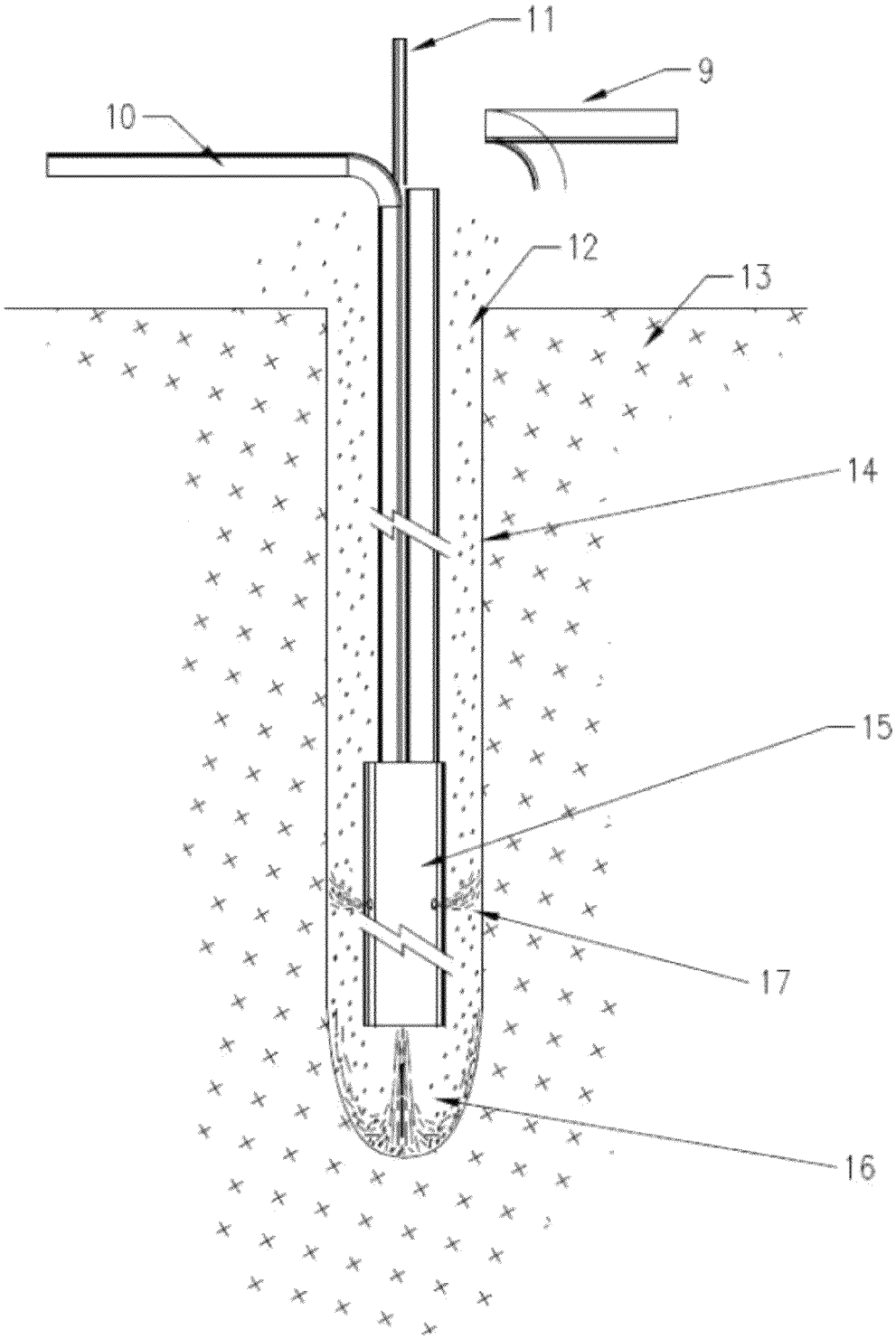
FIG. 2 is a schematic side view of an air spallation drilling system in operation, in accordance with one embodiment of the invention.

In one embodiment, a heating means may include a gas based spallation system, with the heated working fluid including a heated jet of a gas such as, but not limited to, air, combustion products, or any other appropriate gas or mixture thereof. An exemplary spallation method includes the use of air spallation drilling. This technique (also known as Flame Jet Drilling or Jet Piercing), uses a supersonic flame jet in an air-filled hole to apply heat to the rock surface. An example air spallation drilling process is shown in FIG. 2. Subsonic jets may also be used.

FIG. 2 shows an example flame jet spallation drilling system 200. In this process, compressed air is pumped down a tube 9. Water 11 and fuel 10 (such as, but not limited to, diesel, fuel oil, or propane) are also pumped down into the borehole 14 which has been created in the bedrock 13. The air and fuel and are combusted in the burner assembly 15 and a jet of superheated fluid 16 exits the nozzle at supersonic velocities, thereby causing spalling of the rock and creation of a borehole. A cooling stream of water exits the drill head assembly from one or more guide holes 17 to drop the temperature of the exhaust stream and spalls. The drill head assembly is moved downward at a rate that creates a more or less uniform borehole 14. Spalls 12 are carried up the borehole 14 and ejected at the surface.

In one embodiment, the spallation process may produce a highly uniform and smooth wellbore with slight ellipticity, as the drilling process inherently allows stresses in the rock to be relieved through ovalization.

In one embodiment, the air spallation apparatus may include a pipe assembly that is introduced into a hole in a rock formation. Fuel and air are provided to a combustion chamber through respective fuel and air supply lines. The high temperature combustion products exit through a nozzle generating a supersonic axial flame jet. The flame jet, for example, can heat the rock directly beneath it at a central region, (e.g. a stagnation zone). Cooling fluid exits above the nozzle and mixes with the hot combustion gases and spalls, cooling them to a safe temperature and quenching the spallation process. In some embodiments, exiting combustion gases may not be sufficient to lift the spalled rock away from the removal site, up the hole to the surface and additional air may be provided.

Combustion

A working fluid may be provided using a heat generation chamber. The heat generation chamber may, for example, include a combustion chamber, which may be energized by a spark, flameholder, or glow plug. Alternatively, the combustion reaction may be initiated by a catalyst which may be later bypassed or isolated once the reaction is self-sustaining. In a combustion chamber, a focused or diffuse flame may exit into a working fluid to raise the temperature of the fluid prior to contacting a rock surface. In such an embodiment, the high temperature combustion reaction may not come into contact with rock, and therefore may avoid fusing or melting the rock surface. In hydrothermal flame drilling, the combustion flame is directly impinged on the rock surface.

Electrical Heating

A heat generation chamber may alternatively be an electric heating chamber, heated by an electric heating element or induction heater that is energized by a turbogenerator, driven by a flow of water delivered to the turbogenerator from the surface in a conduit. The electric heating element may be additional or optionally energized by an electrical power cable run from a surface generator or by transmission of electrical power along the drill string The heat generation chamber may also be heated by induction heating using permanent magnets which are rotated by a hydraulically driven turbine. Alternatively, a receiving material, such as steel, may be rotated in the field of permanent magnets. Permanent magnets may be cooled by a stream other than the working fluid. The induction heater or an induction generator may use a small permanent magnet generator cooled by the fluid exiting the turbine to flash the field of a much bigger induction generator that can operate at much higher temperatures. In some embodiments, fluid flowing through or past the inductive receiving material may increase in temperature. Coolant flow through channels in the permanent magnets may prevent overheating and loss of magnetization.

Thermochemical

In an alternative embodiment, a working fluid including an aqueous fluid comprising water and hydroxides of Group I elements of The Periodic Table of Elements, and mixtures thereof, may be used. For example, an aqueous fluid may include a hydroxyl ion concentration of the hydroxides of Group I elements of The Periodic Table of Elements and mixtures thereof at ambient conditions is in the range of about 0.025 to 30 moles of hydroxyl ion per kilogram of water. In some embodiments, an upper limit of the range can be determined by the solubility of the Group I hydroxide. For example, a fluid may include about 0.1 to about 52 grams sodium hydroxide per 100 grams of solution at room temperature (but may include more at higher temperatures). In some embodiments, the fluid may comprise alcohols such as methanol or ethanol with hydroxides, which produce alkoxides. Such alkoxides may help solubilize minerals in rock.

In some embodiments, concentrated aqueous or alcohol solutions of hydroxides of alkali metals can react with subsurface rock formations and may be capable of forming one or more water soluble complexes with at least one of Si or Al. For aluminosilicate rocks, the high alkoxide or hydroxyl ion concentration in the fluid may provides the dual benefit of (i) enhancing the dissolution rate by fully ionizing the chemical surface groups on the formation rock, thus maximizing the density of surface sites vulnerable to hydrolysis, and (ii) enhancing solubility of reaction products by forming thermally stable soluble complexes. Such fluids may dissolve rock and consume hydroxide stoichiometrically until e.g., the hydroxyl ion concentration drops to near 0.01 moles of hydroxyl ion per kilogram of water or alcohol. Materials to achieve hydroxyl ion concentration above 0.01 moles of hydroxyl ion per kilogram of water include, but are not limited to alkali metal and alkaline earth metal components such as hydroxides, silicates, carbonates, bicarbonates, mixtures thereof and the like. In example material is sodium hydroxide. Other solutes may be added in any desired quantity to achieve other objectives, as long as the hydroxyl ion concentration is maintained Coupled Thermal and Mechanical Systems One aspect of the present invention relates, at least in part, to drilling systems, and associated methods of use, that includes a heat source to thermally affect a target material and a mechanical drilling system. The drilling systems may be used to create boreholes or increase the diameter of existing boreholes in any of the target materials described herein including, but not limited to, crystalline rock material, silicate rock, basalt, granite, sandstone, limestone, or any other rocky material. The drilling systems may be used to create vertical boreholes, horizontal boreholes, angled boreholes, curved boreholes, as well as slots, perforations, fracture enlargement, or other forms of hole opening, or any combination thereof. In one embodiment, the methods and systems described herein provide for improved deep borehole drilling, for example from approximately 10,000 feet to approximately 50,000 feet below the surface, or more.

Figure 16:
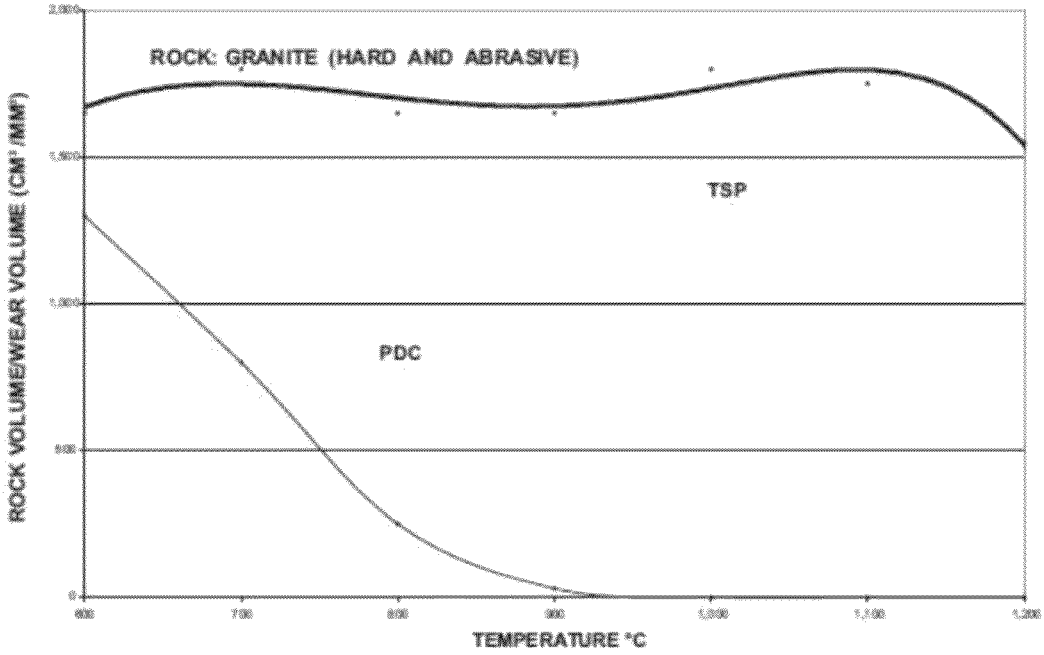
FIG. 16 shows a graph of wear rates of PDC and TSP cutters against hard granite as a function of temperature.
Figure 17:
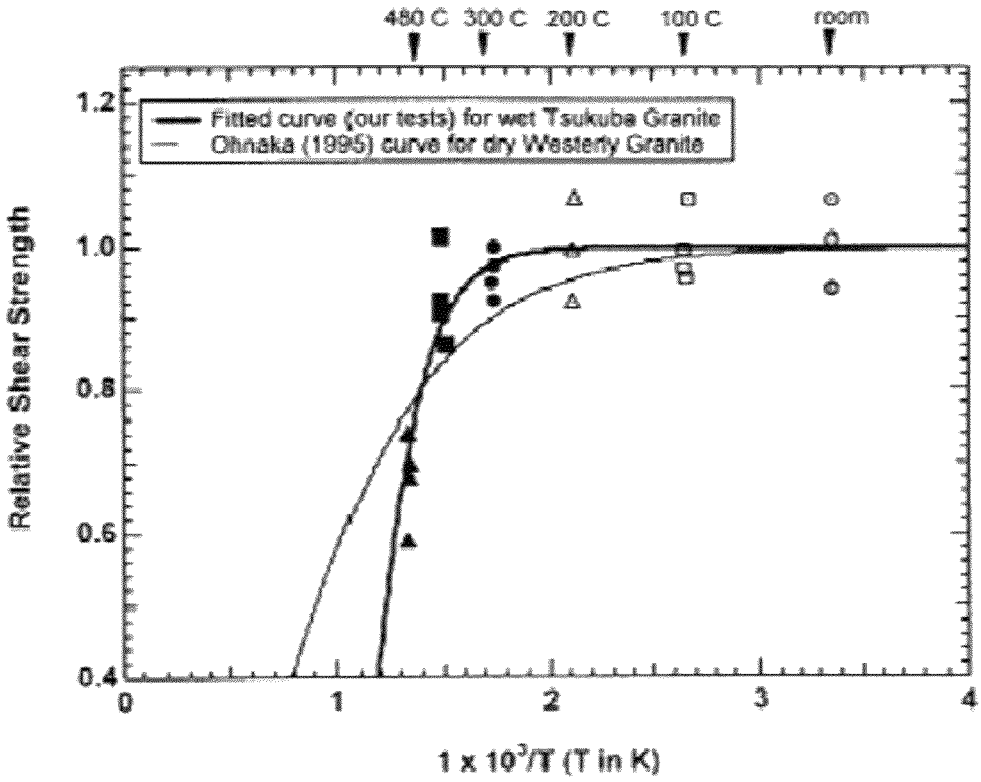
FIG. 17 shows a graph of the relative shear strength as a function of the ultimate temperature for two example granites.

A borehole may be created, for example, through the combined use of a heated fluid and a mechanical drilling and/or reaming or milling system. Combining a mechanical drilling system with e.g. a thermal drilling system such as those described above may overcome certain limitations of thermal systems alone, by, for example, the combination may provide for controlling stand-off and/or rate of penetration or bit advancement, penetrating unspallable or thermally-insensitive or unspallable zones, comminuting larger pieces of rock that may be produced or fall from the borehole wall, penetrating fractures which have inflowing or potential for outflowing fluids. Combining the use of a heat source to thermally affect a target material with a mechanical drilling system may overcome certain limitations of conventional mechanical drilling systems alone by, for example, preventing the wear and fatigue to the drill bit that is produced through traditional mechanical drilling technologies. More particularly, by utilizing one or more heat sources to thermally affect a rock portion in advance of one or more conventional drilling and/or milling systems, the mechanical and physical strength of the rock to be drilled and/or milled can be reduced forward of, and/or simultaneously with, the mechanical drilling process. This may allow for increased penetration rates with reduced bit wear, vibration and drill string fatigue, and uncontrolled trajectory deviations compared to conventional drilling processes. For example, new cutter materials such as TSP can operate at temperatures above 1000° C., as shown, e.g., in FIG. 16, where hard rocks such as granites are significantly softened, as shown, e.g., in FIGS. 9, 10, 11, and 17. Therefore, a thermal jet which reduces the rock strength by, e.g. partially spalling and/or microfracturing and/or softening combined with a mechanical drilling process using a high temperature bit material, has the possibility of a corresponding ROP exceeding that of either process along. As a result, the efficiency of conventional mechanical drilling methods may be significantly increased by the use of a heat source to modify the properties of the rock in advance of the mechanical drilling system.

In one embodiment, the mechanical drilling and/or reaming system may, for example, include a traditional mechanical, chemical, or other appropriate drilling and/or reaming mechanism. Embodiments of the invention may, for example, incorporate any appropriate mechanical bit design, including, but not limited to, roller cone bits, tricone bits, polycrystalline diamond compact (PDC), reaming bits, milling bits, hammer drill bits or coring bits, or other appropriate drilling bits. The design of these bits, including cutting and rock reduction surfaces, can be optimized so that the depth-of-cut and rate-of-penetration can be maximized while keeping the wear, vibration, and trajectory deviations within acceptable limits. Materials and novel designs, including high temperature metals and alternative methods for inclusion of cutting surfaces, may be optimized for use under these relatively high temperature conditions. The use of high temperatures may also allow for the use of ultra-hard materials that tend to be brittle at lower temperatures. In an alternative embodiment, the drilling system may include other physical or chemical processes such as, but not limited to, sonication, sonic drilling, laser drilling, arc/plasma, particle assisted drilling, chemical dissolution, or other appropriate physical or chemical processes of use in drilling applications in addition to, or in place of, a mechanical drilling system.

In order to thermally affect the rock to be drilled and/or reamed or milled by the mechanical drilling system, one or more heat sources may additionally be incorporated into the system. This heat source may include any appropriate heat source adapted to thermally affect a rock through spallation, microfracturing, macrofracturing, dissolution, partial melting, softening, modification of grain boundaries, change in crystalline phase, decrystallization, erosion, or the like. For example, certain materials such as shales and clays may be modified (e.g., dehydrated at high temperatures) to reduce or eliminate bit baling.

In one embodiment of the invention, a combined thermal and mechanical borehole creation system may include a spallation drilling mechanism, such as, but not limited to, any of the thermal spallation systems described herein, with mechanical drilling mechanism such as, but not limited to, a drilling, reaming, milling, and/or hole opening process. A downhole chemical reaction (e.g. hydrothermal oxidation of methanol and peroxide over a catalyst) may provide both thermal energy as well as the mechanical energy (e.g. expansion of the hot fluid to e.g. drive a hammer).

In one embodiment, a small pilot borehole may be formed, e.g. with the thermally produced pilot borehole being substantially smaller than the target diameter of the final borehole. The pilot borehole may thereafter be milled, drilled, or otherwise enlarged, by a mechanical system such as a reaming system, or other appropriate hole opening system, to form the final borehole of the required diameter. This method may, for example, allow for more precise control of borehole geometry, and provide substantial cost and time benefits for producing the final reamed borehole. The pilot hole may serve as a guide, stay, or centralizer for the reaming bit. In addition, removal of rock from the circumference of a lead borehole (that has been created by spallation system) through a reaming process may be, for example, faster, easier, and/or produce less bit wear than traditional drilling of the entire borehole. The spallation drilling mechanism and reaming mechanism may be part of a single device, or be separate devices. The pilot borehole may be used, for example, as an exploratory, test, monitoring, or scientific borehole to e.g. determine the quality of the resource and evaluate if a larger borehole should be created.

The use of a working fluid for e.g., creation of a lead borehole, may affect one or more properties (e.g. a thermal, mechanical, chemical or physical property) of the material at the surface of the pilot borehole wall. This may, in turn, make it easier for the reaming system to ream the surface of the lead borehole to create the final borehole. In one embodiment, the reaming operation may also remove rock that is not structurally stable. Such rock could, if not removed, fall into the hole, bridge the hole, or form ledges that prevent the advance of casing or stick the casing before it is on-depth. Bridges that form in the casing annulus can e.g. divert or disrupt the placement of cement which may jeopardize the success of well completion. The reduced mechanical strength of the thermally affected zone, if not removed, may also reduce the overall integrity of a completed well.

In each of the embodiments described above, a working fluid, such as those described herein, may be used to weaken and/or remove the rock at a distal end of a borehole prior to, or simultaneously with, the drilling, reaming, and/or milling action of a mechanical bit coupled to the thermal spallation system. In different embodiments of the invention, a working fluid can be configured to spall or thermally affect the entire bottom surface of the distal end of the borehole. In an alternative embodiment, the thermally-affected zone produced by a working fluid does not cover the entire surface under the drill bit. Rather, the fluid stream can be directed so as to target certain regions under the bit to be weakened. Damage to or removal of these regions can cause structural weakening of the remainder of the surface so that it may be easily removed by a separate feature on the drill bit. In another embodiment, a working fluid may be focused toward the sides of the borehole, with or without additional working fluid being focused toward the bottom of the borehole.

In various embodiments of the invention, the mechanical drilling and/or milling or reaming operation may be carried out concurrently with a thermal drilling operation, e.g. use of a working fluid. For example, a mechanical drilling/reaming element may be located either substantially close to the thermal treatment operation and/or substantially offset along the drilling assembly, thereby allowing the mechanical drilling process to be carried out concurrently, or substantially concurrently, with a thermal drilling operation. The mechanical drilling elements, (e.g. drill bits or reaming bits) may therefore remove the thermally modified portion of the geological formation and/or thermally unmodified rock surrounding the thermally modified rock, thereby creating the borehole and, in some embodiments, improving the geometry or integrity of a wall of the borehole created by the spallation system or other thermal treatment system.

The system may be adapted to remove both spalled or thermally affected rock and non-spallable rock. In addition, the system may be adapted to reduce the size of rock pieces that are too large to be removed from the borehole in a circulating fluid. As a result, the mechanical drilling system, in combination with the thermal treatment system, may be used to create boreholes in a number of different geological formations including a number of different properties. For example, a coiled tubing deployed thermal spallation drill head can be combined with a coiled tubing deployed mud-motor drill; in formations where the thermal spallation process is not effective, the mud motor may be used to turn a conventional coiled tubing drill bit. Likewise, a drill pipe deployed hydraulically driven turbo-generator can be used to produce electricity for resistance heating elements used to initiate thermal spallation or treatment of the rock. A thermally-stable rotary drill bit serves to maintain proper stand-off of the jet during pure spallation drilling, assist in some sections via thermomechanical drilling, and be the sole mechanism for drilling in others. This is particularly advantageous over prior, uncoupled, systems, wherein, for example, a thermal treatment or thermal drilling system may need to be removed from the borehole if unspallable rock is found at the bottom of the borehole, or created by overheating the rock, and temporarily replaced by a mechanical drilling system. This removal of a drilling system, and insertion of another type of drilling system, whenever materials with different properties are met may be extremely costly and time consuming. By coupling a thermal system with a mechanical system within a single drilling system, the need to replace the system when different materials are met may be avoided.

In an alternative embodiment, the mechanical drilling process may be performed as a secondary operation while some tubing or pipe remains in the hole. In a further embodiment, the mechanical drilling process may be performed as a secondary operation after the thermal drilling assembly has been removed. In one embodiment, different processes, such as a thermal drilling process and a mechanical drilling and/or reaming process, may be performed concurrently along different portions of a single casing interval or wellbore.

In one embodiment, one or more thermal treatment nozzles can be distributed throughout the front of a mechanical drill bit, or through slots radially extending from an outlet port. The nozzles can also be shrouded with a protective gas or fluid stream to reduce cooling and mixing with the drilling fluid and/or increase the potential for thermally damaging the rock surface. Gas shrouds, fluid streams, solid insulation such as a ceramic or syntactic ceramic, vacuum gaps, or gas or fluid filled gaps can also be used to protect the materials of construction or mechanical drilling equipment from high temperatures.

In one embodiment, the drilling process includes rotary or coiled tubing drilling. As a result, a thermal jet, or a portion thereof, may be configured to rotate. In an alternative embodiment, one or more thermal jets, or a portion thereof, may be fixed, for example, through either a center or peripheral ring jet.

In some of the embodiments described herein, a thermal system including a single nozzle may be incorporated into a mechanical drilling system. The single nozzle may be located centrally along a central elongate axis of the system. As a result, the thermal system may include a fixed, non-rotating, structure. A mechanical drilling and/or reaming or milling mechanism may then by positioned over or in the thermal system, and rotate around or in the thermal system, to mechanically drill and/or ream the borehole being created in conjunction with the thermal system. Providing a single, centrally located, non-rotating thermal system may be advantageous, for example, in simplifying the structure of the system by reducing the number of necessary moving parts and reducing the mechanical complexity of the overall system. This may, for example, reduce the cost of the system while also allowing for a more structurally sound and sturdy borehole creating tool. In one embodiment, by minimizing the moving parts within the thermal system, stronger and more robust materials may be used in the construction of the thermal system, and the resulting structure may therefore be better adapted to withstand the high pressures, temperatures, impact, and mechanical wear that are generated at the bottom of a borehole during drilling operations.

In one embodiment, a heat source may be incorporated into a mechanical drilling system such that the distal end of the mechanical drilling system extends a specified distance from the distal end of the heat source. As a result, the impingement of the distal end of the mechanical drilling system against the target portion of the rock results in the substantially constant stand-off distance between the rock surface and the heat source. This may be advantageous, for example, in applications where a set distance is required between the target surface and the distal end of the heat source to ensure that the temperature, flow, and heat flux produced at the surface of the target portion of the rock is within the required limits for efficient spallation. Also provided herein are methods that may achieve e.g., softening of rock at a radius proportional to the wear rate of e.g. mechanical cutters such that the life of the cutters is more uniform.

Figure 4A:
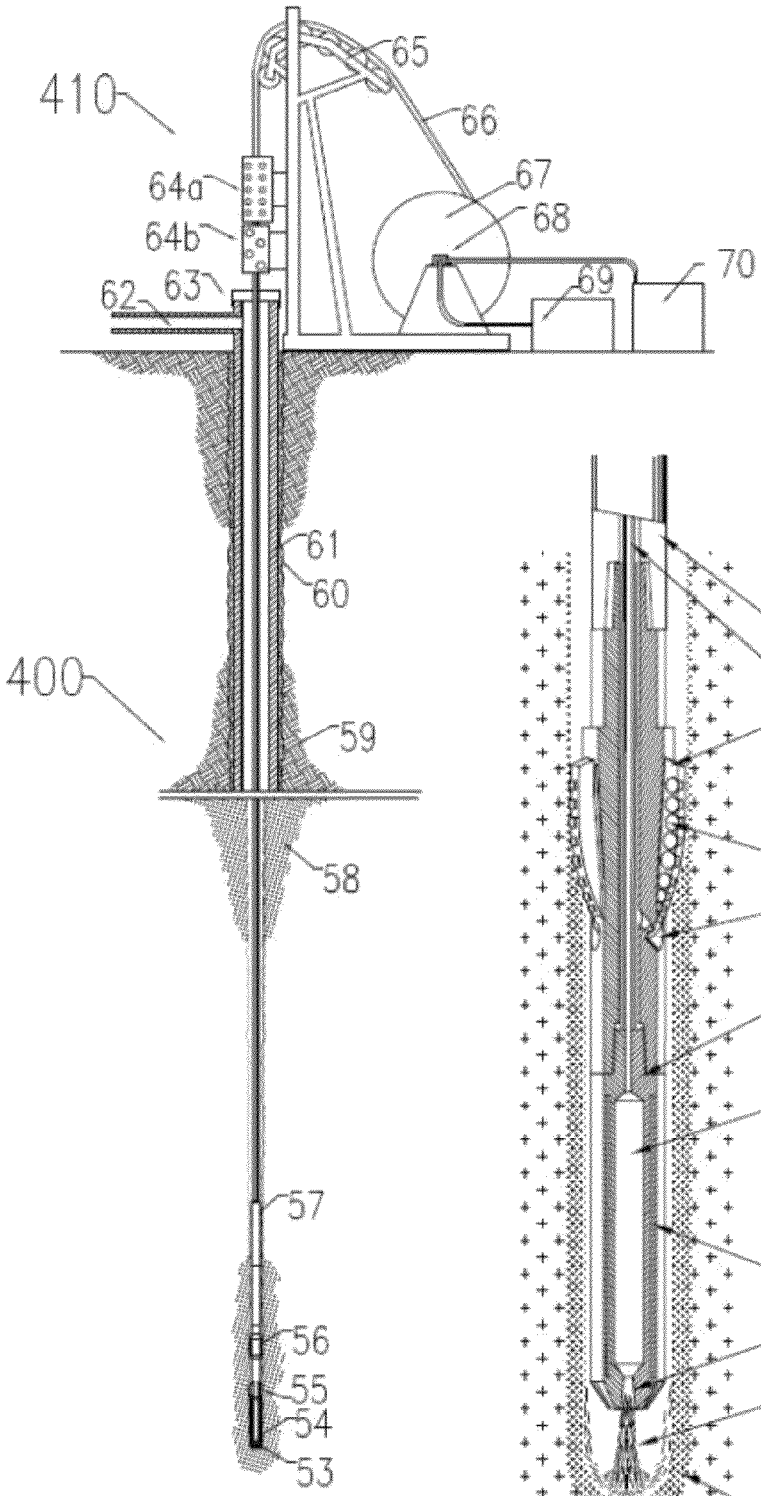
FIG. 4A is a schematic side view of a thermal-abrasive reaming system, in accordance with one embodiment of the invention.
Figure 4B:
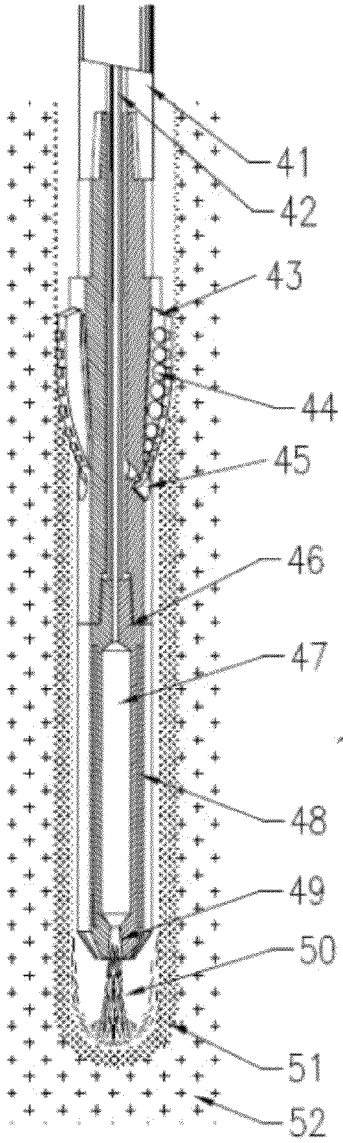
FIG. 4B is a schematic sectional side view of the nozzle and reamer of the thermal spallation-abrasive reaming system of FIG. 4A.

An example drilling system is shown in FIG. 4A and FIG. 4B. In this embodiment, the drilling system 400 includes a pilot hole thermal spalling system 54 and borehole reamer 55 in conjunction with coiled tube drill rig system 410. The pilot hole thermal spalling system 54 is powered by a fuel and oxidant fed through a nested tube 42 contained in a motor driven shaft 41. The reactants move through the assembly to a pilot drill reaction chamber 47. The reaction chamber 47 is filled with a catalyst to initiate a thermal reaction with the fluid passing therethrough to change at least one property of the fluid such as, but not limited to, a temperature, a pressure, or a state of the fluid. In one example, the reaction between the fluid and the catalyst increases the temperature and decreases the density of the fluid. As a result of the thermal reaction, a jet 50 of hot gases/liquids is directed out of a nozzle 49 at the distal end of the chamber 47. The reaction chamber 47 may, in one embodiment, be thermally insulated from the main body by, e.g. a gas filled cavity 48. The exit jet 50 spalls the rock at the distal end of the borehole, thereby drilling a hole in the rock 52 and creating a damaged zone 51 around the bore.

The spalled rock can then be carried away from the target location at the end of the borehole by the recirculating fluid or drilling mud within the borehole. The nozzle portion 49 may, in one embodiment, be constructed from a high temperature resistant material such as, but not limited to, at least one of a ceramic, ceramic composite, high temperature steel alloy, or the like.

The pilot spallation sub assembly 54 is attached to a rotating reamer sub-assembly 55 which carves away the damaged rock. The reamer 55 has multiple blades 43 having attached carbide or diamond compacts 44 to cut away at the damaged rock zone 51. Coolant, such as, but not limited to, a water or drilling mud, may be introduced just below the reamer blades 43 with imbedded compacts 44 through one or more outlets 45 to help cool the assembly and remove cuttings.

In one embodiment, where the system is attached to a coiled tube drill rig 410, the downhole assembly, or a portion thereof, may need to be rotated through the use of a downhole motor 56 attached, for example, to a connector 57 and then to the nested coiled tube 66 and powered by high pressure fluid supplied by surface pumps 70.

The hard rock 58 found at depth can be effectively drilled by this system. In one embodiment, shallow depth rock 59 can be drilled, cased 61, and cemented 60 to prevent loss or introduction of fluid during drilling. Drilling fluids including drilling mud water and spalls are removed from the borehole through a flow line 62 to be separated and possibly recirculated. A rubber packoff in a stripper head 63 diverts the returns into the flow line away from the drill rig 410. On the surface, the coiled tube rig 400 contains a coiled tubing injector 64*a* which is used to drive the coiled tube within the borehole, a tube straightener 64*b* and a gooseneck 65 which is used to guide the tubing from the injector 64 into or off of the reel 67. Fluid, including e.g. reactants, can be fed in from a source 69 through a rotating coupling 68 into the reel assembly 67.

Figure 5A:
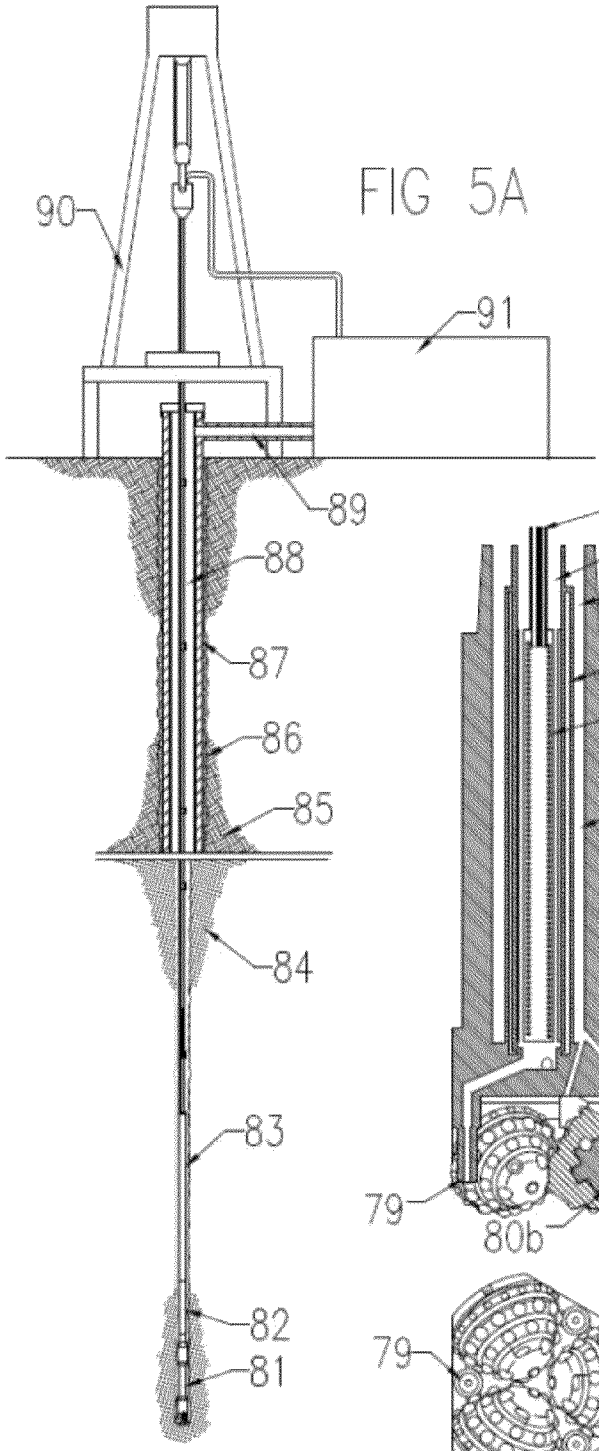
FIG. 5A is a schematic side view of a composite thermal spallation and tricone roller bit drill system, in accordance with one embodiment of the invention.
Figure 5B:
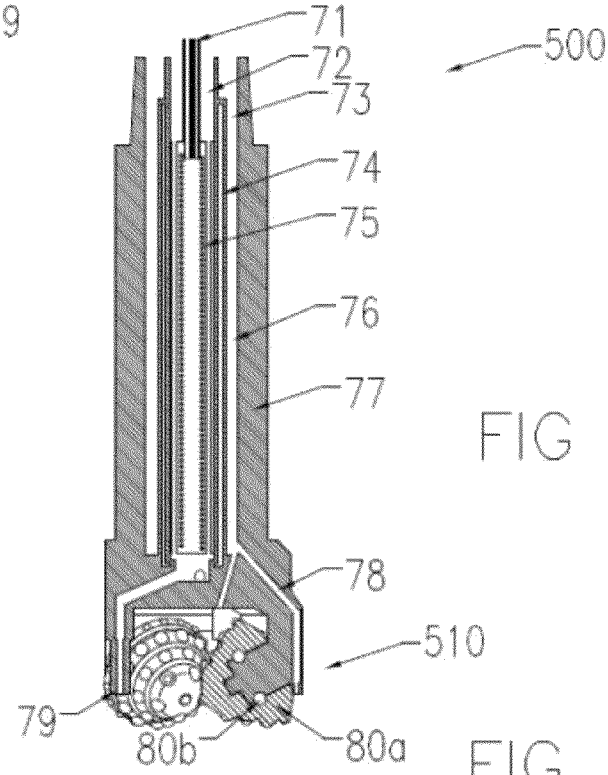
FIG. 5B is a sectional side view of the nozzle and tricone drill bit for the thermal spallation and tricone roller bit drill system of FIG. 5A.
Figure 5C:
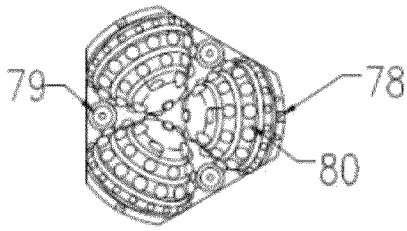
FIG. 5C is an end view of the nozzle and tricone drill bit of FIG. 5B.

One example drilling system may include a drill string based thermally assisted tricone drilling system. An example thermally assisted tricone drilling system 500 is shown in FIGS. 5A-5C. In this embodiment, heat to power a downhole spallation system such as, for example, a hydrothermal spallation drill system, can be provided by electrical resistance heating. A tricone bit 510 is incorporated into a distal end of the drilling system 500. In one embodiment, the tricone bit 510 has multiple rotating rollers 80*a* which incorporate hard segments, constructed, for example, from carbide, steel or ceramic segments, that are used to grind and wear away at the rock and are held in place by sleeve or roller bearings 80*b*.

In one embodiment, electrical power may be generated using a downhole turbine 83 in conjunction with an electrical generator 82. Power from the generator 82 is carried to a heater 75 through one or more power cables 71. Water 72 is pumped into the heater and boiled producing superheated fluid at high pressure that is ejected through one or more nozzles 79 in the drill bit. The heater 75 may include an insulating gap 74, as described above. Drilling mud and/or coolant is pumped down through an annular region 73 and into the borehole through one or more conduits 78. A surface assembly 90 may be attached to the tricone bit 510. The surface assembly 90 may include a conductor pipe and conductor casing 87 cemented in place 86 in a surface rock portion 85 to protect the potable water zones and provide a high pressure seal to the earth. A segmented drill string 88 is driven into the ground and rotated by the drill rig 90 and connected to a drilling fluid circulating pump 91.

In alternative embodiments of the invention, a drilling system may include a spallation system, such as any of the spallation systems described herein, coupled to other types of mechanical drill bit, such as a PDC drill bit, diamond-impregnated coring bit, or hammer drill bit. Example drilling systems including a thermal spallation system coupled to various drill bits are shown in FIGS. 6-8B.

Figure 6:
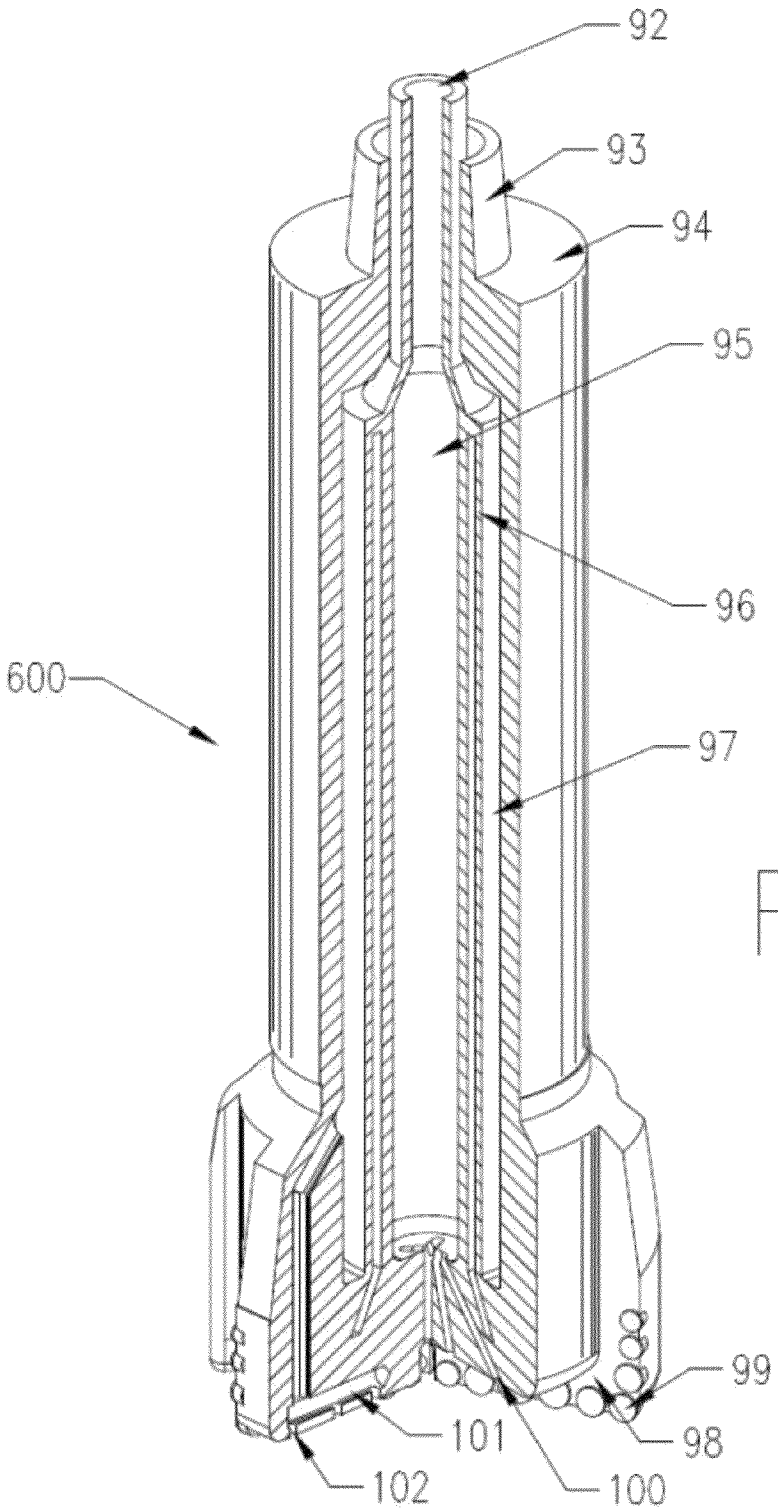
FIG. 6 is a schematic sectional perspective view of a spallation system and PDC drag drill bit, in accordance with one embodiment of the invention.

For example, FIG. 6 shows a PDC bit 600 incorporating a spallation system such as a hydrothermal spallation system. In this embodiment, fluid, including water, fuel, and oxidant, is introduced through an inlet tube 92 into a reaction chamber 95. The reaction chamber 95 may be insulated by, e.g. a pressurized air gap 96. Upon passing into the chamber 95, the reactants within the fluid contact a catalyst located within the chamber 95 and react, producing high temperature reacted fluid. The reacted fluid exits through one or more openings 100 as jets directed against a target rock face. The spallation system is contained in the drill body 94 of the PDC bit 600 and connected to a drill string at a threaded tool joint or threaded connection 93. Drilling mud or coolant is pumped down through an annular gap 97 and down to one or more outlet feeders 101 and vents 102 close to the bottom of the drill bit 600. Rotation of the bit engages flutes 98 mounted on which the compacts 99, such as, but not limited to carbide or PDC compacts, cut away at the thermally affected target rock surface. The compacts 99 are cutting elements set in the matrix of the bit body on ridges, sometimes called blades, with flutes between the blades for mud flow and cuttings passage to the annulus.

In an exemplary embodiment, nozzles 100 leading a PDC drill bit 600 may be sized to soften the rock just ahead of each cutter element (compacts) 99. Drilling through the presoftened rock will reduce the wear on the tool 600, especially the compacts 99.

Figures 7A, 7B:
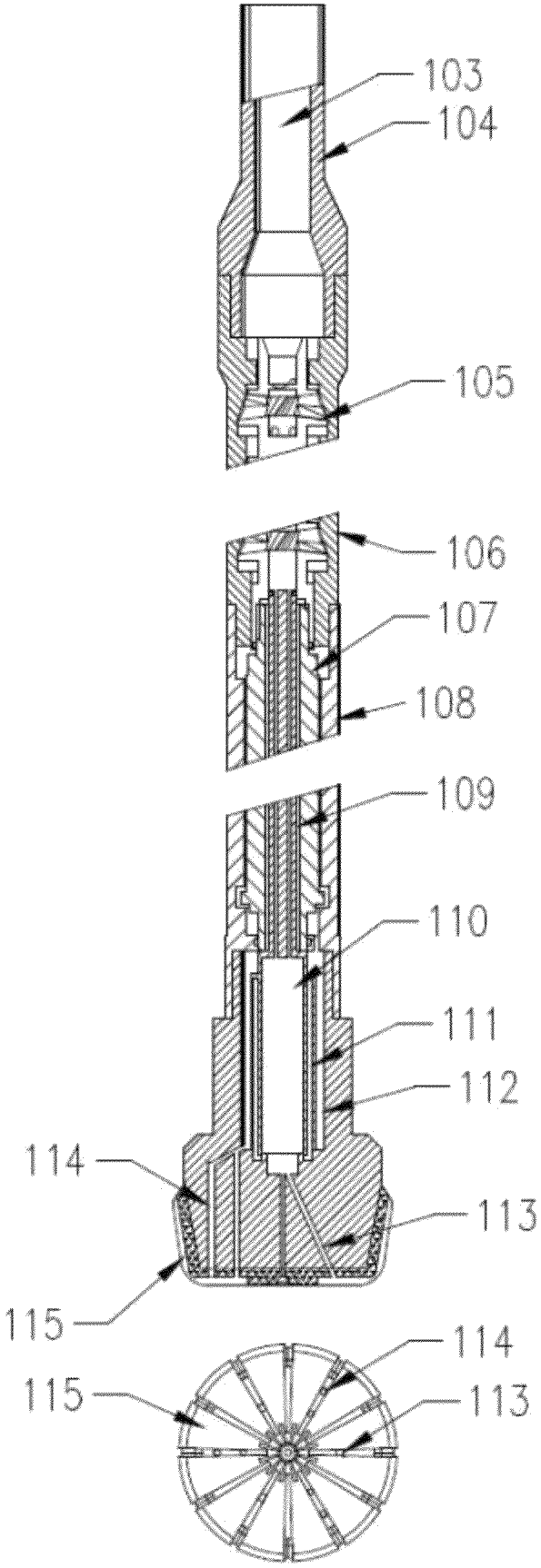
FIG. 7A is a schematic sectional side view of a thermal spallation system and a milling/abrasive drill bit, along with an induction type heater system, in accordance with one embodiment of the invention.
FIG. 7B is an end view of the thermal spallation system and a milling/abrasive drill bit of FIG. 7A.

FIGS. 7A and 7B show a drilling system 700 including an abrasive/grinding bit incorporating a hydrothermal spallation system. In this embodiment, water is pumped downhole through an opening 103 in a segmented drill string 104 into a downhole turbine or motor 105 located within a subassembly 106. The motor 105 is connected by a shaft to a water cooled rotating magnet assembly 107 contained within a housing 108. The magnet assembly 107 surrounds a non-rotating metal core 109 having a series of holes to allow a fluid to flow therethrough to remove heat generated by induction from the rotating magnets 107. This resulting super-heated fluid exits into a chamber 110 which may be insulated by an air gap 111 from a coolant fluid channel 112. The heated fluid exits through one or more nozzles 113 to interact with a target rock surface. Coolant is directed from coolant exit ports 114. An abrasive material, such as, but not limited to diamond, are surface set into or impregnated in a plurality of cutter segments (pads) 115. In operation, the super-heated fluid exiting the nozzles 113 and impinges upon the target rock surface, thereby damaging the rock and assisting the cutting of the rock by the cutter segments (pads) 115.

Figure 8A:
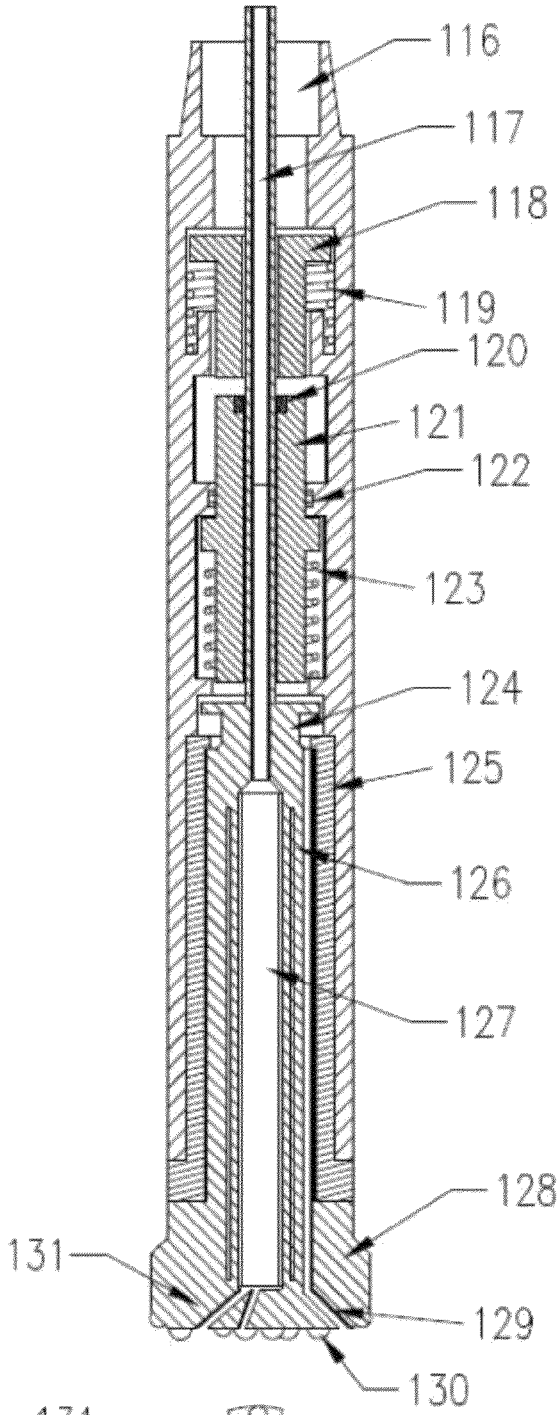
FIG. 8A is a schematic side view of a spallation system and hammer drill bit, in accordance with one embodiment of the invention.
Figure 8B:
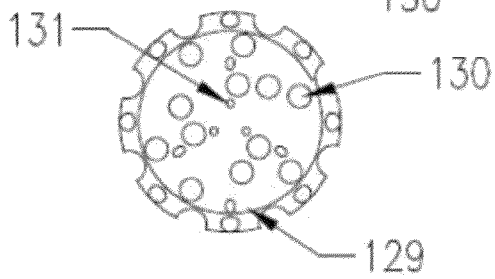
FIG. 8B is an end view of the spallation system and hammer bit of FIG. 8A.

FIGS. 8A and 8B show a drilling system 800 including a thermal spallation system coupled to a hammer drill bit. In general, a hammer drill is a drill with a hammering action. The hammering action provides a short, rapid hammer thrust to pulverize relatively brittle material and provide quicker drilling with less effort. In one embodiment, the hammer drill may additionally include a rotating motion that may be used separately or in combination with the hammering motion. When used in the hammer mode, the tool provides a drilling function similar to a jackhammer.

In the embodiment of FIGS. 8A and 8B, coolant and/or drilling fluid is introduced into a bit 800 through a drill string connector 116 (e.g. a connection to a drilling assembly that includes drill collars to provide a hammer with a large and stiff inertial load to push off of.) The drill string connector 116 connects to the drill assembly. An upper valve plunger 118 and return spring 119 is integrated into the hammer bit 800 to rapidly press a driver 121 into an anvil 124, thereby driving the distal end of the anvil 124 from a distal end 128 of the bit 800 to transmit a blow to a target rock surface. The driver 121 may include seals 120, 122, and a return spring 123. The anvil 124 is attached to the body of the bit 800 through a guide nut 125, which also prevents rotation of the bit. Integral to the anvil 124 is a thermal combustion chamber 127 which is fed a fluid including a fuel, water, and an oxidant from the surface through a separate tube 117. The combustion chamber 127 may be thermally insulated through, for example, a pressurized air gap 126. Hot fluid/gas exits the chamber 127 through one or more jets 131 distributed across the drill face. The distal end of the drill bit 128 is cooled by water or drilling mud exiting through exit ports 129. Stress to the thermally altered rock is created by the hammering action combined with drill string rotation through the carbide buttons 130.

In other embodiments, improved well control may also be achieved through the use of a hydrostatic column of a fluid such as, but not limited to, water or geothermal drilling mud, to increase hydrostatic pressure e.g. to balance formation pressure in exposed formation using, e.g., deep surface or intermediate casing and high pressure blowout prevention equipment installed on a wellhead. Thermal spallation, coupled with high velocity liquid flow through nozzles, may produce high pressure jets, pulsating jets or abrasive jets to produce a dual spallation/jet drilling system. Such dual systems may include a combination of hot and cold jets or include operating spallation jets at higher flow rates than needed to produce spallation (and thus have a jet drilling process substantially directly ahead of the nozzle and a spallation process in the wall jet that forms beyond the radius of the jet produced hole). For example, the use of high temperature fluids may greatly reduce the pressure required to achieve jet drilling in high strength rock. Additionally, the use of fluids with temperatures below the brittle-ductile transition of the rock may prevent the rock from being overheated and becoming unspallable. Alternatively, the rock may be heated above the ductile-brittle transition far enough to soften the rock enough that it can be swept away or drilled like soft to medium sediments. This may be advantageous, for example, for materials, such as basalts, which are typically less prone to spallation and not significantly damaged by heating to a temperature below the ductile-brittle transition.

A thermal degradation process or spallation formation may not be used continuously. Rather, certain embodiments of the invention may include pulsed heat treatment, such as a cyclically pulsed heat treatment. In a further alternative embodiment, the heat treatment may be alternated with a cooling treatment. Such alternation may increase the damage to the rock or may help moderate the temperature of the drilling mechanism and materials of construction while still imparting high temperature, at times, against the rock surface. In one embodiment, the thermal spallation jet(s), or other appropriate heat source, may be activated and turned off as required, thereby allowing the use of the spallation system to assist in the penetration through certain sections of a target rock, while allowing the thermal spallation process to be turned off when penetrating other sections or target rock, for example where thermal spallation is either not required or advantageous.

One embodiment of the invention includes a drill bit design for use with a thermally assisted mechanical drilling method. In one embodiment, for example in very deep/hot formations, the thermal treatment can be a cooling process, where a very low temperature jet causes microfracture of the surface through a reduction in temperature.

In one embodiment, the bulk of the fluid flow through the drilling assembly—e.g. the portion used for cooling and cuttings lift—may be relatively cool, while only a small portion—e.g. that used for thermal degradation—is hot. As a result, some, or all, of the cold fluid can be used to provide cooling to at least a portion of the drilling device. For example, cold fluid may be sent through or around the mechanical drilling structure to reduce its temperature and improve survivability. In one embodiment, cold water may be sent through flow channels in a traditional PDC or tricone bit, while the hot portion of the fluid is insulated directed substantially down against the rock. The channels transporting the hot water may be isolated from the bit by a layer of insulation, such as, but not limited to, a substantially solid, liquid, gas, or vacuum insulation layer, or a combination of the different insulation layers. In one embodiment, the relative ratio of hot/cold can be adjusted to balance the performance of the two drilling mechanisms.

One embodiment of the invention includes a spallation system including control systems, and associated methods, adapted, for example, to control the diameter of the wellbore produced by a e.g., hydrothermal jet, maintain the desired well hole trajectory, control the distance between the nozzle and the bottom of the hole (i.e. the "stand-off"), and/or ensure a sufficient temperature differential so as to induce spallation. These control systems may include software and/or hardware based control elements designed to ensure optimum performance of the thermal drilling system.

Disclosed methods may include introducing a flow of water into the borehole. This flow of water may be used, for example, to at least partially form an ascending fluid stream to carry loose material such as, but not limited to, the spalled, drilled, or otherwise loose rock from the bottom of the borehole. The returning fluid may also travel up the borehole in reverse circulation, e.g., where the fluid can be directed upward through a separate tube or annulus in the main drill string. The water flow may also be used to provide cooling for one or more parts of the system and/or surrounding rock. The provided cooling may be produced by at least one of temperature cycling, thermal protection, and a circulated cooling fluid.

In one embodiment, a heat exchanger may be coupled to a portion of the system above the nozzle of the thermal spallation system. This heat exchanger may be used, for example, to exchange heat between a working or heating fluid (e.g. a reacted fluid), spallation fluid, and loose material ascending through the borehole and the fluid being pumped to the thermal spallation system, e.g. an unreacted fluid, within a conduit extending from the surface to the thermal spallation system.

In one embodiment, one or more of properties of working fluid and jet may be selected to ensure that that the required conditions are met for optimum spallation. These jet properties may include, but are not limited to, a temperature, a heat flux, an exciting jet velocity, a heat capacity, a heat transfer coefficient, a Reynolds number, a Nusselt number, a density, a viscosity, and/or e.g., a mass flow rate. For example, these properties may be obtained through selection of the specific fluids used, by mixing of multiple fluids, and/or by treatment of the fluid through heating, cooling, pressurizing, chemically treating, or otherwise adjusting the composition of the working fluid. Exemplary ranges, without being limiting, for a thermal system for borehole creation from 1,000-30,000 feet, using a working fluid, may include those provided in Table 1 below. Such parameters may be determined by using a disclosed working fluid in several different or similar rock formations, as exemplified below, and assessing preferable ranges.

TABLE 1

Example property ranges for Hydrothermal Spallation drilling of boreholes.

| Property | Borehole creation |
|---|---|
| Temperature (C.) | 400-1200 |
| Total Heat Output (MW/m 2) | 0.1-100 (e.g. about 1-10) |
| Heat Flux (MW/m$^2$) | 0.1-100 |
| Mass Flow (lbs/min) | 0-500 |
| Exiting Jet Velocity (m/s) | 0-700 (e.g. about 400-700) |
| Heat Capacity of the Working Fluid (kJ/kg*K) | 2.26-5 |
| Heat Transfer Coefficient of Working Fluid (kW/m 2*K) | 38-56 |
| Reynolds Number (for the single, non-rotating center jet with round nozzle with diameter = 1/16 of hole diameter) | $0.5 \times 10^6$-$2.5 \times 10^6$ (for 1" hole)<br>$12 \times 10^6$-$60 \times 10^6$ (for 24" hole) |
| Nusselt Number | 30-45 (for 1" hole)<br>740-1040 (for 24" hole) |
| Density of working fluid at temperature/pressure (g/cm$^3$) | 0.01-0.1 |
| Viscosity of working fluid at temperature/pressure (cp) | 0.025-0.045 |
| Induced Strain in Rock (%) | 0-30 |
| Spall Size, 80% of total mass (mm) | 0.001-3 |

For example, a temperature at least that of the onset of rapid thermal spallation but below the, e.g. brittle ductile transition of the rock may be maintained.

The total heat output—the thermal power of the drill divided by the cross sectional area of the borehole to be drilled—may be kept, for example, between 0.1 and 100 MW/m$^2$. The heat flux—a product of the heat transfer coefficient and the temperature difference between the wall jet and the rock surface—may be kept, for example, between 0.1 and 100 MW/m$^2$. In certain embodiments, if too low a value of heat flux is used, a thermal gradient may propagate and build in the rock, reducing the relative strain of the surface rock to the underlying layer, thereby reducing or preventing spallation. In one embodiment, it is possible to increase the heat flux by increasing the Reynolds number—a dimensionless number that gives a measure of the ratio of inertial forces to viscous forces—in the nozzle exit. In certain embodiments, the heat flux of a thermal jet for spallation drilling may be increased without having the jet exceed the temperature e.g. brittle-ductile transition of the rock, by increasing the mass flow, and/or reducing the nozzle diameter (to increase the exiting jet velocity). Increasing the velocity or mass flow of the jet may also provide a mechanical or erosive means of removing material or spalls from the rock surface, clearing and providing a freshly exposed surface for further spallation, and/or help with spall and cuttings lift.

The Nusselt number—a dimensionless ratio of convective to conductive heat transfer across (normal to) the rock-fluid boundary may, in a non-limiting example, for a working fluid in one or more of the disclosed systems, be between about 30 and 1040, depending on hole size. In one embodiment, working fluid properties can be optimized so as to produce an induced strain within the grains of the rock of between about 0-30%, thereby generating enough stress to cause structural failure, which may make use of existing flaws, discontinuities, or grain boundaries in the rock and/or in-situ stresses Spall sizes may, in one embodiment, be optimized so that 80% of the transported spalls maintain a range of 0.001-3 mm. If the produced spalls are too large, they may not be lifted by the drilling fluid and may plug small openings in heat exchangers and internal returns tubes used in reverse circulation. If the produced spalls are too small, it may be an indication that the heat flux is too high, causing excessive microfracturing beyond what is needed for drilling and cuttings lift, thereby wasting energy and sacrificing efficiency, as well as increasing mineral dissolution. Spall size may also be controlled to help plug fractures leading to lost circulation or intrusion of fluids during drilling, or to attempt not to plug fractures in producing zones during e.g. hole opening for enhanced wellbore impedance.

In one embodiment, at least one property of the spalls and/or working fluid (e.g. reacted fluid) may be monitored to provide information relating to the spallation process. For example, the spall size, shape, chemical composition, and/or number of created spalls may be monitored to provide information on the efficiency of a spallation process. In addition, or in the alternative, one or more properties of the reacted fluid may be monitored to provide information on the efficiency of the catalytic reaction between the unreacted fluid and the catalyst. By monitoring one or more of these properties, information on the spallation process, such as, but not limited to, the efficiency of the heating reaction, the rate of spallation, the composition of the spalled rock, the temperature of the fluid leaving the nozzle, and/or the heat flux at the target surface may be deduced.

In an embodiment, the properties of the fluids may be used to inform the adjustment or addition of any additives into the unreacted or cooling-lift water streams. Such additives may include cleaning agents (e.g. to remove deposits from a catalyst, nozzle or heat exchanger), and additives that increase or decrease tendencies for materials in returning fluids to crystallize, precipitate, or agglomerate. Contemplated cleaning agents may include solids that are significantly abrasive to unwanted deposits but not to the ceramic or metal of the nozzle. A cleaning agent may be added continuously to a flow, or sent down periodically. Additives may also assist in the opening of existing fractures in production zones, or by preventing the produced spalls and minerals from plugging the existing fractures by e.g. mineral redeposition.

The monitoring may be carried out using at least one of a thermal measurement, an optical measurement, an acoustic measurement, a chemical measurement, and a mechanical measurement (e.g. a flow meter). For example, a laser-based optical system may be used to measure one or more properties of the spalls exiting the borehole. In alternative embodiment, any appropriate measurement device may be used.

If a change in one or more properties is observed, a property of the fluid and/or spallation system may be adjusted to compensate for the observed change and ensure optimum spallation. This adjustment may be made, for example, by adjusting one or more properties of the unreacted fluid being sent down the borehole to adjust the fluid temperature and/or heat flux created by the spallation process to maintain e.g., a pre-determined spall size. The unreacted fluid may be adjusted by changing a parameter such as, but not limited to, a chemical composition, a fluid mixture, a pressure, and/or a temperature.

In one embodiment, control of the Reynolds number of the fluid jet at the exit of the nozzle by, e.g. controlling the mass flow exiting the nozzle, controlling the nozzle size, and/or controlling the viscosity of the fluid, may assist in controlling the heat flux at the surface of the rock at the target location.

The spalls and/or reacted fluid may be monitored at the surface (i.e. after traveling from the distal end of the borehole to the surface in the ascending fluid stream). In an alternative embodiment, the spalls and/or reacted fluid may be monitored at a location part way down the borehole and/or at the distal end of the borehole. In one embodiment the spalls and/or reacted fluid are monitored at a single location. In an alternative embodiment, the spalls and/or reacted fluid are monitored at multiple locations.

One embodiment disclosed herein includes a method for excavation of a borehole in a geological formation by using a heat source, such as, but not limited to, a thermal drilling system to create a pilot borehole in a geological formation, measuring at least one property of the geology of the pilot borehole, evaluating the at least one measured property to determine whether to enlarge the pilot borehole, and enlarging the pilot borehole if the at least one measured property meets a set requirement. The pilot borehole may be enlarged by inserting at least one of a spallation drilling system and a mechanical drilling system into the pilot borehole.

This method may be advantageous in situations where a pilot borehole is to be formed in order to test the properties of the geology to determine whether further drilling and completion is warranted. The smaller pilot borehole is cheaper to drill than a larger diameter borehole, but may still allow access to the subterranean geology for testing. The pilot borehole may also be used as a guide hole for the larger borehole drilling, and may weaken the structure of the rock surrounding the pilot borehole to facilitate easier drilling of the larger borehole.

The evaluating step may include evaluating whether the geological formation is suitable for use as, for example, an injection or production borehole for at least one of a geothermal system, oil and gas, mining, excavation, or $CO_2$ or nuclear sequestration or storage. As discussed above, one or more properties of the geology of the pilot borehole may be evaluated by evaluating at least one property of spalls and/or the fluid (e.g. the reacted spallation fluid, a cooling fluid, and a drilling mud) exiting the borehole. In various embodiment, any of the drilling systems described herein may be used to create the pilot borehole and/or larger borehole Self-Casing The fluids used in the systems described herein, and/or the loose materials created by the process described herein, can, in one embodiment, strengthen and seal the walls against structural collapse and wellbore fluid loss, thereby greatly extending time interval between casing of the borehole. This may happen through processes such as, but not limited to, precipitation of materials on the surface walls of the borehole and/or depositing of loose materials within cracks and other cavities on the walls of the borehole.

In some applications, however, it may be desirable to install casing in addition to any self-casing processes produced by the systems and methods described herein. For larger diameter borehole, for example, casing may be accomplished employing conventional telescoping casing strings using methods familiar to those skilled in the art. For small diameter boreholes, the slim borehole can be cased, for example, using an expandable casing string that is inserted into the borehole and then radially expanded. The casing may be made of a malleable material, and when it is placed in the borehole, it can be radially expanded against the borehole wall upon application of an internal radial load.

The examples which follow are intended in no way to limit the scope of this invention but are provided to illustrate the methods and apparatus of the present invention. Many other embodiments of this invention will be apparent to one skilled in the art.

Example 1

An example method of testing the efficiency of a thermal spallation system is described below. This method may be used to test any appropriate spallation system on a material.

In the embodiment of Example 1, a Sierra White granite rock core measuring 4" in diameter and 6" long was prepared by pre-drilling a 0.75" diameter hole 0.5" deep on the top surface. The core was then loaded into a stainless steel pressure vessel. A preheater was assembled by winding a 20' long section of 0.125" ID stainless steel tubing in a machined groove around a 4" brass block in which contained a series of rod heaters.

The thermal spallation system included a 0.5" ID×3" long catalyst chamber which exits through a single, 0.09" diameter non-rotating nozzle located along the central axis. The catalyst chamber is filled to a height of roughly 1.5" with 0.5% platinum on 1/16" spheres having a surface area of 100 $m^2$/g. A series of stainless steel screens, spacers, and diffusers allow fluid to pass through while holding the catalyst bed in place. The drill head is insulated from surrounding cooling water by a 0.040" gap pressurized with nitrogen.

Before the start of a test, the drill head is driven to the bottom of the predrilled hole and a depth is read off of a dial indicator. The drill head is then retracted approximately 1.5" from the bottom of the hole into a large cooling water chamber.

The hydrostatic pressure in the vessel is then raised to 1600 PSI by means of a back-pressure dome regulator. An axial load of 6000 PSI and confining pressure of 3000 PSI are applied by separate pumps acting upon the core to simulate deep geological formation conditions. An air actuated pump is used to deliver 3 g/s of a 20% by volume methanol in deionized water through the preheater which raises the temperature of the unreacted fluid to 250-300° C. A high pressure oxygen flow is metered into the preheated aqueous methanol solution at sub-stoichiometric ratios.

The thermal spallation system may use a methyl alcohol fuel, and an $O_2$ oxidant. The aqueous methanol/$O_2$ solution travels through the spacers, screens, and diffuser and over or through the catalyst bed. The catalyst is not preheated and does not need an additional heat source such as a glow plug, spark, or flame for the reaction to initiated or maintained. The substantially flameless catalytic oxidation of the methanol produces heat within the water which raises the temperature of the fluid to 800-900° C.

The high temperature fluid exiting the nozzle into the cooling chamber is initially diverted and cooled by a 4 GPM water flow. The flow of aqueous methanol is increased to 9 g/s over 2 minutes while simultaneously adjusting the oxygen flow. The drill head is then driven by a high pressure fluid pump at a rate of 1.0"/min through a stainless steel seal, isolating it from the cooling water, and into the predrilled hole to a standoff of 0.25" from the rock surface, as measured by the dial indicator. The displacement of the drill head is then reduced to 0.5"/min. The drill head penetrates into the rock until it reaches the full stroke of the equipment, roughly 1.5" below the predrilled rock surface. In one embodiment, the drill head is then held at this position to demonstrate the ability of the center jet nozzle to drill in advance of the drill head and under ream. In an alternative embodiment, the drill head need not be held consistently at the bottom. Fluid and spalls exit the borehole into the cooling water above the rock via a 0.189" tube approximately 1.5" in length. The bulk fluid then passes through a series of screens which remove the bulk of the spalls before the bulk fluid passes the back pressure dome regulator and then through a low pressure hydrocyclone to remove very small size spalls. The spalls from may be separated from the bulk fluid by filtering through a 200 mesh screen which retained approximately 88% of mass of the excavated rock. Size analysis may be performed by laser light scattering.

After being held for 10 minutes at this depth, the drill head is rapidly retracted through the borehole seal, allowing cooling water to fill the hole and the jet to be diverted, quenching the spallation process. Aqueous methanol and oxygen flow rates are gradually reduced and the preheater is turned off.

Figure 18:
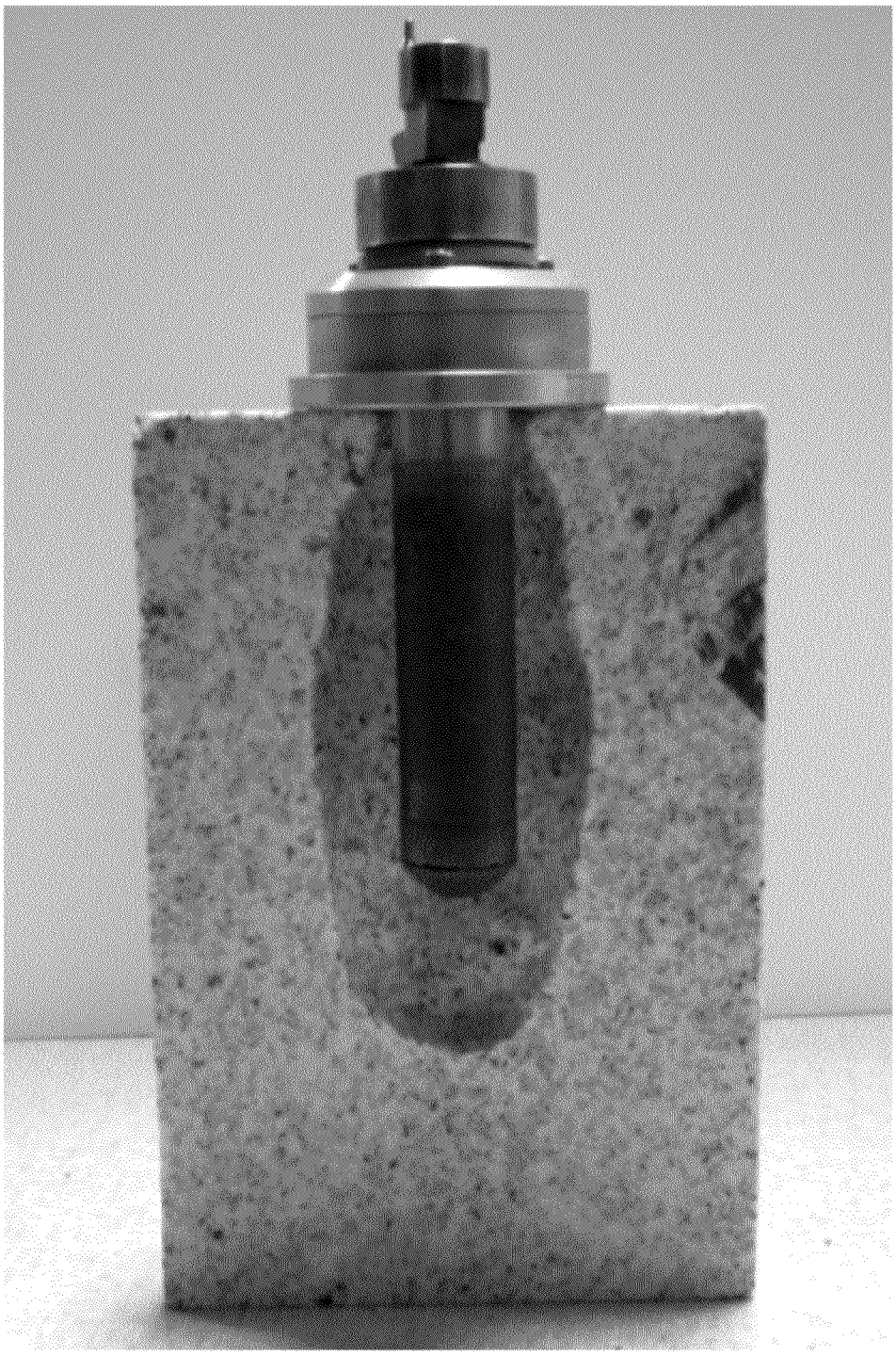
FIG. 18 is an image of a 4" diameter, 6" long, rock core with a drill head therein, in accordance with one embodiment of the invention.
Figure 22:
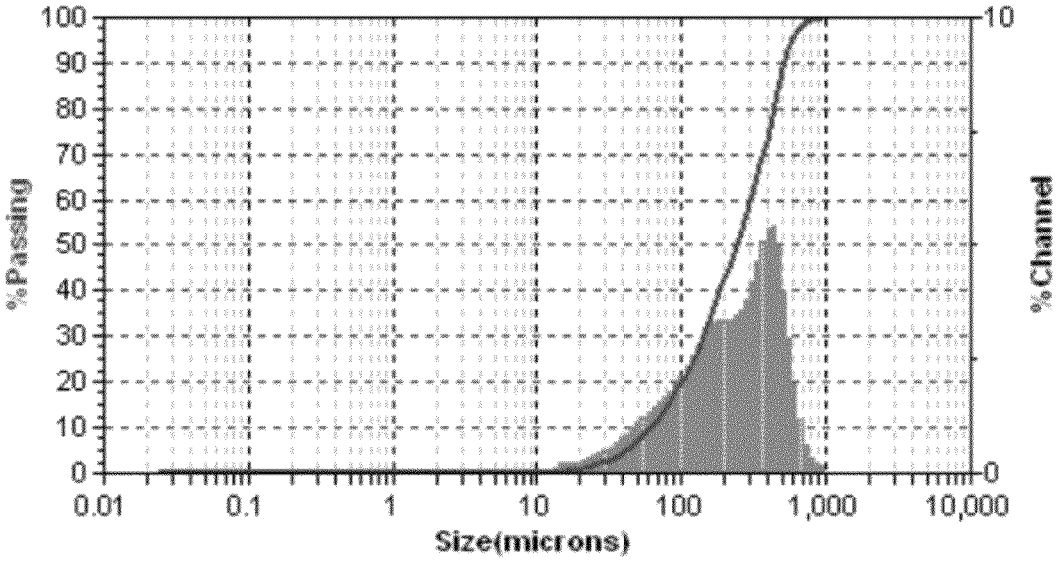
FIG. 22 shows a graph of spalled particle size distribution for an example thermal spallation drilling system.

The sample may then be removed from the cell. The volume of excavated rock may thereafter be determined from the mass of water required to fill the volume of the new borehole, less the volume of the predrilled hole. The rock core may then be dried and weighed. A image of a rock core sectioned axially following the test with the drill head that produced the borehole is shown in FIG. 18. A graph showing spalled particle size distribution for the system of Example 1 can be seen in FIG. 22.

Example 2

Repeatability and Other Rock Types

An experiment as in Example 1 was been repeated on Sierra White Granite, as shown in Table 2:

TABLE 2

Additional hydrothermal spallation drilling of boreholes in Sierra White Granite

| run # | 1 | 2 | 3 | 4 | 5 |
|---|---|---|---|---|---|
| hole volume (cc) | 104.1 | 84.9 | 55.1 | 42.6 | 57.3 |
| hole depth (cm) | 10.26 | 8.27 | 6.016 | 6.49 | 6.16 |
| final drill nozzle depth (cm) | 4.66 | 4.47 | 3.67 | 4.33 | 4.655 |
| final stand off (cm) | 5.6 | 3.8 | 2.346 | 2.16 | 1.505 |
| penetration rate(pump setting) | 200 | 400 | 600 | 800 | 990 |
| run time(sec) | 300 | 150 | 125 | 73 | 62 |
| pen rate (cm/min) | 0.9525 | 1.905 | 2.8575 | 3.81 | 4.6736 |
| quarrying rate (cc/min) | 20.82 | 33.96 | 26.448 | 35.0137 | 55.45161 |
| avg hole area ($cm^2$) | 10.1462 | 10.26602 | 9.15891 | 6.563945 | 9.301948 |
| avg hole diameter (cm) | 3.594239 | 3.6154 | 3.414893 | 2.890931 | 3.441456 |
| avg hole diam (in) | 1.415055 | 1.423386 | 1.344446 | 1.138162 | 1.354904 |
| quarrying rate ($m^3$/hr) | 0.001249 | 0.002038 | 0.001587 | 0.002101 | 0.003327 |

The process was conducted on other rock types including Sioux Quartzite, Wausau Granite, Berea Sandstone, and granodiorites, as shown in Table 3, as well as Barre, and Westerly granites:

TABLE 3

Example results for hydrothermal spallation drilling of boreholes in other rock types

| run # | 6 | 7 | 8 | 9 | 10 |
|---|---|---|---|---|---|
| rock type | wausau granite | souix quartzite | berea sandstone | granodiorite | granodiorite |
| hole volume (cc) | 202.3 | 199.1 | 195.7 | 133.5 | 131.7 |
| hole depth (cm) | 10.202 | 11.121 | 11.32 | 8.72 | 9.243 |
| final drill nozzle depth (cm) | 4.48818 | 4.445 | 4.572 | 3.62204 | 4.198 |
| final stand off (cm) | 5.71382 | 6.676 | 6.748 | 5.09796 | 5.045 |
| penetration rate (pump setting) | 9 | 18 | 27 | 9 | 9 |
| run time (sec) | 179 | 138 | 69 | 167 | 183 |
| penetration rate (cm/min) | 2.5 | 5 | 7.5 | 2.5 | 2.5 |
| quarrying rate (cc/min) | 67.81 | 86.57 | 170.17 | 47.96 | 43.18 |
| avg hole area (cm 2) | 19.83 | 17.90 | 17.29 | 36.86 | 14.25 |
| avg hole diameter(cm) | 5.02 | 4.77 | 4.69 | 6.85 | 4.26 |
| avg hole diam (in) | 1.98 | 1.88 | 1.85 | 2.70 | 1.68 |

Other tests were conducted on Sierra White Granite while independently varying a number of parameters including temperature, mass flow, axial stress, confining stress, nozzle diameter, jet velocity, heat flux, rate of drill head displacement. Table 1, above, indicates determined parameters used to enable hydrothermal spallation in one embodiment of the invention.

Other tests following Example 1 were conducted with hydrostatic pressures including near ambient, 1500 PSI (subcritical), and 3500 PSI (supercritical), to demonstrate the viability of this system from shallow to deep wellbores.

Example 3

Borehole Drilling—4" Diameter in Hard Rock

A 4" diameter hole is pre-drilled to a depth of 5" in Sierra White granite rock block measuring 24×24" square and 36" tall. A drill head interface is placed in the pre-drilled hole and sealed in place with high temperature cement. The block is centered in cylindrical steel mold 38" diameter, 44" in length, with a 0.375" wall. This mold had been split down the side and support railings were welded onto the outside edge. Bolts are used to clamp the two halves of the mold together. Concrete is poured to fill the empty volume between the rock block and mold. The concrete is allowed to cure for 10 days, after which time the bolts are tightened to provide 150 psi clamping pressure on the sample. A diagram of the apparatus is shown in FIGS. 14A-C.

Approximately 450 g of Instant Steam catalyst obtained from Oxford Catalyst PLC is loaded into a converging radial flow reactor and placed inside a 2⅞" OD drill head, as shown in FIG. 12. The drill head is slid into the drill head interface. Before the start of a test, the drill head is driven to the bottom of the predrilled hole and a depth is read off of the computer controls. The drill head is then retracted approximately 10" from the bottom of the hole to allow cooling water from the drill head interface to enter the bottom of the hole. A mixture of 38% hydrogen peroxide and 12% methanol by weight is pumped into the catalyst bed at 3200 mL/min. Neither the catalyst nor the fuel/oxidant fluid is preheated, and no additional heat source such as a glow plug, spark, or flame for the reaction is used. The mixture "lights off" over the catalyst bed producing a 800° C. jet of steam which exits a single, 0.189" diameter non rotating nozzle located along the central axis.

The drill head interface is advanced quickly through a stainless steel seal in the drill head interface, isolating it from the cooling water, and into the predrilled hole a to a distance of 5" off the bottom of the hole; the advance rate is then reduced to a setpoint drilling rate of 10'/h by a stepper motor, gear reducer, drive screw, ball nut, and static and sliding support members. A load cell is included to measure the drive force transmitted to the drill assembly. The drill is advanced to its full stroke, roughly 13" below the depth of the predrilled hole.

Figure 15:
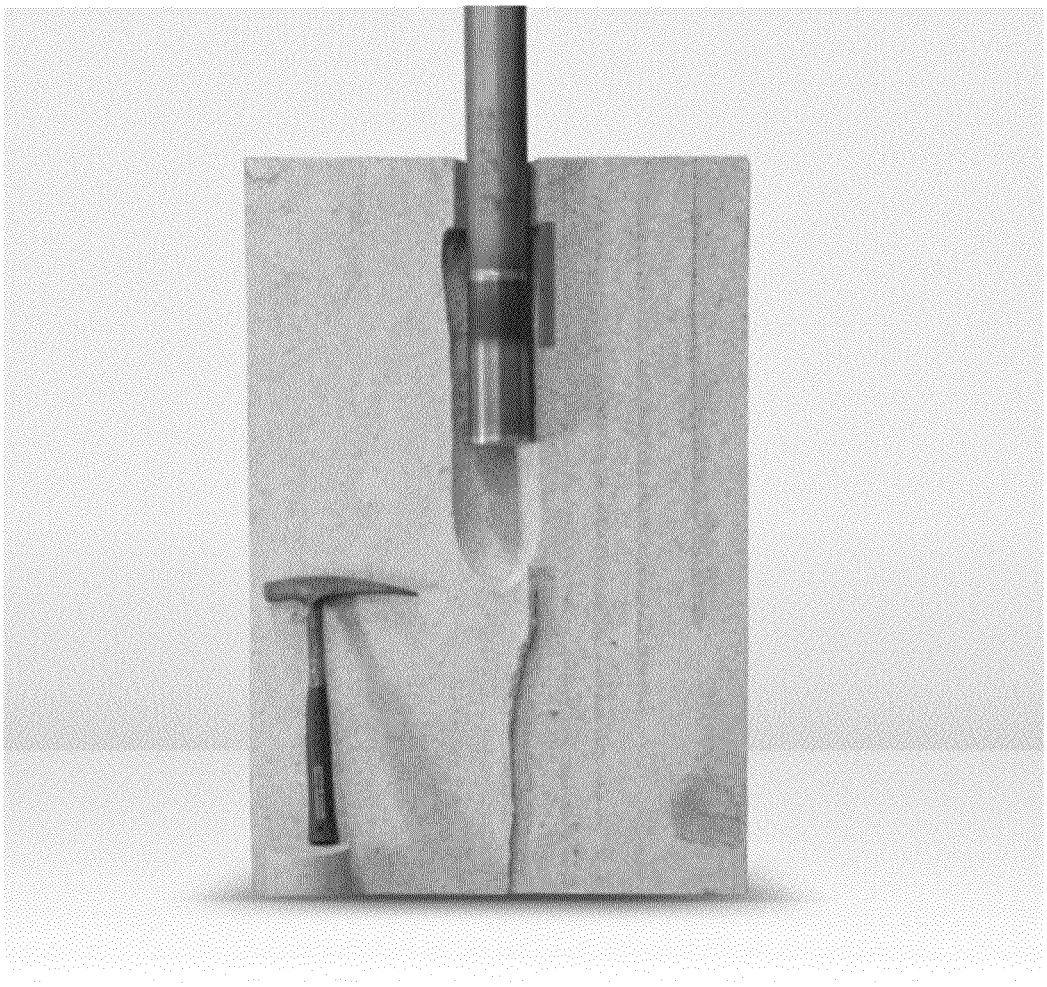
FIG. 15 is an image of a cross section of a 24"×24"×36" Sierra White Granite block after being drilled, in accordance with one embodiment of the invention.

The reaction is immediately quenched by stopping the flow of the reactants, and the drill is removed to reveal a hole that extends 5" past the final depth of nozzle exit. The sample is removed from the concrete and sectioned to display the hole that is created, as shown in FIG. 15.

Example 4

Field Drilling

A thermal spallation system can be deployed on a customized AmKin 800 V track mounted coiled tubing unit. A 20' long 2⅞-3½" OD bottom hole assembly is prepared from instrumentation and controls subassembly (or "sub"), a release sub, a dynamic barrier sub, stabilizers and centralizers, and an iteration of the steam generation sub described in Example 4. The steam generation sub houses an axial catalyst bed 2½" in diameter and 12" long filled with Oxford Catalysts Instant Steam catalyst. The bottom hole assembly is attached to a Tenaris HS-90 2.00" steel coiled tubing with a 0.134" wall through a connector sub. Inside of the coiled tubing, a ⅜" OD nitric-acid passivated stainless steel capillary is housed to transport the unreacted fluid to the steam generation sub, and a 5/16" 7-conductor wireline cable is used for communication in the instrumentation controls sub.

A starter well is drilled into competent rock and lined with 4" ID casing. At the top of the casing is mounted a wellhead diverter with stripper rubber. The bottom hole assembly and coiled tubing is run through a wellhead diverter seal to the bottom of a water-filled 300' hole.

The unreacted fluid is prepared at the surface by continuously metering 52% high test peroxide, reagent grade methanol, and deionized water into a mix tank to produce 38% peroxide and 12% methanol. The mixture is pumped through the capillary at 1 gallon per minute to the catalyst bed where it self-energizes and reacts with the catalyst element without the need for an external energy source (such as a spark, glow plug or flame holder) thus generating a 800 C reacted fluid, without an inherently unstable flame or the need for cooling water to protect the materials of construction or overheating of the rock. This reacted fluid is then emitting through a 0.189" nozzle and directed at the bottom of the hole, causing rapid spallation of the rock. The coiled tubing is fed into the hole at a rate of 20'/h by means of the coiled tubing injector on the AmKin 800 V continuously drilling a 4" borehole in the solid granite. Spalls are swept through the dynamic seal assembly where they meet a 50 gallon per minute flow of water flow, which has traveled down inside the 2" coiled tubing and exited a series of upward pointing jets, to cool the reacted fluid and carry the spalls to the surface. At the surface, the spalls are removed by a series of "shakers", cyclones, and filters, the water is cooled by a 200 kW mud cooler, and continuously recirculated.

Example 5

Multilaterals with Hole Opening

A system as described in Example 4 can be used to create multilaterals. At the desired depth, the bottom hole assembly is deviated, the spallation jet is directed at the wall of the borehole causing the drill to create a hole off-axis from the existing borehole. The bottom hole assembly is advanced using the coiled tubing injector and intersects additional fracture networks which can provide flow to the main wellbore. When the final target depth ("TD") is reached, the unreacted fluid is directed through a second catalyst bed that is in fluid communication with 6 jets oriented normal to the axis of the bottom hole assembly and spaced 60 degrees apart around the circumference of the tool. The unreacted fluid is pumped again and reacted fluid exits the circumferential jets, expanding the diameter of the wellbore as the bottom of the hole assembly is withdrawn on the coiled tubing. Periodically, this hole opening process is paused and the well is allowed to produce fluid, blowing produced spalls and loose rock from the fractures. Flow sensors including "spinners", and thermocouples are used to infer the flow rate from a given fracture. If additional hole opening is required, the hole opening is restarted. In certain sections of the well where larger/global hole opening is desired, the bottom hole assembly can be held in place, causing extensive spallation, macrofracturing, breakout and collapse of sections in the producing zone.

Example 6

Hole Opening of a 0.75" Borehole

Using the procedure of Example 1, a Sierra White granite rock core measuring 4" in diameter and 6" long was prepared by pre-drilling a 0.75" diameter hole 4" deep on the top surface. The core was then loaded into a stainless steel pressure vessel described in Example 1.

The thermal spallation system includes a 0.5" ID×3" long catalyst chamber which exits through a single, 0.04" diameter non-rotating nozzle oriented perpendicular to the existing predrilled hole. The catalyst chamber is filled to a height of roughly 1.5" with 0.5% platinum on 1/16" spheres having a surface area of 100 $m^2/g$. A series of stainless steel screens, spacers, and diffusers allow fluid to pass through while holding the catalyst bed in place. The drill head is insulated from surrounding cooling water by a 0.040" gap pressurized with nitrogen. The drill head is held in a large cooling water chamber during start up.

The hydrostatic pressure in the vessel is then raised to 1600 PSI by means of a back-pressure dome regulator. An axial load of 4500 PSI and confining pressure of 3000 PSI are applied by separate pumps acting upon the core to simulate deep geological formation conditions. An air actuated pump is used to deliver 3 g/s of a 20% by volume methanol in deionized water through the preheater which raises the temperature of the unreacted fluid to 250-300° C. A high pressure oxygen flow is metered into the preheated aqueous methanol solution at sub-stoichiometric ratios.

The thermal spallation system uses methyl alcohol fuel, and an $O_2$ oxidant. The aqueous methanol/$O_2$ solution travels through the spacers, screens, and diffuser and over or through the catalyst bed. The catalyst is not preheated and no additional heat source is used. The catalytic oxidation of the methanol produces heat within the water which raises the temperature of the fluid to 800-900° C.

The high temperature fluid exiting the nozzle into the cooling chamber is initially diverted and cooled by a 4 GPM water flow. The flow of aqueous methanol is increased to 9 g/s over 2 minutes while simultaneously adjusting the oxygen flow. The drill head is then driven by a high pressure fluid pump at a rate of 7.5 cm/min through a stainless steel seal, isolating it from the cooling water, and into the predrilled hole. The reacted fluid spalls the wall of the borehole until it reaches the full stroke of the equipment, roughly 1.5" below the predrilled rock surface. Fluid and spalls exit the borehole into the cooling water above the rock via a 0.189" tube approximately 1.5" in length. The bulk fluid then passes through a series of screens which remove the bulk of the spalls before the bulk fluid passes the back pressure dome regulator and into a large collection tank.

The drill head is rapidly retracted through the borehole seal, allowing cooling water to fill the hole and the jet to be diverted, quenching the spallation process. Aqueous methanol and oxygen flow rates are gradually reduced and the preheater is turned off.

The sample is then removed from the cell. A large slot is formed along the length of the predrilled hole in the same orientation as the jet, increasing the diameter by roughly 2×.

Figure 19:
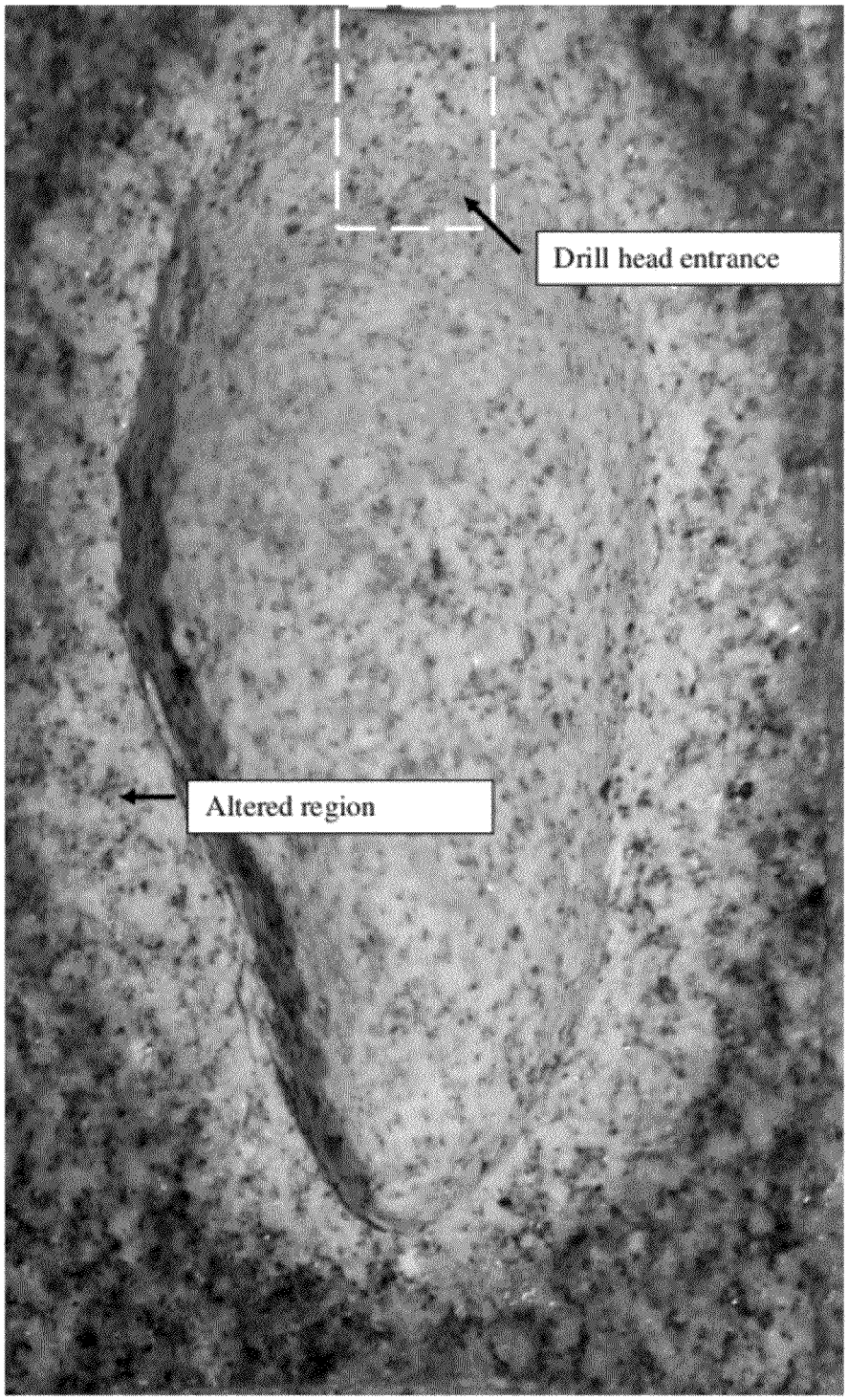
FIG. 19 is an image of a 4" diameter, 6" long rock core where an initial predrilled borehole (represented by the dotted line) is opened, increasing the borehole diameter and producing a thermally affected zone, in accordance with one embodiment of the invention.

Effective experiments, following Example 5, holding the jet stationary to open the hole globally; using axial jets, multiple jets, and diffuse heating; and where rock is intentionally fractured either or parallel or normal to either the existing borehole or the jets have also been conducted. In one embodiment, as shown in FIG. 19, using a vertical spallation jet in a predrilled 7/8" hole 1" deep (shown as dashed lines) into a 4" diameter rock core increased the diameter by roughly 2× and created a thermally affected zone (shown by arrow) of highly altered materials with reduced strength, as determined by SEM-EDAX, thin sections, microscopy, punch and modified Chercar testing.

Example 7

Thermal and Mechanical Drilling

Spalls and/or a reacted rock region can be formed as described above. A reamer element, including one or more reamer elements mounted to the housing and located back from the distal portion of the thermal spallation system, can then be used to ream the thermally effected rock at the outer sides of the borehole created by the thermal spallation system to enlarge and/or shape the borehole, as required.

Example 8

Thermal Heating and TSP Drag Bit

Spalls and/or a reacted rock region can be formed as described above. A drag bit with TSP cutters is then used to remove the thermally effected rock from the borehole more easily than if the rock was not heated.

Example 9

Rock Sample Tests

Thin sections: samples extracted from rocks in Examples 1-4 were cut into small sections using diamond blades and sent to a thin section preparation laboratory. The samples were evacuated and saturated with a blue epoxy to identify pores and fractures. The samples were polished and then mounted to a glass slide and the section ground down to a thickness required using a transmission microscope with polarizing lens to determine mineral structure alteration and other microscopic features.

Microscopic observations on the regions near the borehole suggest thermal fracturing of grains especially quartz and feldspars but little or no alteration of these minerals is apparent in the micrographs.

Binocular microscope: samples were inspected with a binocular microscope looking for evidence of alteration fractures and other feature associated with changes in the physical or chemical properties due to the rapid heating accompanying hydrothermal spallation. Radial crack were identified in many of the samples that have the appearance of being filled with small quartz remnants (spalls). A general bleaching of the thermally altered surface suggests removal of iron and other color generating compounds.

Punch tests: a small spring loaded punch (pointed tool steel) was used to remove small amounts of rock. The spring force on each punch when triggered is approximately 15 pounds total. The removed rock was collected and the total amount weighed. A series of punches tests (20 ea) were used on each sample on the thermally affected zone and on virgin rock, and results shown below:

| Rock Type | Rock Removed (grams from 20 punches) Untreated | Thermally-Affected Zone | % Increase |
|---|---|---|---|
| Sierra White Granite | 0.014 | 0.084 | 600% |
| Red Wausau Granite | 0.019 | 0.044 | 232% |
| Diorite | 0.017 | 0.057 | 335% |
| Souix Quartzite | 0.017 | 0.027 | 159% |
| Berea Sandstone | 0.053 | 0.127 | 240% |

Figure 21:
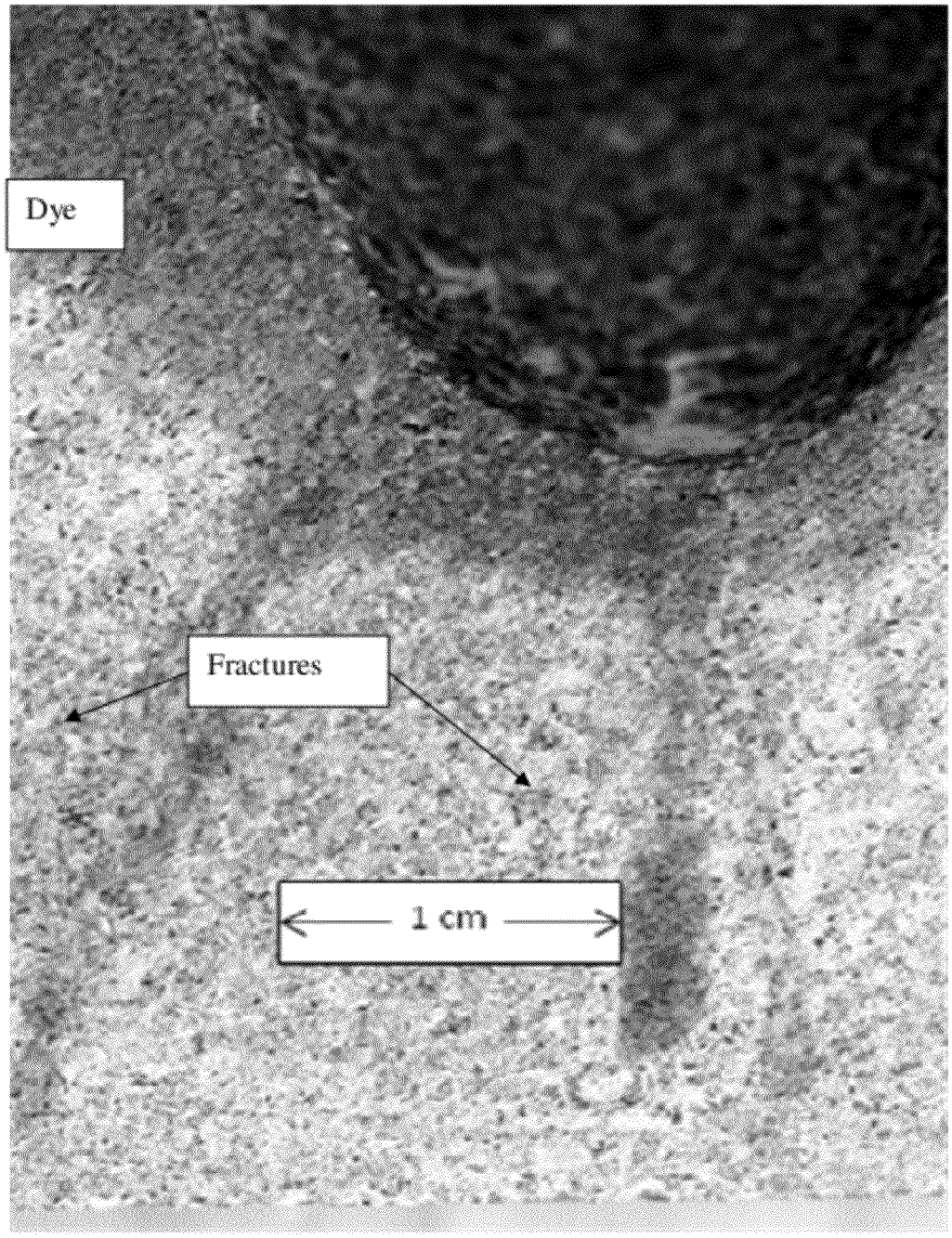
FIG. 21 is an image of a slabbed Granodiorite sample subjected to spallation drilling followed by a dye penetrant which indicates a zone of microfracturing and several distinct linear fracture zones emanating perpendicular to the borehole region, in accordance with one embodiment of the invention.

Dye penetrant: a visual dye penetrant was applied to the surface of the thermally altered rocks to see the extent and depth of the fracturing/alteration. After application the rocks were visually inspected with the binocular microscope. FIG. 21 shows an image of an example diorite sample indicating the depth of penetration of the dye into the altered zone and the flow of dye into two smaller fracture zone perpendicular to the altered region. In various embodiments of the invention, dye penetration from about 0.7 cm, at the regions closest to where the jet is impacting the rock, to approximately 1.5 cm further up the annulus, where the rock has been exposed to the superheated fluid longer, may be achieved.

REFERENCES

All publications and patents mentioned herein, including those items listed below, are hereby incorporated by reference in their entirety as if each individual publication or patent was specifically and individually incorporated by reference. In case of conflict, the present application, including any definitions herein, will control.

U.S. Pat. No. 5,771,984; U.S. Pat. No. 7,742,603; U.S. Pat. No. 7,025,940; US2008/0093125

"Feldspars and Feldspathoids, Structures, Properties, and Occurrences: Structures, Properties and Occurrences," by William L. Brown, North Atlantic Treaty Organization Scientific Affairs Division, Published by Springer, 1983.

"Hydrolytic weakening of quartz and other silicates," by D. T. Griggs, Geo-phys. J. Roy. Astron. Soc., 1967.

"Origin of granite in the light of experimental studies," by Tuttle, O. F. and N. L. Bowen, Geol. Soc. Am. Mem. 74, 1958.

EQUIVALENTS

While specific embodiments of the subject invention have been discussed, the above specification is illustrative and not restrictive. Many variations of the invention will become apparent to those skilled in the art upon review of this specification. The full scope of the invention should be determined by reference to the claims, along with their full scope of equivalents, and the specification, along with such variations.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in this specification and attached claims are approximations that may vary depending upon the desired properties sought to be obtained by the present invention.

The terms "a" and "an" and "the" used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided herein is intended merely to better illuminate the invention and does not pose a limitation on the scope of the invention otherwise claimed. No language in the specification should be construed as indicating any non-claimed element essential to the practice of the invention.

Having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A method of spalling a material, comprising:

directing a fluid having a temperature greater than about 500° C. above the ambient temperature of the material and less than about the temperature of the brittle-ductile transition temperature of the material to a target location on the surface of the material; wherein the fluid produces a heat flux of about 0.1 to about 50 $MW/m^2$ at an interface between the fluid and the target location, and thereby creating spalls of the material.

2. The method of claim 1, wherein the fluid has a temperature greater than about 600° C.

3. The method of claim 1, wherein the fluid has a temperature less than about 900° C.

4. The method of claim 1, wherein the method further includes providing a spallation system comprising at least one nozzle.

5. The method of claim 4, wherein the fluid is directed through the at least one nozzle to the target location.

6. The method of claim 1, wherein the fluid produces a heat flux of about 1 to about 20 $MW/m^2$ at an interface between the fluid and the target location.

7. The method of claim 1, wherein the fluid is directed through one nozzle.

8. The method of claim 7, wherein the nozzle is adapted to direct the heated fluid from the drilling system substantially along an elongate central axis of the drilling system.

9. The method of claim 7, comprising directing the fluid from the at least one nozzle in a cyclically pulsing flow.

10. The method of claim 7, comprising directing the fluid from the at least one nozzle in a substantially continuous flow.

11. The method of claim 1, further comprising selecting the fluid to have a specified value of a parameter selected from the group consisting of a temperature, a heat flux, an exciting jet velocity, a heat capacity, a heat transfer coefficient, a Reynolds number, a Nusselt number, a density, a viscosity, and a mass flow rate.

12. The method of claim 11, wherein the fluid has an exiting jet velocity of about 400 to about 700 m/s.

13. The method of claim 11, wherein the fluid has a heat capacity of about 2.26 to about 3 kJ/kg·K.

14. The method of claim 11, wherein the fluid has a heat transfer coefficient of about 38 to about 56 $kW/m^2 \cdot K$.

15. The method of claim 11, wherein the directed fluid has a Reynolds number of about $0.5 \times 10^6$ to about $60 \times 10^6$.

16. The method of claim 11, wherein the directed fluid has Nusselt number of about 30 to about 45 or about 740 to about 1040.

17. The method of claim 11, wherein the fluid has a density of about 0.01 to about 0.1 $g/cm^3$.

18. The method of claim 11, wherein the fluid has a viscosity of about 0.025 to about 0.045 cP.

19. The method of claim 1, further comprising monitoring at least one property of the spalls.

20. The method of claim 19, wherein the spall size and/or shape is monitored.

21. The method of claim 19, further comprising adjusting the fluid temperature and/or heat flux to maintain a pre-determined spall size.

22. The method of claim 19, further comprising adjusting at least one parameter of the method in response to a change in the at least one of a property of the spalls, a hole diameter, a rate of penetration, and a standoff distance.

23. The method of claim 1, further comprising monitoring the fluid after the fluid is in contact with the material and/or after spalls have formed.

24. The method of claim 1, wherein the fluid comprises water.

25. The method of claim 1, wherein the material is rock.

26. A method for excavation of a borehole in a geological formation, comprising:

using a thermal drilling system to create a pilot borehole in a geological formation;

measuring at least one property of the geology of the pilot borehole;

evaluating the at least one measured property to determine whether to enlarge the pilot borehole, wherein the evaluating step comprises evaluating whether the geological formation is suitable for use as an injection or production borehole for at least one of a geothermal system, resource mining, excavation, or $CO_2$ or nuclear sequestration or storage; and enlarging the pilot borehole if the at least one measured property meets a set requirement.

27. The method of claim 26, wherein the pilot borehole is enlarged by inserting at least one drilling system into the pilot borehole.

28. The method of claim 27, wherein the thermal drilling system is a spallation drilling system.

29. A method for excavation of a borehole in a geological formation, comprising:

using a thermal drilling system to create a pilot borehole in a geological formation;

measuring at least one property of the geology of the pilot borehole, wherein the property of the geology of the pilot borehole is evaluated by evaluating at least one property of a fluid exiting the borehole; evaluating the at least one measured property to determine whether to enlarge the pilot borehole; and enlarging the pilot borehole if the at least one measured property meets a set requirement.

30. The method of claim 29, wherein the fluid is at least one of a spallation fluid, a cooling fluid, and a drilling mud.

31. A method for excavation of a borehole in a geological formation, comprising:

using a thermal drilling system to create a pilot borehole in a geological formation, wherein using a thermal spallation system comprises directing a fluid having a temperature greater than about 500° C. above the ambient temperature of the rock and less than about the temperature of the brittle-ductile transition temperature of the rock to a target location on the surface of the rock; wherein the fluid produces a heat flux of about 0.1 to about 20 $MW/m^2$ at an interface between the fluid and the target location;

measuring at least one property of the geology of the pilot borehole;

evaluating the at least one measured property to determine whether to enlarge the pilot borehole; and enlarging the pilot borehole if the at least one measured property meets a set requirement.

* * * * *